US007677071B2

(12) United States Patent
Heirich

(10) Patent No.: US 7,677,071 B2
(45) Date of Patent: Mar. 16, 2010

(54) APPARATUS FOR THE FABRICATION OF METAL WALL FRAME MEMBERS AND ASSEMBLY OF WALL FRAMES THEREFROM, AND FOLDABLE WALL FRAME STRUCTURES

(75) Inventor: William C. Heirich, Littleton, CO (US)

(73) Assignee: BH Legacy, LLC, Muskogee, OK (US)

( * ) Notice: Subject to any disclaimer, the term of this patent is extended or adjusted under 35 U.S.C. 154(b) by 691 days.

(21) Appl. No.: 11/446,317

(22) Filed: Jun. 2, 2006

(65) Prior Publication Data

US 2007/0277463 A1 Dec. 6, 2007

(51) Int. Cl.
*B21D 5/08* (2006.01)

(52) U.S. Cl. ..... 72/181; 72/132; 72/177; 72/183; 72/363

(58) Field of Classification Search ..... 72/8.6, 72/10.3, 11.4, 12.3, 129, 131, 132, 176, 177, 72/178, 179, 180, 181, 182, 183, 224, 225, 72/248, 363; 29/897.3, 897.31, 897.312, 29/897.32

See application file for complete search history.

(56) References Cited

U.S. PATENT DOCUMENTS 1,955,072 A * 4/1934 Jordan ..... 72/177
3,452,433 A * 7/1969 Scofield ..... 29/882
3,636,903 A * 1/1972 Anderson et al. ..... 72/52
3,888,099 A * 6/1975 Allen ..... 72/129
4,028,794 A * 6/1977 Ritchie et al. ..... 29/882
4,655,067 A * 4/1987 Frost et al. ..... 72/131
4,680,951 A * 7/1987 Brach ..... 72/160
5,501,053 A * 3/1996 Goleby ..... 52/842
5,787,748 A * 8/1998 Knudson et al. ..... 72/181
6,813,919 B1 * 11/2004 Ellis ..... 72/7.1
6,997,026 B2 * 2/2006 Fischer ..... 72/181
7,096,702 B2 * 8/2006 McDonald ..... 72/181
7,310,984 B2 * 12/2007 White ..... 72/131

* cited by examiner

*Primary Examiner*—Edward Tolan
(74) *Attorney, Agent, or Firm*—Fellers, Snider, Blankenship, Bailey & Tippens

(57) ABSTRACT

An apparatus is disclosed for roll forming metal components including substantially channel-shaped members for use in a building structure. The apparatus includes a support frame assembly having front and rear portions. A mechanism is provided for selectively feeding at least one metal strip into the support frame assembly, the metal strip having a pair of side edges and a center web. A plurality of driver roll elements are mounted along the support frame assembly and are adapted to move the metal strip through the frame assembly. Finally, a plurality of spaced idler forming rolls are mounted for free rotation in pairs along the support frame assembly. The idler forming rolls are adapted to simultaneously air form the side edges of the metal strip into angularly extending side flanges by urging the side edges in opposing directions from the center web as the metal strip is moved along the frame assembly by the driver roll elements. In addition, a device for feeding metal strips to the roll forming apparatus is disclosed along with an apparatus for assembling metal wall frame structures, both stationary and foldable forms thereof, from channel-shaped members.

26 Claims, 53 Drawing Sheets

FIG. 4
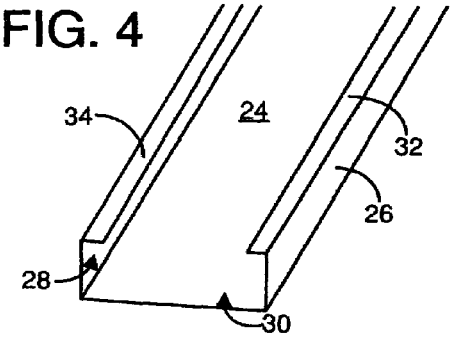
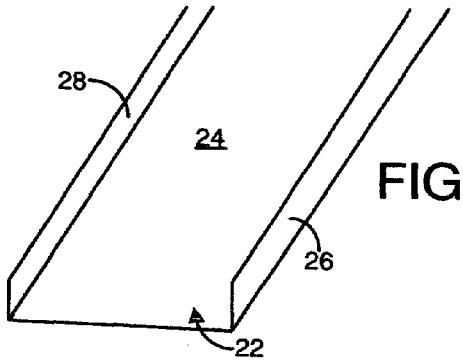
FIG. 3
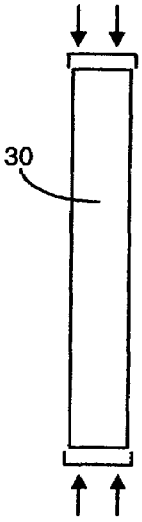
FIG. 5A
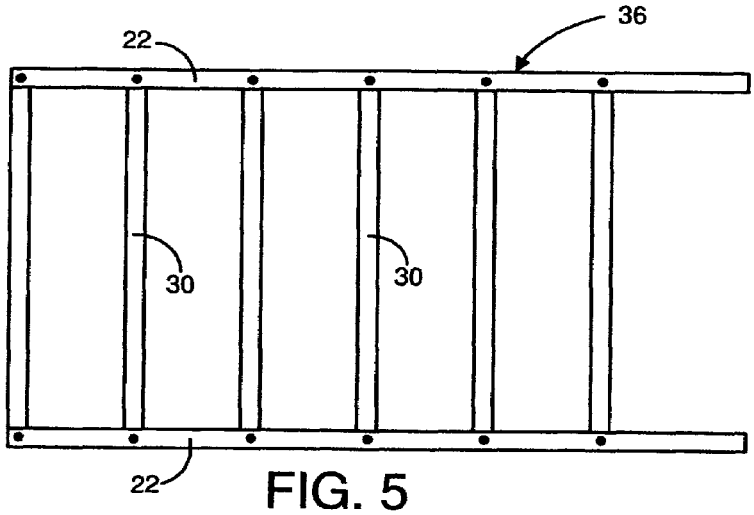
FIG. 5
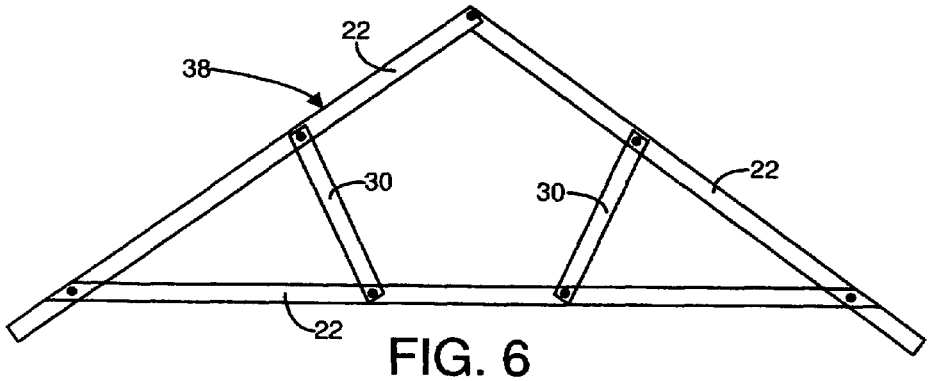
FIG. 6

FIG. 12
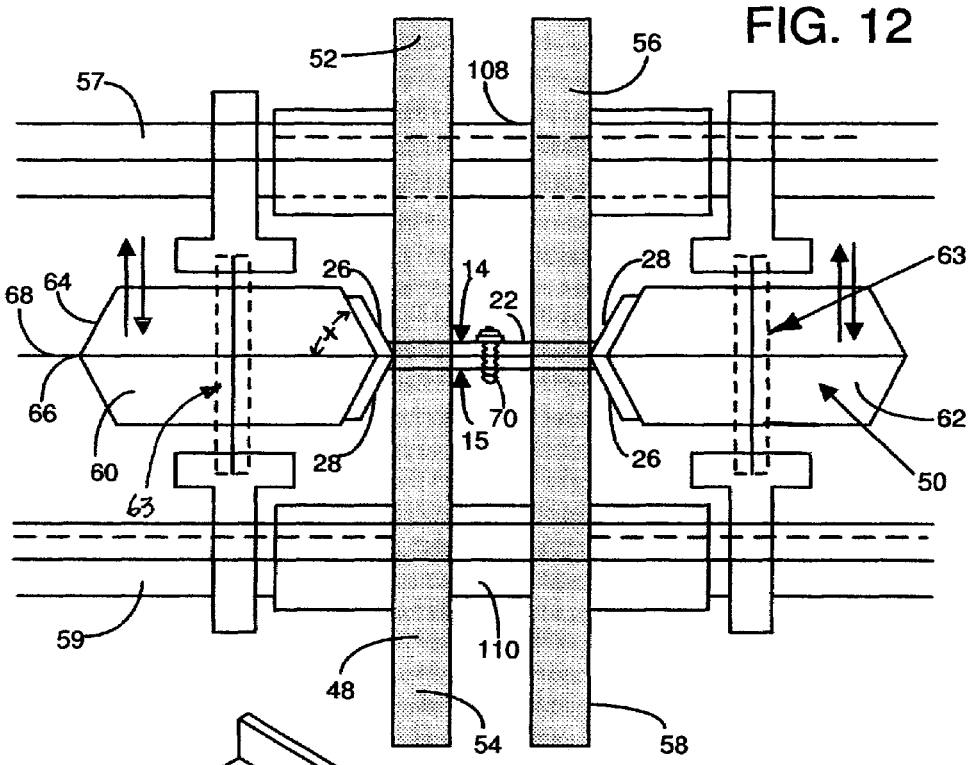
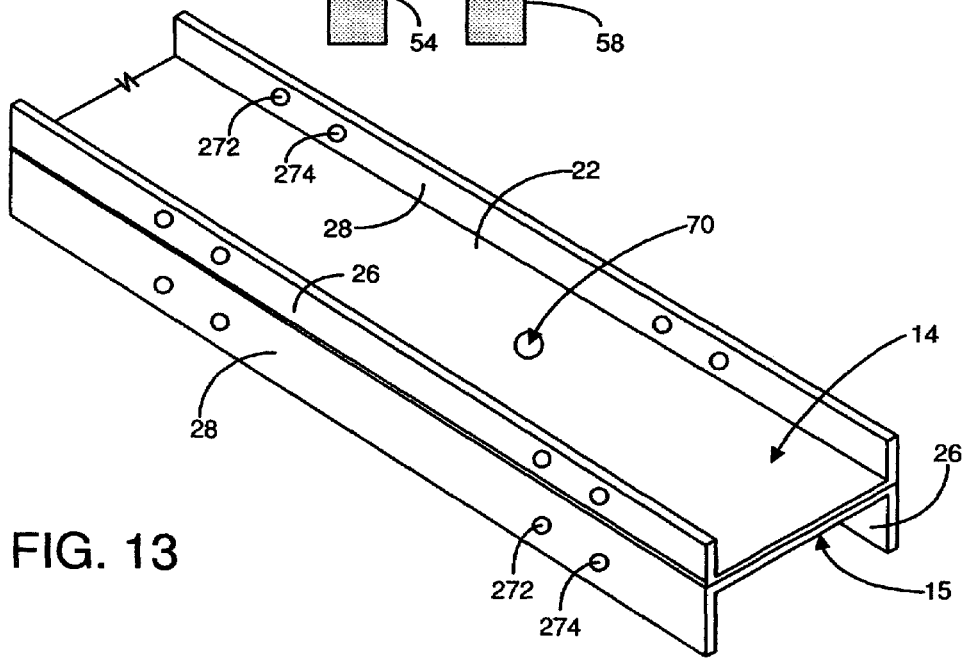
FIG. 13

152
216
214
228
224
226
218
220
222

APPARATUS FOR THE FABRICATION OF METAL WALL FRAME MEMBERS AND ASSEMBLY OF WALL FRAMES THEREFROM, AND FOLDABLE WALL FRAME STRUCTURES

BACKGROUND OF THE INVENTION

1. Field of the Invention

The present invention relates generally to the fabrication and assembling of building frame components and, more particularly, to devices for accomplishing this. Specifically, the present invention relates to apparatus for the efficient and precise formation of metal frame components to enable easy assembly and use of the same in both commercial and residential structures.

2. Description of the Prior Art

In general, wall structures for both residential and commercial construction have been made over the years using the so-called stick framing method and construction. In such stick frame construction, the structural walls are made from wood studs, and the top and bottom wood framing members are called plates. Typically, the studs and plates are made from two-by-four lumber members which are generally 2" in thickness and 4" in width cut to the desired length. Stick framing generally involves the technique of nailing the studs to the top and bottom plates and are normally spaced 16" on center to form a building structural wall. Systems for arranging these components into wall structures are illustrated in U.S. Pat. Nos. 3,986,247, 4,876,787 and 5,646,860.

In recent years, high-rise and other commercial building structures have replaced standard stick frame construction with steel structures. High-rise buildings typically employ straight column members subjected to high axial compression forces. The use of solid or rectangular rolled-steel sections typically in the form of steel studs supported between steel tracks has now become the standard construction format for commercial wall construction. Such steel members can be produced economically in a wide range of sizes and are readily assembled into wall and window sections. Examples of such devices are illustrated in U.S. Pat. Nos. 3,877,129 and 4,078,288.

Light gauge steel framing has been available to the construction market for well over forty years now. In fact, it has become the dominant, i.e. greater than 90 percent, construction technique in the commercial industry. However, wood is still the dominant framing material in the residential construction field, still amounting to about 85-92 percent. Considerable time and money has been expended by numerous trade and industry organizations, particularly during the past ten or twelve years, in study and research to determine why there is this vast difference in usage between these two construction fields, which at first glance would appear to have equal need and use for this material in their respective construction fields. As a result of the above findings, it has been determined that there has been noticeable progress made by light gauge steel framing in gaining a larger portion of the residential building market. Nonetheless, this progress has been a slow, moderate increase as opposed to the extreme dominance of steel framing vs. wood stick framing which has occurred in the commercial construction field.

There are a number of reasons for this disparity of usage of steel framing between these two fields of construction. Among the obstacles faced are traditional residential construction approaches as well as production methods for steel framing components. The production method of choice for producing light gauge steel framing has been, and will most likely continue to be, cold roll forming. This is due to its inherent low production cost with almost no material scrap loss factors. During the last 50 years, cold roll forming of steel has gone from substantially a "black art" with machines and materials which required considerable operator experience and skill, to a production technology which today is performed by higher precision machines and with fewer operator skills while using materials that are much more uniform in quality.

There are two main components used in light gauge metal framing. These components include studs (similar to wood framing) which in walls are the vertical members, and tracks, which are the top and bottom horizontal frame members to which the studs are attached. Both components are basically a U-shape component with the studs having inwardly turned stiffened lips on the outer distal edge of each leg, whereas the tracks do not. The tracks are dimensioned widthwise to fit over the ends of the studs, and the stud and track members are used to frame wall sections. The same basic shapes in wider and heavier gauge sizes are also used for floor framing sections. Both shapes are also used to assemble roof and other truss members of considerable spanning and load carrying capabilities.

Traditional cold roll forming devices consist of sets of two driven shafts positioned one above and one below a metal sheet passing through the device. Mounted on these shafts are roll elements whose profile has been machined to bend or form a strip of flat metal as it passes between the tightly spaced roll contours. This set of shafts, rolls and the mechanism that drives them is referred to as a roll pass. A roll former will consist of a number of such roll passes mounted in a flat steel base with all passes being mounted in a straight line, and with all shafts in parallel with each other. The profile of each set of rolls in each succeeding pass is designed to gradually change the cross section of the initially flat metal strip fed into the machine, into the final desired shape as it passes through the sets of rolls. The number of passes required will vary with the complexity of the shape being formed as well as the type of material, its thickness and physical properties.

Typically, the lower shaft is in a fixed position and is non-adjustable vertically. The upper shaft is typically vertically adjustable, usually having compression springs mounted between the bearing blocks of the upper and lower shafts which are sufficiently strong so as to not only support the weight of the upper shaft and its rolls, but to also hold it firmly against adjustment screws which limited the extent the shaft and its roll can move upwardly. The design and machining of the rolls is done in a manner to allow a particular gauge or thickness of metal strip to pass between them. This space or clearance between the rolls is usually a compromise to allow clearance for more than one gauge to pass through the machine by making adjustment of the screws located above each bearing of the upper shaft.

The clearance or space between the upper and lower roll contours must be sufficient to allow the rolls to slip against the metal strip being formed as there is obviously only one point on the circumference of each roll, called the drive point, at which the metal strip and the surface of a given roll can be traveling at the same speed. This point will vary with each set of rolls in each pass, in that the rolls not only form the metal strip but also function to drive the strip through the machine. The balance of the metal strip and roll surfaces are sliding in relationship to each other.

To successfully roll form a finished shape, the metal's yield strength must not be exceeded as the metal is formed by the rolls. Otherwise, strains can be induced at the points where it is exceeded which in turn can result in stretched metal with residual stresses that can distort, twist and curve the shape of the finished part. Assuming that the roll tooling has been properly designed to avoid this particular problem, there are a number of other factors which still cause problems in existing roll forming technology. The rolls in a typical roll forming device are typically positioned firmly in a fixed position against a shoulder on each shaft. Good tooling design must assume the space or clearance between the two rolls remains constant. However, there is no such thing as absolute perfection in either the roll former or it's roll tooling, nor in the metal strips which are to be passed through the machine.

There are a number of tooling variables that may be the source of other problems. Drive shafts which are less than absolutely straight, or rolls that are not absolutely concentric or not uniformly fitted to their drive shafts, and similar variations from perfection, can cause the rolls to lope during rotation. This may vary the design spacing between the rolls, thus alternately squeezing and inducing stresses in the metal as it passes through the machine. Other similar machine and tooling variables can also be cited. The degree of these variables in a machine and its tooling can increase during the operating life of both because of wear and strains that are either induced or relieved through production usage.

There may also be metal strip variables. Perfection in the metal strip being roll formed is also not likely. An article from the October issue, 2002, of The Fabricator magazine, outlines the reality of the variables inherent with present day state of the art metal strip roll form production. These strip variables coupled with machine and tooling variations outlined above, combined to induce stresses during roll forming which can seriously affect the quality of the finished formed parts. Thus, there remains a need in the art for an apparatus which can roll form such metal components for wall structures as well as assembling wall structures from such components and which overcomes the numerous aforementioned problems inherent in the existing technology. The present invention addresses and solves these particular problems in the art.

SUMMARY OF THE INVENTION

Accordingly, it is one object of the present invention to provide an apparatus for forming metal components and wall structures therefrom.

It is another object of the present invention to provide a roll forming device which automatically adjusts for metal gauge thickness variations, which prevents metal strip slippage, and which provides an independent mechanism for moving the sheet metal strips through the device.

Yet another object of the present invention is to provide a roll forming device capable of simultaneously forming a pair of sheet metal strips, one on top of the other, into U-shaped channel members.

Another objective of the present invention is to provide a metal coil handling and feeding mechanism for directing metal sheets to a roll forming device.

Still another object of the present invention is to provide a device for assembling a wall structure from metal studs and tracks.

A further object of the present invention is to provide a pre-fabricated, foldable metal wall frame unit which is capable of selectively being erected on the site of residential or commercial building construction.

To achieve the foregoing and other objects and in accordance with the purpose of the present invention, as embodied and broadly described herein, an apparatus is disclosed for roll forming metal components including substantially channel-shaped members for use in a building structure. The apparatus includes a support frame assembly having front and rear portions. A mechanism is provided for selectively feeding at least one metal strip into the support frame assembly, the metal strip having a pair of side edges and a center web. A plurality of driver roll elements are mounted along the support frame assembly and are adapted to move the metal strip through the frame assembly. Finally, a plurality of spaced idler forming rolls are mounted for free rotation in pairs along the support frame assembly. The idler forming rolls are adapted to simultaneously air form the side edges of the metal strip into angularly extending side flanges by urging the side edges in opposing directions from the center web as the metal strip is moved along the frame assembly by the driver roll elements.

In one modification of the invention, the feeding mechanism is adapted to feed a pair of metal strips into said frame assembly, said metal strips having substantially congruent side edges and center webs. Additionally, the driver roll elements are adapted to move the paired strips substantially simultaneously through the frame assembly, and the forming rolls simultaneously air form the side edges of the paired metal strips into angularly extending side flanges by urging the substantially congruent side edges of the paired strips in opposing directions.

In another form of the invention, the side edges and center web portions of said pair of the metal strips substantially abut each other as they enter the front portion of the support frame assembly.

In yet another modification, each forming roll may include a beveled outer circumferential edge sized and angled to substantially equally separate the edges of the paired metal strips and bend them outwardly away from each other as they pass along the frame assembly. In a more specific aspect of the invention, the angles formed by the beveled circumferential edges of the plurality of pairs of forming rolls progressively increase from the front to the rear portions of the frame assembly to form the channel-shaped members from the metal strips.

In yet another modification of the invention, the driver roll elements include a plurality of sets of roller elements with each set including at least one pair of roller elements. Preferably, each such pair includes an upper and lower roller element disposed, respectively, above and below the at least one metal strip along the frame assembly. Moreover, the outer circumferential edge of each such driver roll element is tapered to form a beveled surface substantially parallel to the beveled outer circumferential edge of an adjacent forming roll.

In another aspect of the invention, the channel-shaped members may take the form of track elements having side flanges at approximately right angles relative to the center web portion thereof. Alternatively, the channel-shaped members may be in the form of stiffened edge stud elements having side flanges at approximately right angles relative to the center web portion thereof, and ledge extensions forming a pair of lips projecting inwardly toward each other from the distal end edges of the side flanges.

Still another modification of the invention includes a plurality of pairs of forming rolls, more preferably nine to twelve sets of paired forming rolls spaced along the frame assembly.

The channel-shaped members comprising track elements have side flanges at approximately right angles relative to the center web portion thereof. In this instance, the angles formed by the beveled circumferential edges of the plurality of pairs of forming rolls of the invention are sized and shaped such that the paired metal strips engage all but the first two sets of the forming rolls to form the track elements.

In an alternate form, the channel-shaped members comprising stiffened edge stud elements have side flanges at approximately right angles relative to the center web portion thereof, and ledge extensions forming a pair of lips projecting inwardly toward each other from the distal end edges of the side flanges. In this instance, then, the paired metal strips engage all sets of the forming rolls to form the stud elements, the first few sets of forming rolls being sized and shaped to form the projecting lip portions of the stud elements.

In another modification of the invention, the mechanism for selectively feeding the paired metal strips into the frame assembly includes a device for attaching a connector element between the two metal strips to join them together to prevent relative slippage therebetween as the paired strips move through the frame assembly. In a more specific form, the connector element attachment device is a screw gun mounted to the frame assembly.

In the above modification of the invention, the mechanism for selectively feeding the paired metal strips into the frame assembly may include a pair of steel coil rolls each providing one metal strip therefrom. A cradle assembly is provided for each coil roll and has at least three support rollers for supporting and rotating the coil roll to play out the metal strips. An alignment mechanism is also provided for engaging the metal strips from both of the coil rolls to establish a slack loop for the metal strips and ensure proper alignment between the substantially congruent strips and firm engagement between the front portion of the frame assembly and the substantially congruent metal strips. In one aspect of this modification, the alignment mechanism is in the form of a tensioner member having a biasing mechanism for maintaining the slack loop. Alternatively, each cradle assembly includes four support rollers, at least three of which drive and rotate said coil roll, and the alignment mechanism is then in the form of a pair of spaced roller conveyor members for forming the slack loop.

One aspect of the above mechanism for selectively feeding the substantially congruent metal strips into the frame assembly further includes a shearing device for simultaneously cutting the paired strips into preestablished substantially identical lengths as they pass through the frame assembly and are formed into metal components.

In another aspect, the mechanism for selectively feeding the substantially congruent metal strips into the frame assembly further includes a pair of encoder elements each associated with one metal strip. The encoder elements are adapted to measure and select the preestablished metal strip lengths to identify where the shearing device is to make the cuts. In one variation of this, the encoder elements are in the form of magnetic wheels which substantially prevent friction, slippage and squeeze between the wheels and the metal strips prior to entry into the frame assembly.

In one form of the invention, the shearing device may be in the form of a double shear mechanism to provide both blanking and guillotine shearing actions.

In still another modification of the invention, the driver roll elements may include a plurality of sets of roller elements with each set including at least one pair of roller elements. In this arrangement, each pair of roller elements includes an upper and lower roller element disposed, respectively, above and below the at least one metal strip along the frame assembly. The apparatus may further include an adjustment mechanism associated with each pair of upper and lower driver roll elements. The adjustment mechanism automatically adjusts the clearance of the driver roll elements in the frame assembly to accommodate variations in metal strip thickness and differences in metal strip gauges.

In one form of the above modification, the adjustment mechanism includes a stop member disposed between the upper and lower driver roll elements of each pair of driver roll elements to prevent them from directly contacting each other. Moreover, the adjustment mechanism may be in the form of at least one disc spring, a laminated urethane block, or a hydraulic cylinder.

Another modification of the invention includes each pair of driver roll elements being aligned adjacent to a second pair of driver roll elements to form a set of four driver roll elements disposed proximate to each other and through which the at least one metal strip is moved. The upper driver roll elements of each set of driver roll elements are adapted to slide fit and float on a first shaft while separated by a first spacer key therebetween. The lower driver roll elements of each set of driver roll elements are likewise adapted to slide fit and float on a second shaft while being separated by a second spacer key therebetween. The driver roll elements of each set of elements are disposed to float on their respective shafts to minimize pinching and stress on the metal strip being moved between each pair of upper and lower driver roll elements.

Another modification of the invention provides an improvement to an apparatus for cold rolling metal frame components from sheet metal strips for use in building structures, the components including track and stud elements having their side edges cold formed to create a substantially U-shaped channel member having side flange portions and a center web portion. The apparatus includes a frame support having front and rear portions, a plurality of paired forming rolls designed to force the edges of the sheet metal strip substantially orthogonal relative to the center web of the strip to form the substantially U-shaped channel structure having side flange portions at approximately right angles relative to the center web portion, and a mechanism for moving the sheet metal strips through the frame support for engagement with the forming rolls. The improvement is wherein the apparatus further includes a feed mechanism for introducing a pair of sheet metal strips, one on top of the other, simultaneously into the forming rolls, and a mechanism for simultaneously forming the pair of sheet metal strips into the U-shaped channel members. Alternatively, the improvement is wherein the mechanism for moving the sheet metal strips through the frame support is in the form of a plurality of driver rolls mounted in the frame support separate from the forming rolls, and wherein the forming rolls are non-driven, idler rolls spaced along opposite side edges of the metal strip.

A further modification of the invention includes a device for feeding sheet metal strips to an apparatus for cold rolling metal components for use in building structures. The device includes at least one metal coil roll adapted to provide a single metal strip for entry into the cold rolling apparatus. A cradle assembly is provided for holding the coil roll; and a plurality of support rollers are disposed along the bottom portion of the cradle assembly for supporting and rotating the coil roll to play out the metal strip from the outer circumference of the coil roll. Finally, an alignment mechanism is provided for engaging the metal strip to form a slack loop to align the strip with the entry of the cold rolling apparatus.

An additional modification of the invention includes an apparatus for assembling and securing metal tracks and stud elements into a building wall structure wherein the stud elements are arranged substantially parallel to each other between a pair of tracks disposed at the upper and lower end portions of the studs. Each track has a center web with side flanges and a plurality of spaced sets of apertures along the side flanges, with each set of apertures including two different sized apertures positioned adjacent each other. Each stud element has a center web with side flanges terminating in lip portions disposed along the longitudinal edges of the stud side flanges to form a soft side of the stud. The apparatus includes first and second support frames mountable to a floor surface. The first support frame is stationary, and the second support frame is movable and distance adjustable with respect to its position relative to the first support frame to accommodate different size wall structures. A pair of attachment stations are positioned, respectively, on the first and second support frames. Each attachment station includes a plurality of track guide roller elements disposed for guiding and carrying a track therealong substantially horizontal relative to the floor surface supporting the support frame, the roller elements being arranged to movably engage the side flanges of the track. A pair of hole finder elements are positioned on the support frames at each attachment station between the roller elements, the hole finder elements being disposed along both side flanges of each side of the track on both of the support frames. Each hole finder element includes a selectively movable locator pin adapted to pass through the larger of the two apertures in each set of apertures located in the track side flanges. Finally, a mechanism associated with each hole finder element at each attachment station is provided for attaching a connector element through the smaller of the apertures of each set of apertures to attach the side flanges of each track to the side flange ends of each stud element positioned between the track members.

An additional modification of the invention is in the form of an improvement to an apparatus for assembling metal tracks and studs into a building wall structure wherein the studs are arranged substantially parallel to each other between a pair of tracks disposed at the upper and lower end portions of the studs. Each track has side flanges and a plurality of spaced sets of apertures along the side flanges with each set of apertures being in the form of two different sized apertures positioned adjacent each other. Each stud has a pair of side flanges terminating in lip edges along the side edges of the stud side flanges to form a soft side of the stud. The improvement to the apparatus includes a plurality of hole locator mechanisms wherein the locator mechanisms engage the larger of the set of holes to maintain the track and studs in firm temporary engagement while permanently attaching the two with a plurality of connector elements utilizing the smaller hole of each set of holes along the track flanges.

Another modification to the invention includes a foldable wall frame. The frame includes first and second track members spaced from each other, and a plurality of spaced stud elements, each having a first and a second end portion and positioned between and substantially perpendicular to the spaced track members. A first attachment element pivotally secures the first end portion of each stud element to the first track member, and a second attachment element pivotally secures the second end portion of each stud element to the second track member. The pivotal attachments enable the first track member to be folded down proximate the second track member.

Yet another aspect of the invention is in the form of an elongated brace member for laterally supporting adjoining studs of a wall frame. The wall frame typically includes a plurality of studs interconnected at their ends between a pair of tracks, with each stud having a central web portion and side flanges. The brace member includes an elongated support element having first and second end portions, a pair of elongated side edges extending between the support element end portions, and a channel defined along the center of the support element and extending between the support element end portions. A first pair of opposing notches are defined in the side edges proximate the support element first end portion. A second pair of opposing notches are also defined in the side edges proximate the support element second end portion. The pairs of notches are sized and shaped for removable engagement with adjoining studs to provide lateral support thereof.

Finally, a device is disclosed that attaches sheathing to a surface of a metal wall frame, the frame including a plurality of studs interconnected between a pair of tracks. The device includes a support structure for mounting on a floor surface and having a substantially horizontal surface. A plurality of drive shafts are provided, each having a plurality of sprockets disposed thereon. A plurality of drive chains engage sets of sprockets and are adapted for movement by the drive shafts. At least one push bar is disposed along the upper surface of the support structure and is adapted for movement therealong by the drive chains, the push bar being sized for urging a wall frame with a sheathing panel thereon over the surface of said support structure. A drill head assembly is also provided and has a plurality of drill members adapted for simultaneously creating a plurality of holes in a sheathing sheet as it moves thereunder. Finally, a plurality of screw guns are disposed downstream from the drill members for attaching screws through the sheathing into a metal wall frame thereunder.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings:

FIG. 3 is a front perspective view of a metal track constructed using the apparatus in accordance with the present invention;

FIG. 4 is a front perspective view of a metal stud constructed using the apparatus in accordance with the present invention;

FIG. 5 is a side view of a building wall section built using metal components as constructed in accordance with the apparatus of the present invention;

FIG. 5A is a front view of the wall section of FIG. 5;

FIG. 6 is a front view of a roof truss built using metal components constructed with an apparatus in accordance of the present invention;

FIG. 12 is an enlarged front view of one pair of idler forming rolls and driver roll elements as a pair of metal sheets pass therethrough;

FIG. 13 is a pair of formed channel members as they exit the apparatus as constructed in accordance with the present invention;

DETAILED DESCRIPTION OF THE EXEMPLARY EMBODIMENTS

Figure 1:
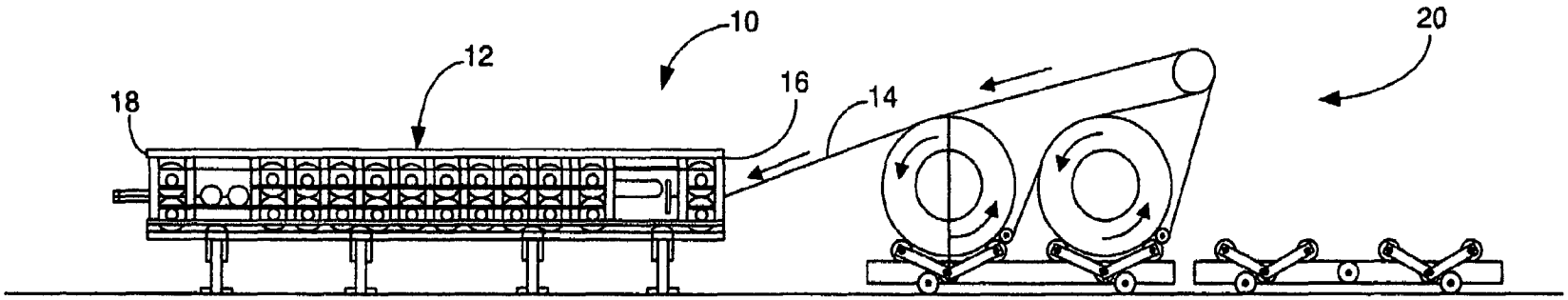
FIG. 1 is a side elevation of one embodiment of a roll forming apparatus constructed in accordance with the present invention.
Figure 2:
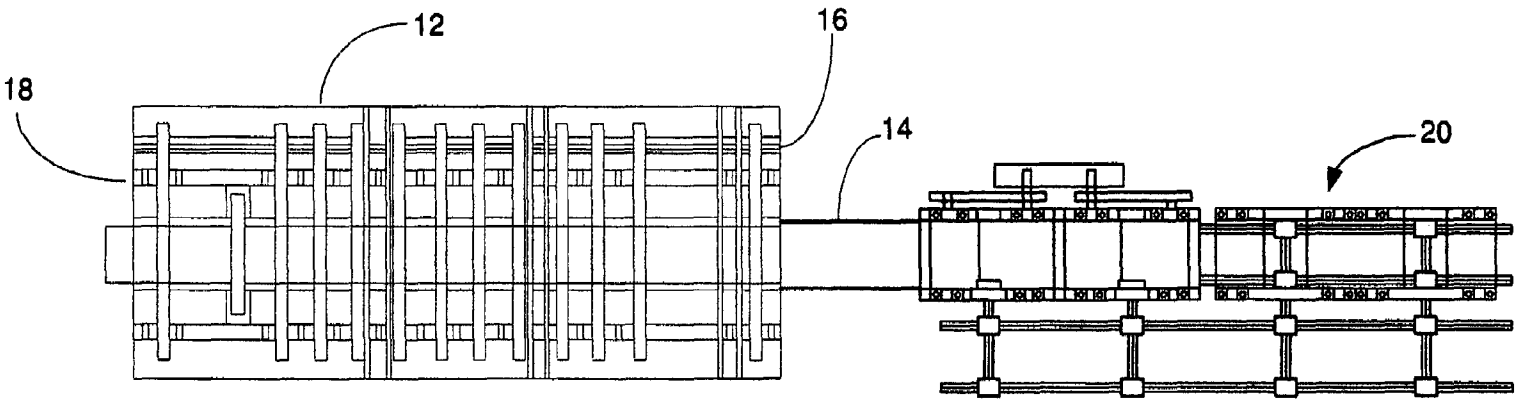
FIG. 2 is a top plan view of the embodiment illustrated in FIG. 1.

The present invention is a multifaceted apparatus for producing roll formed metal components for residential and commercial building frames and the assembling of frames therefrom. Referring to FIGS. 1 and 2, a roll forming apparatus 10 is illustrated in general. The apparatus 10 includes a roll forming device 12 adapted to receive one or more sheets of metal 14 at its front portion 16 and then roll forming the sheets of metal 14 into metal frame components exiting its rear portion 18. It should be understood that while the preferred embodiment of the device 12 illustrates the simultaneous roll forming of two sheets of metal 14 into metal frame components as one of the inventive features of the apparatus, the remaining inventive features of the present invention may be utilized with the roll forming of one or more sheets of metal 14. The metal sheets 14 are fed to the front portion 16 of the device 12 by a metal roll feeding device 20 as described in greater detail below. Once the metal components are formed and exit the rear portion 18, they are then assembled together into fixed or foldable wall frames by a frame assembler apparatus as discussed in greater detail below.

The Metal Forming Assembly

Referring now to FIGS. 3-6, the metal sheets 14 may be formed into any type of cold rolled components. The preferred use of the present invention is to form substantially U-shaped metal frame components for use in residential and commercial building frame structures. One of the primary components formed using the present invention is a metal track element 22 having a center web portion 24 and a pair of upright flanges 26, 28 that are angled at approximately 90° relative to the web portion 24. The other primary component formed with the apparatus 10 is a stud member 30. The stud member 30 includes a center web portion 24 having upright flanges 26, 28 as in the track element 22. In addition, the stud member 30 includes a pair of stiffened lip elements 32, 34 projecting inwardly toward each other substantially orthogonal from the distal edge of the flanges 26, 28.

The metal components 22, 30 are preferably formed for assembly together into a wall frame unit 36. The frame unit 36 includes a plurality of stud members 30 spaced at about 16" centers and attached at each end to a track element 22. In another form, the metal components may be assembled to form a roof truss unit 38. In this form and by way of example only, the eaves and base support are formed from several track elements 22 and are interconnected with stud members 30.

Referring now to FIGS. 7-13, one embodiment of a preferred roll forming assembly 12 is illustrated. The device 12 includes a base platform 40 having a fixed frame 42 and a movable frame 44 mounted on a plurality of cross support platforms 46. The frame 44 is movable relative to the fixed frame 42 in order to receive different sizes of metal sheets and vary the widths of the studs and tracks formed by the device 12. The drive mechanism is a typical gear arrangement and is attached to the fixed frame 42 at 47. The drive mechanism 47 engages and rotates the various drive shafts and drive rolls discussed below.

One of the objectives for the design of this roll forming device 12 is for it to be light enough and strong enough to be used not only in a manufacturing plant location, but also to be readily portable and rugged enough to be transported on a trailer designed for the machine to be taken out in the field to a construction site. To this end, an objective of the present invention is to maintain the overall weight of the roll forming device as light as practical while providing a rigid frame for the machine. Typical roll formers of the prior art employ a heavy steel base on which the individual roll passes are, mounted. Such machines usually weigh between 15,000-20,000 lbs. They are designed for in plant use only and would be a major problem to move and be operated on a construction job site. The present invention, however, preferably uses heat-treated extruded aluminum members for the base platform 40 and other frame members. This arrangement provides a much lighter yet rigid machine. The overall weight of the preferred embodiment illustrated here and is the neighborhood of 6000-7000 lbs.

The present invention is designed to overcome, or at least greatly reduce, the above discussed problems inherent in the prior art devices. Of equal or possibly greater value is the ability of the present invention to roll form two separate metal strips 14, 15, one placed directly on top of the other, using the same set of roller dies to simultaneously form the two strips as they pass through the device 12 as a unit. Consequently, the production output for any given device 12 is doubled with just one set of tooling. To accomplish this, the two functions of the roller dies of the prior art are divided by providing separate and distinct driver rolls 48 and non-driven idler forming rolls 50.

Figure 9:
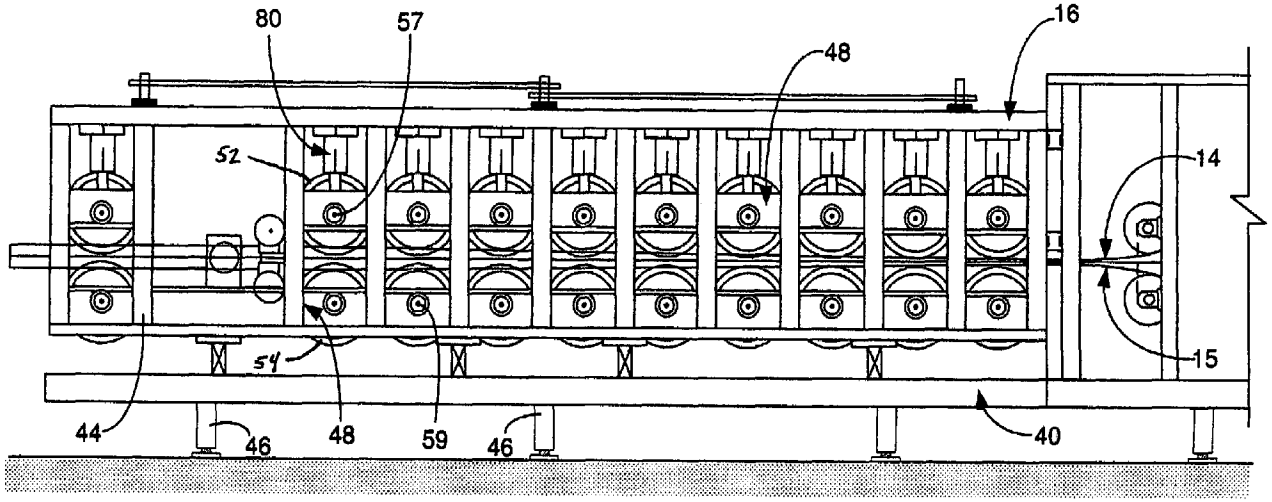
FIG. 9 is a side plan view of another embodiment of a roll forming apparatus constructed in accordance with the present invention.
Figure 10:
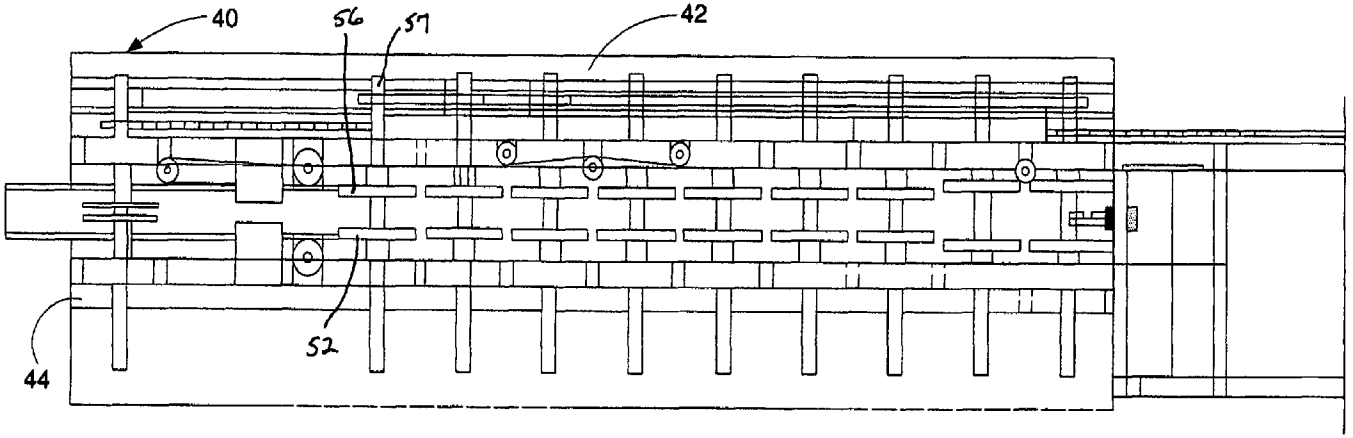
FIG. 10 is a top plan view of the embodiment illustrated in FIG. 9.

Referring in particular to FIGS. 9, 10 and 12, each combination unit or pass of driver and idler rolls in the preferred embodiment includes two pair of driver rolls 52, 54 and 56, 58 and one pair of idler rolls 60, 62. In preferred form, there are at least 9-12 combination units or passes of driver and idler rolls in the device 12. In each unit or pass, a first pair of driver rolls includes an upper driver roll 52 and a lower driver roll 54, while the second pair also includes an upper driver roll 56 and a lower driver roll 58. The upper driver rolls 52, 56 are mounted for rotation on a first drive axle 57, while the lower drive rolls are likewise mounted for rotation on a second drive axle 59. Mounted adjacent and laterally outside of the two sets of driver rolls are the idler rolls 60, 62. Each of the idler rolls 60, 62 is mounted for free rotation on a shaft 63, the idler roll 60, 62 freely floating on its respective shaft 63.

Each idler roll 60, 62 includes an outer beveled circumferential surface 64 that terminates in an annular, circumferential edge 66. The angle "x" defined by the slope of the surface 64 and the centerline 68 establishes the force that is exerted against the of the edges of the metal sheets 14, 15 to form the flanges 26, 28. The greater the angle "x", the further the flanges 26, 28 are bent away from the web portion 24 of the sheet 14, 15. The two metal sheets 14, 15 are moved through the device 12 by the driver rolls 48 while the idler rolls 50 are free to rotate, press against and form the sheets 14, 15 as they pass against the beveled surfaces 64 of the idler rolls 50.

Figure 12A:
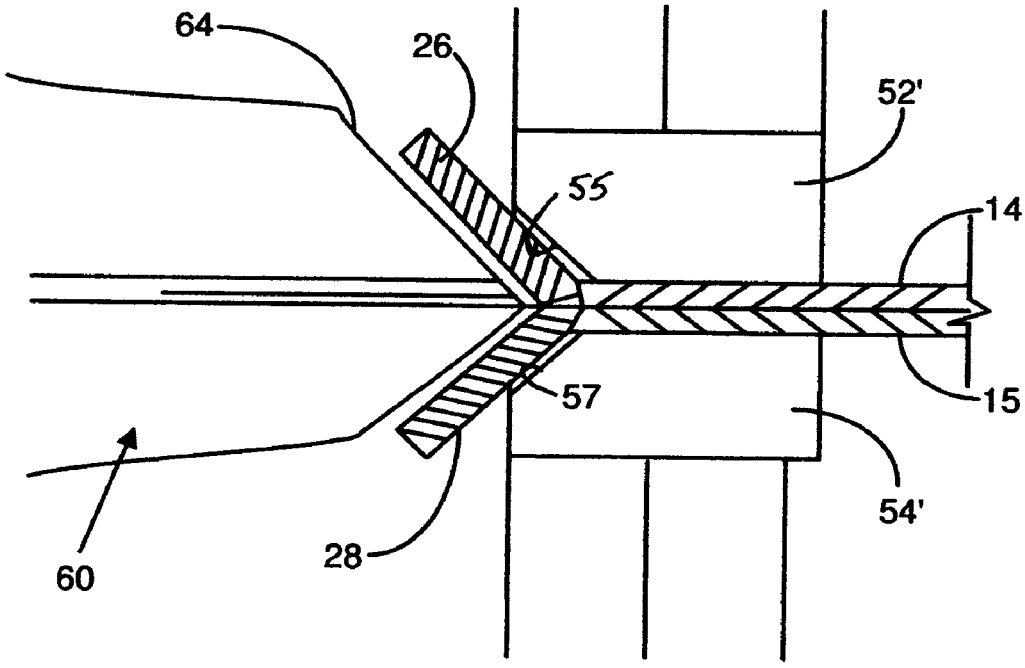
FIG. 12A is an enlarged front view of one pair of idler forming rolls and modified driver roll elements as a pair of metal sheets pass therethrough.

A modified embodiment for the driver roll element pairs 52, 54 and 56, 58 is illustrated in FIG. 12A. In this modified embodiment, the outer circumferential edge of the upper driver roll 52' is tapered to form a beveled edge 55. Likewise, outer circumferential edge of the lower driver roll 54' is tapered to form a beveled edge surface 57. The beveled edges 55, 57 are preferably angled to substantially align with the angle "x" of the idler roll beveled edge 64 to assist in forming the side flanges 26, 28 while reducing the load on the outside edges of the rolls 52', 54' while forming the sheets 14, 15. It should be understood that the second pair of driver roll elements 56, 58 may likewise be modified in this embodiment.

Unlike the prior art, it is imperative that there be no slippage between the two strips of metal sheets 14, 15 as they pass through the device 12. As will be discussed below, there are several operations performed on the sheets 14, 15 as they pass through the device 12 including forming, cutting and hole punching. To accomplish accurate performance of these functions, the drive points between the sheets 14, 15 and the driver rolls 48 must be consistent for each strip without slippage between the drive roll members 48 and the metal strips 14, 15. The driver rolls 48 preferably all have the same diameters, and the circumferences of the driver rolls 48 are preferably treated with either an electro-deposited coating of minute tungsten carbide/cobalt particles, or they are flame sprayed with these materials to provide a superior gripping surface. Since the idler forming rolls 50, however, do not confer a driving force to the metal strips 14, 15, their outer surfaces are left smooth.

Figure 11:
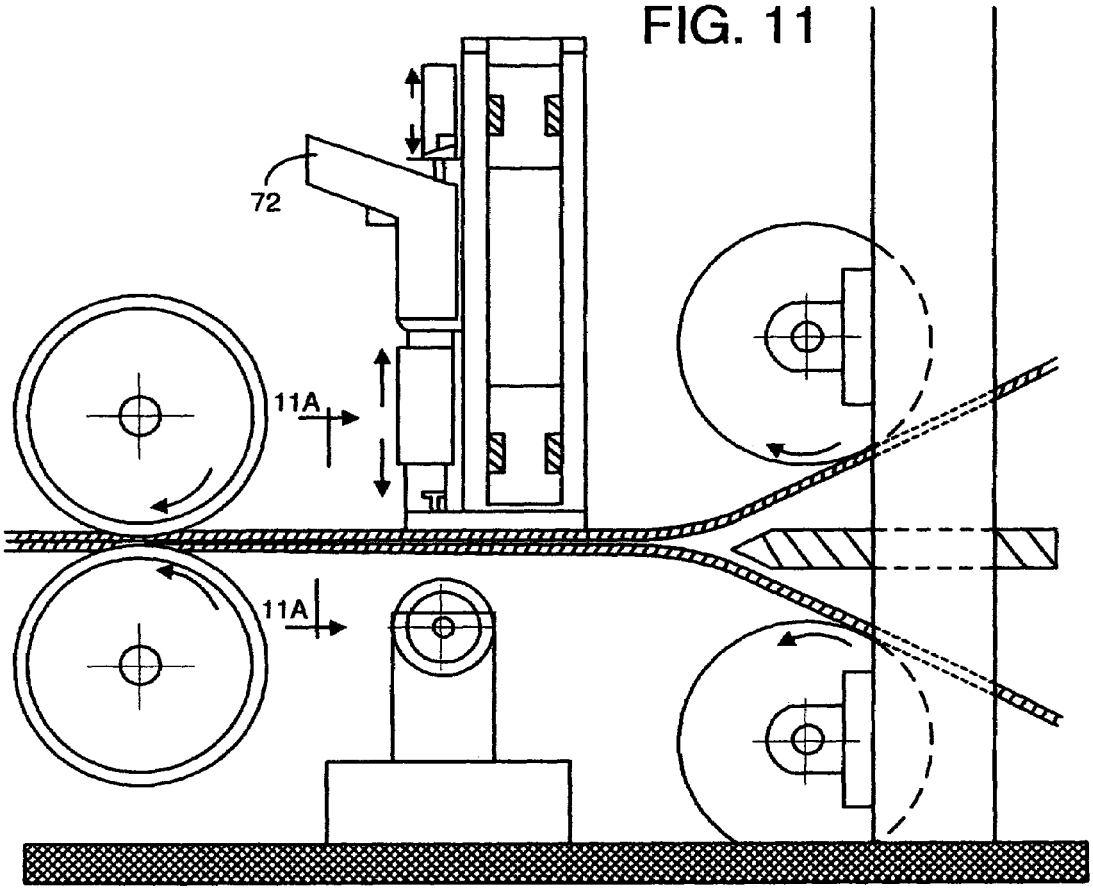
FIG. 11 is an enlarged side view of the entry portion of the embodiment illustrated in FIG. 9 and showing in particular the paired metal strip connector mechanism for preventing relative slippage therebetween.
Figure 11A:
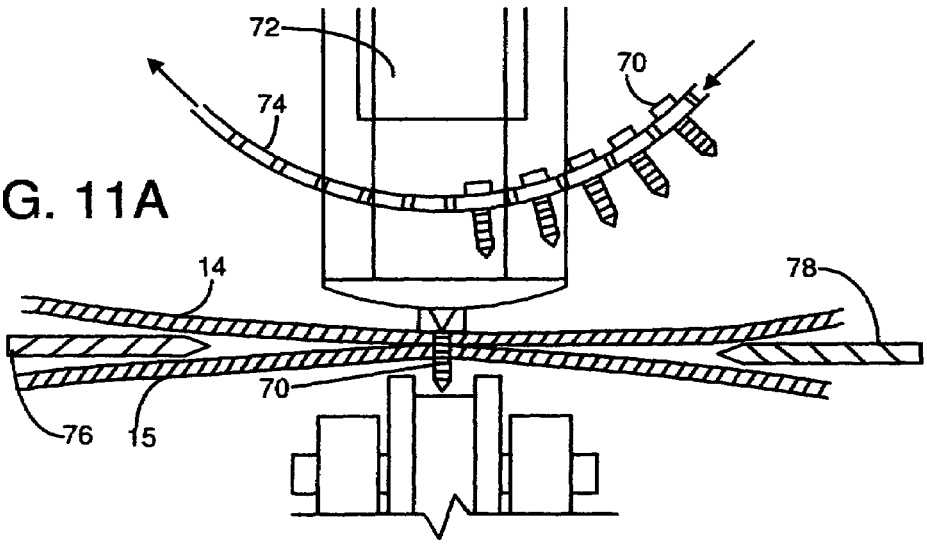
FIG. 11A a cross-sectional view taken substantially along line 11A-11A of FIG. 11.

To further ensure the exact same punching and cut-off lengths of both pairs of metal strips, as discussed below, a self-drilling screw or other similar fastener 70 may be used to secure the two metal strips 14, 15 together as they pass into the device 12 at the front portion 16 thereof. In preferred form, a screw gun 72 is provided at the front portion 16 of the device 12 to automatically insert the fasteners 70 using a fastener strip 74. As can be seen from FIG. 11A, a pair of separators 76, 78 help arc the metal sheets 14, 15 at the centerline thereof at the point of inserting the fastener 70 to ensure a firm attachment without slippage. Since the driver rolls 48 are arranged in two pairs that are spaced from each other, there is space for the fastener 70 to pass between the pairs of driver rolls without contact therewith. Moreover, since the track sections 22 are punched in pairs (see below) to be utilized as the top and bottom members for a given wall section 36, this fastener 70 holding the two track members together serves the secondary purpose of making it easier to locate the two identical length pieces for later assembly operations. It should also be noted that in the preferred embodiment, an inkjet printer may also be provided in the device 12 which may print an identifying number on all parts to match a given wall section location on the building plans.

In a typical prior art roll forming device, the upper shaft's vertical location is defined and limited by compression springs typically used between shaft bearing housings and an adjustment screw located above the shaft bearings. Any of the various machine or metal strip variables discussed above may result, either singly or in combination, in exerting greater pressure on the metal strips as they pass through the rolls which exceeds the metal's yield point, thus inducing undesirable stresses in the formed parts. The present invention obviates these problems.

In a preferred embodiment of the present invention and referring in particular to FIGS. 9, 12 and 14-16, an adjustment mechanism 80 is associated with each pair of upper and lower driver roll elements 52, 54 and 56, 58. The adjustment mechanism 80 automatically adjusts the clearance of the driver roll elements in the frame assembly to accommodate for variations in metal strip thickness and differences in metal strip gauges. In one preferred form, the upper drive shaft 57 is carried in an upper frame or bearing block member 84 which is adjustable vertically relative to the movement of the sheet metal strips through the device 12. A lower frame or bearing block member 86 which is not movable carries the lower drive shaft 59. The adjustment mechanism 80 preferably includes a stop member 82 disposed between the upper and lower frame members 84, 86 to limit movement of the upper frame member relative to the lower member 86 and thereby prevent the upper and lower driver roll elements 52, 54 and 56, 58 from directly contacting each other. This eliminates wear when the driver roll elements are turning but there is no metal sheet being driven between them.

Figure 14:
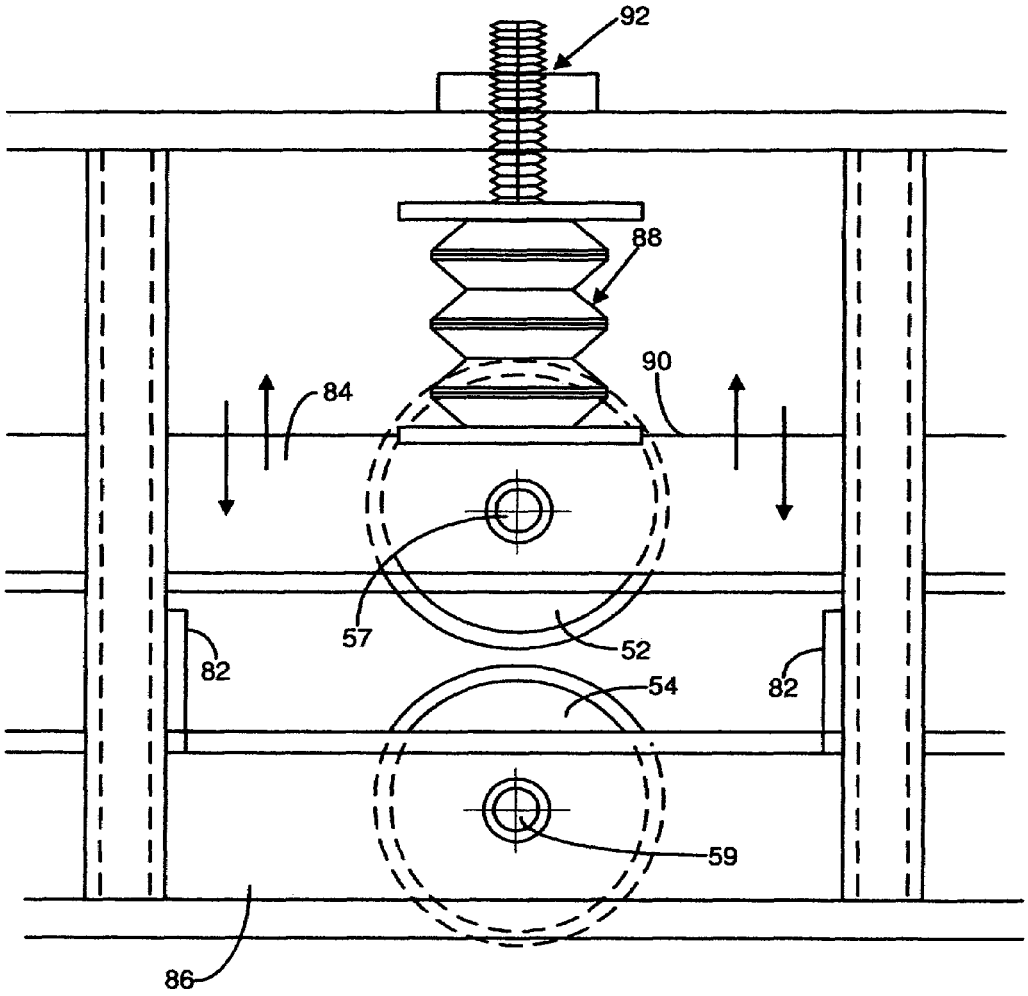
FIG. 14 is a side view, some with some parts in section, of one adjustment mechanism embodiment associated with each pair of upper and lower driver roll elements.

In one embodiment of the invention as illustrated in FIG. 14, the adjustment mechanism 80 includes a plurality of disc or beveled springs 88 positioned between the upper surface 90 of the upper frame member 84 and an adjustment screw assembly 92. The screw assembly 92 is preferably utilized to pre-load the springs 88. This feature removes any slack from the springs 88 but allows the upper shaft 57 and frame member or bearing block 84 to move upwardly. This compresses the springs 88 allowing the driver rolls to adjust automatically to the thickness of the metal strips passing through the device 12 or any variations that may be found therein. In other words, the upper drive shafts 57 "float" and self adjust for different metal gauges and variations from the design gauge thickness.

Figure 15:
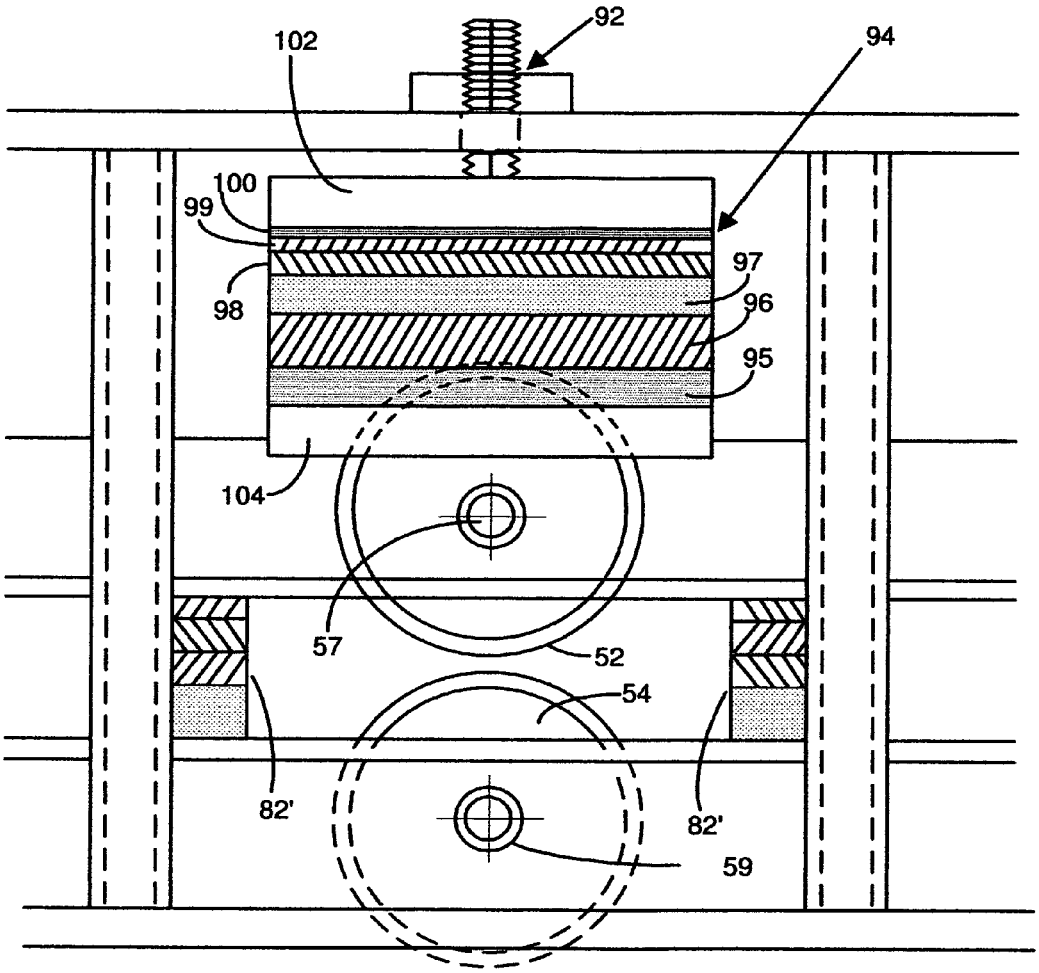
FIG. 15 is a side view, some with some parts in section, of a second adjustment mechanism embodiment associated with each pair of upper and lower driver roll elements.

An alternative adjustment mechanism to the disc springs 88 of the above embodiment is illustrated in FIG. 15. In this embodiment, a laminated block 94 of Urethane rubber is provided. The laminated block 94 accomplishes the same purpose as the disc springs 88 of the previous embodiment. The block 94 is preferably comprised of a plurality of Urethane layers 95-100 sandwiched between a pair of aluminum plates 102, 104. Each of the layers 95, 96, 97, 98, 99, 100 are of different denier hardness, compressibility and thickness. The lower denier, i.e. softer material, and thinner layers will compress first under less pressure, while the thicker or higher denier layers will not compress until a higher pressure is applied.

The blocks 94 of this laminated construction are located as illustrated in FIG. 15, and an adjusting screw 92 is provided to allow the assembly to be pre-loaded to obtain the desired amount of initial compression as in the previous embodiment. The upper shaft 57 and its associated drive roll 52 is free to automatically adjust the spacing between the upper and lower drive rolls 52, 54 for various metal gauges, the heavier gauges getting more compression. This particular embodiment provides a greater range of adjustment and variance of compression than that provided by the disc springs of the previous embodiment of FIG. 14. In addition, the stop members 82' may also be constructed from the same laminated Urethane material as the adjustment member 94. The stop members 82' function as in the previous embodiment and are disposed between the upper and lower frame members 84, 86 to limit movement of the upper frame member relative to the lower member 86 and thereby prevent the upper and lower driver roll elements 52, 54 and 56, 58 from directly contacting each other.

Figure 16:
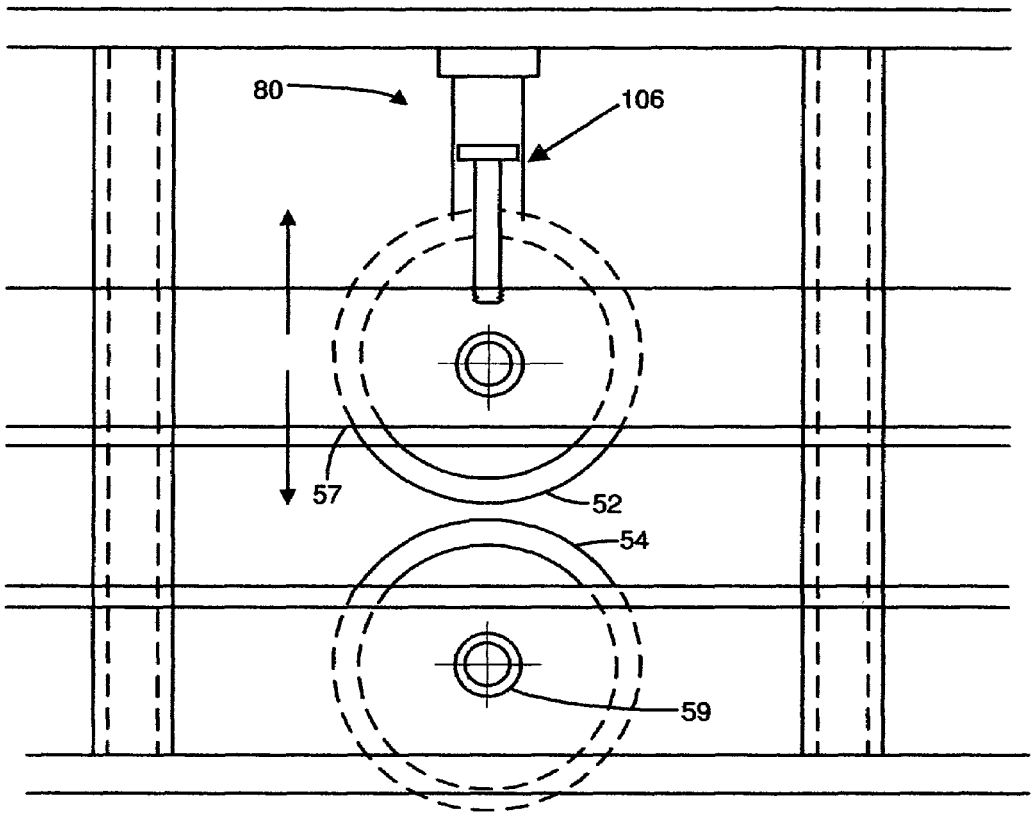
FIG. 16 is a top plan view of several sets of driver roll elements and forming rolls as a pair of metal sheets passes therethrough.

FIG. 16 illustrates yet another embodiment for use as the adjustment mechanism 80. In this embodiment, a single or preferably double acting hydraulic cylinder 106 is provided to allow the upper shaft 57 and it's associated driver roll 52 to self-adjust for metal gauge thickness. In this embodiment, a hydraulic cylinder 106 is connected to a hydraulic accumulator (not illustrated) which maintains a given pressure against the upper shaft bearing block 84. The cylinder 106 acts as a hydraulic spring. Whatever pressure is maintained in the accumulator is applied against the bearing block 84 as a steady pressure, but the shaft 57 can move up or down by either taking or returning oil to the accumulator as needed to adjust drive roll clearance for different metal thickness. By using a double acting hydraulic cylinder and a four-way control valve, the cylinder can be used to lift the upper shaft 57 and its associated driver rolls 52, 56 to a non-driving position when it is desired to let the metal simply pass through a portion of the roll former device 12. An example of this is during the first two passes in the roll formation of track elements 22 as described below.

In typical prior art roll forming machines, the rolls are generally rigidly held in place against a shoulder member, since the rolls are both driving rolls as well as forming rolls. This is not the case in the present invention. Referring particularly to FIGS. 7-10, 12 and 13, the driver rolls 52, 54, 56 and 58 are machined to slide fit over their respective shafts 57, 59. Each roll 52 and 54 is spaced from its adjacent rolls 56, 58 by a spacer key 108, 110, respectively. The spacer keys 108, 110 are separate and apart from the drive keys which drive the two roll sections on each shaft. Thus, the driver roll elements 52 and 54 and the elements 56 and 58 with their respective spacer keys 108, 110 between them allow the driver roll elements to float on the shafts 57, 59 rather than being held in a fixed position as in prior art designs.

The forming of the two metal strips 14, 15 into track elements 22 and stud members 30 is accomplished by the idler forming rolls 50. When the two metal strips 14, 15 are fed into the front portion 16 of the device 12, the strips are flat and the edges thereof substantially congruent with each other. As previously indicated, the strips 14, 15 may be attached to each other by the fasteners 70. As the strips 14, 15 pass through the device 12, the edges thereof are engaged against the beveled circumferential surfaces 64 of the idler forming rolls 60, 62. The edges of the upper strip 14 are formed upwardly to form flanges 26, 28, while the edges of the lower strip 15 are formed downwardly to likewise form flanges 28, 26. The edges of the strips 14, 15 are separated by the edge 66 of the beveled surface 64. As previously stated, the greater the angle "x" of the beveled surface 64, the greater the forming force against the flanges.

The driver rolls 48 are free to move laterally on their shafts 57, 59, thus self adjusting for a centered position between the two idler rolls 60, 62. This allows for any variations in thickness from one side of the strips 14, 15 to the opposite side. This feature minimizes any tendency for the rolls to pinch or induce stress in the metal component due to metal strip thickness variation from the design gauge.

As the metal strips 14, 15 pass through the device 12, each set of driver rolls 48 and idler forming rolls 50 are a unit known as a roll pass. As previously mentioned, a preferred embodiment may include nine to twelve sets or roll passes aligned in a row, although the number of sets of roll passes may be greater or lesser than this as desired. Referring to FIGS. 9-10 and 20-22, the angle "x" of the idler rolls 50 increases from front to back of the device 12. Therefore, the angles represented by A to F of FIG. 22 illustrate such a progressive increase of beveled edge angulations. This increase in the angle "x" forces the flanges 26, 28 in ever increasing angulations until the desired orthogonal orientation and substantially U-shape is achieved by the metal components as they exit the rear portion 18 of the device 12.

Figure 17:
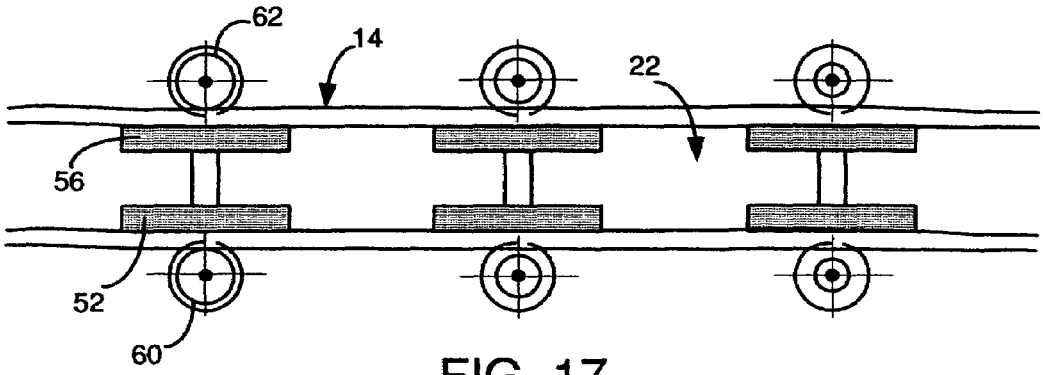
FIG. 17 is a side view of a pair of metal sheets as they are formed into channel members.
Figure 18:
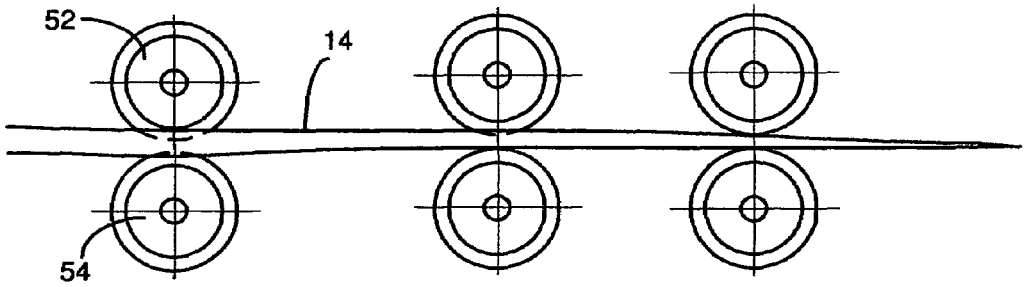
FIG. 18 is a side view of a pair of metal sheets as they are formed into channel members.
Figure 19:
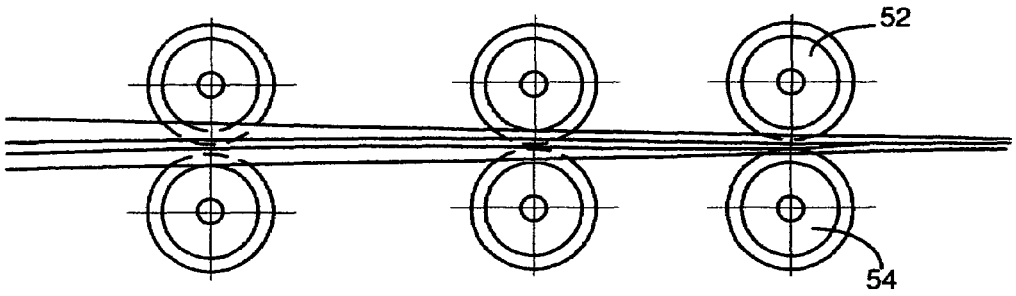
FIG. 19 is a side view, some with some parts in section, of yet a third adjustment mechanism embodiment associated with each pair of upper and lower driver roll elements.
Figure 20:
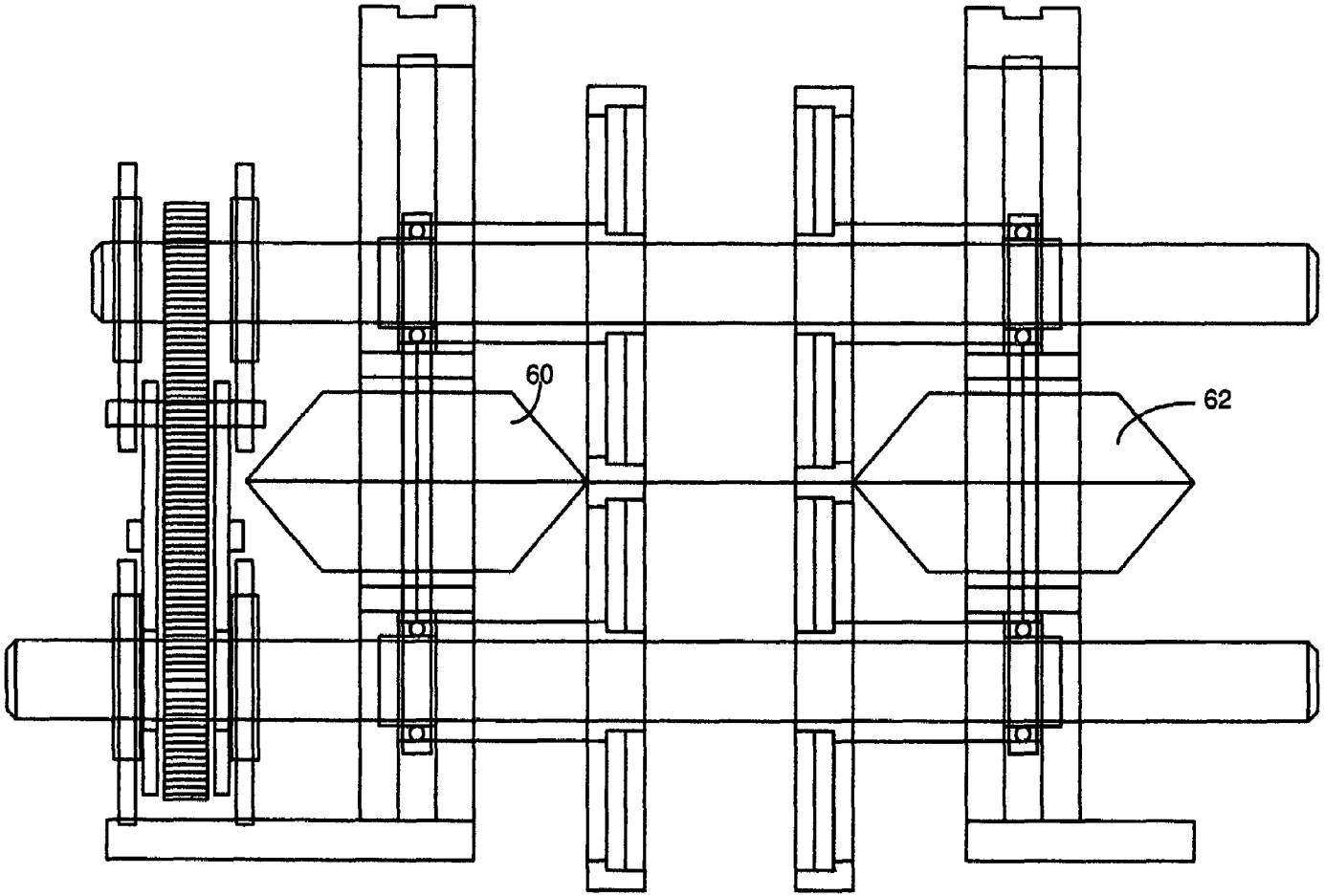
FIG. 20 is a schematic of one driver mechanism embodiment for operating the driver roll elements of the present invention.

Another advantage of forming two metal strips simultaneously in the manner described above is that since the flanges 26, 28 of each strip 14, 15 are being formed in opposite directions from the opposing strip, they mutually support each other as they pass between the driver rolls 48 of adjoining roll passes. Consequently, when only a single metal strip is being formed, there is a tendency for the flat web portion 24 to be pushed downwardly in a bowed shape between roll passes as the edges of the component are being forced upwardly by the next pair of idler forming rolls 50. This is illustrated in FIGS. 17 and 18. Since the two paired strips 14, 15 are being formed in opposition to each other, however, the tendency to bow will be offset. This results in a straight line producing no strain in the metal at the juncture between the web portion 24 and the flanges 26, 28, making for more stress-free forming and a more uniformly formed shape. This is particularly illustrated in FIG. 19. Moreover, since the flanges 26, 28 are being air formed as opposed to die formed as in the prior art (metal forced between matching upper and lower roll forming dies), there is no tendency for the forming rolls to pinch any over-gauge metal in the edge and induce stresses as is the case in die formation processes.

Figure 21:
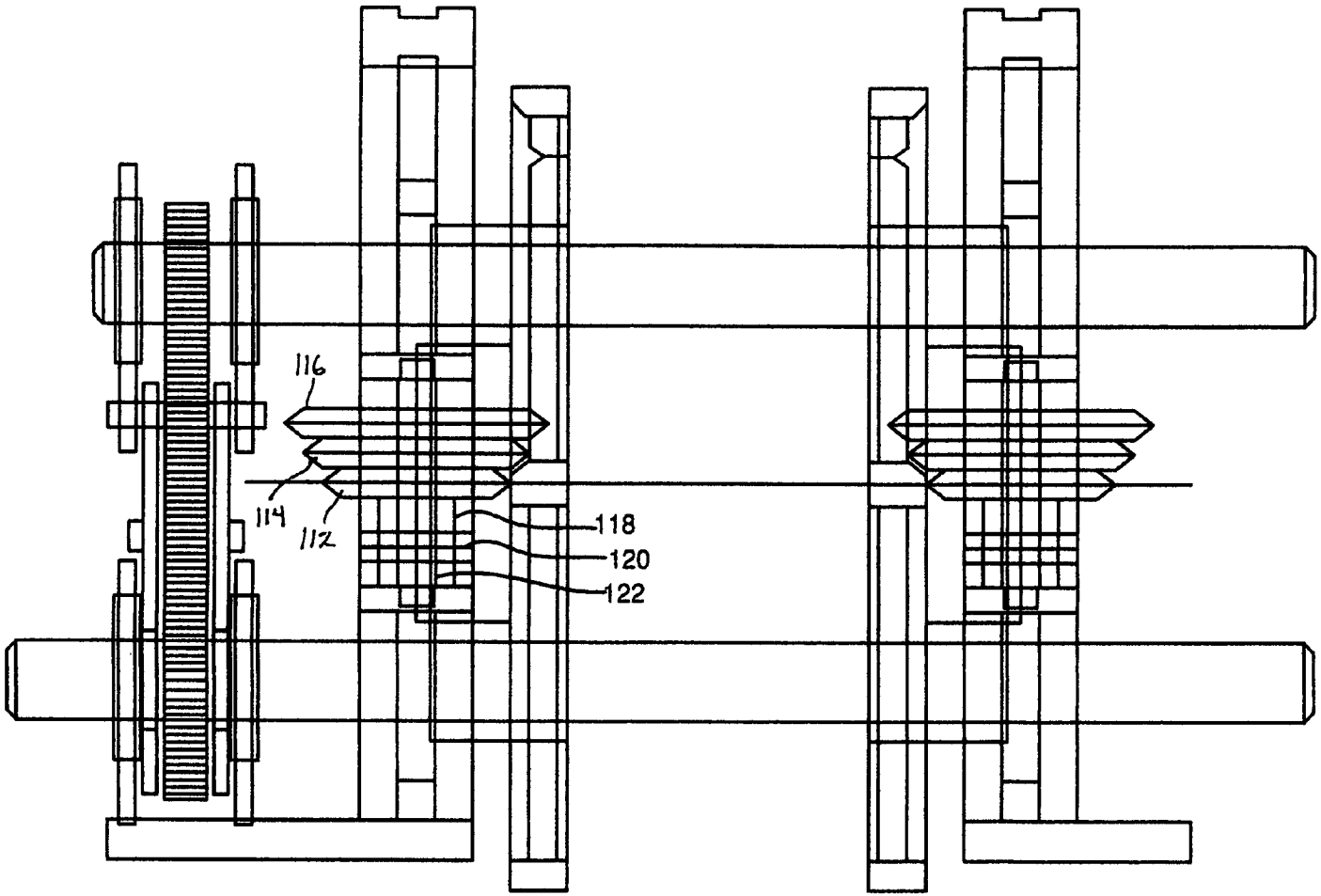
FIG. 21 is a schematic of the idler rolls of various sizes to gradually form the edges of the U-shaped members.
Figure 22:
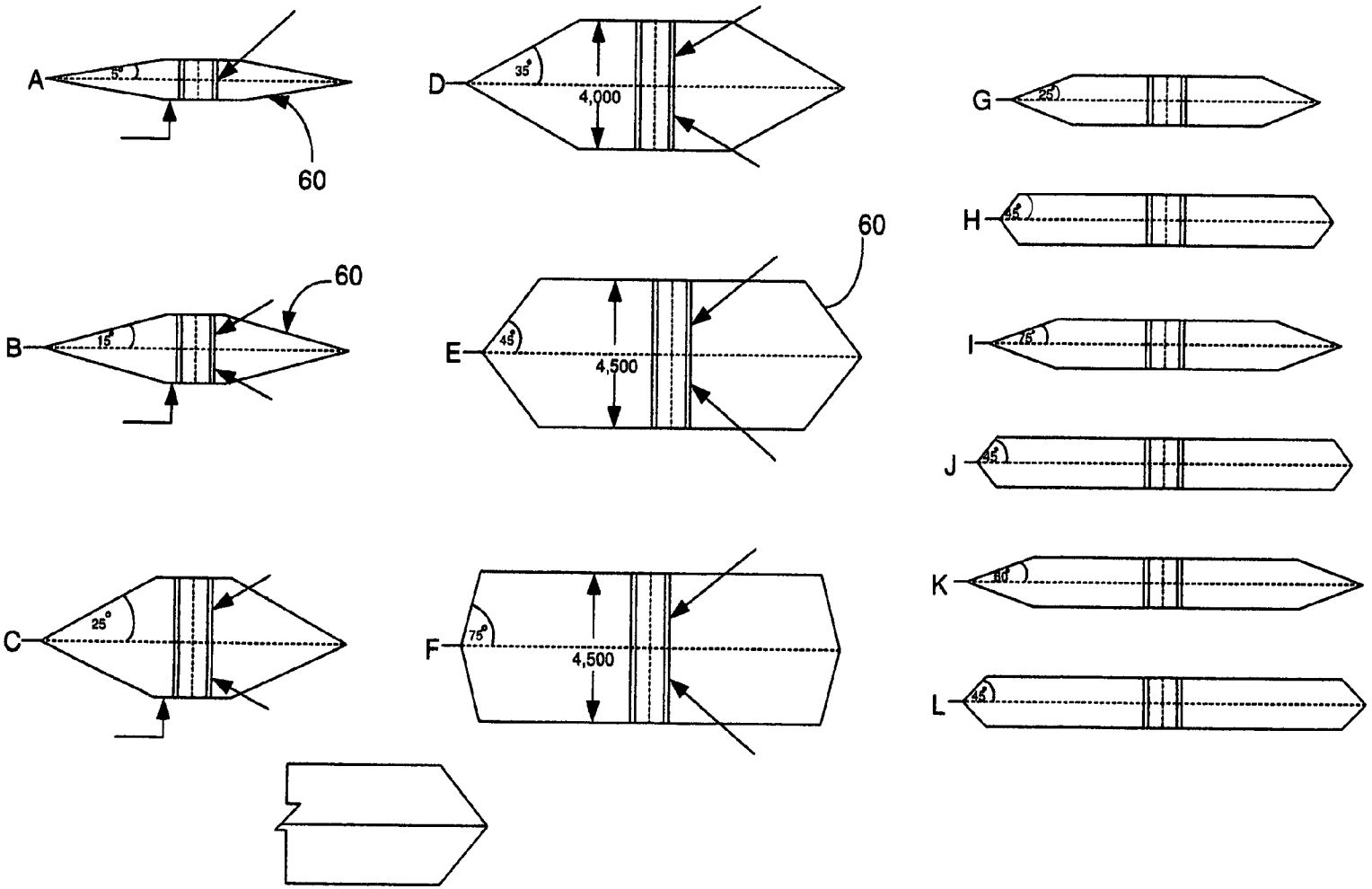
FIG. 22 is a schematic of the various sizes of idler rolls useful with the present invention.
Figure 23:
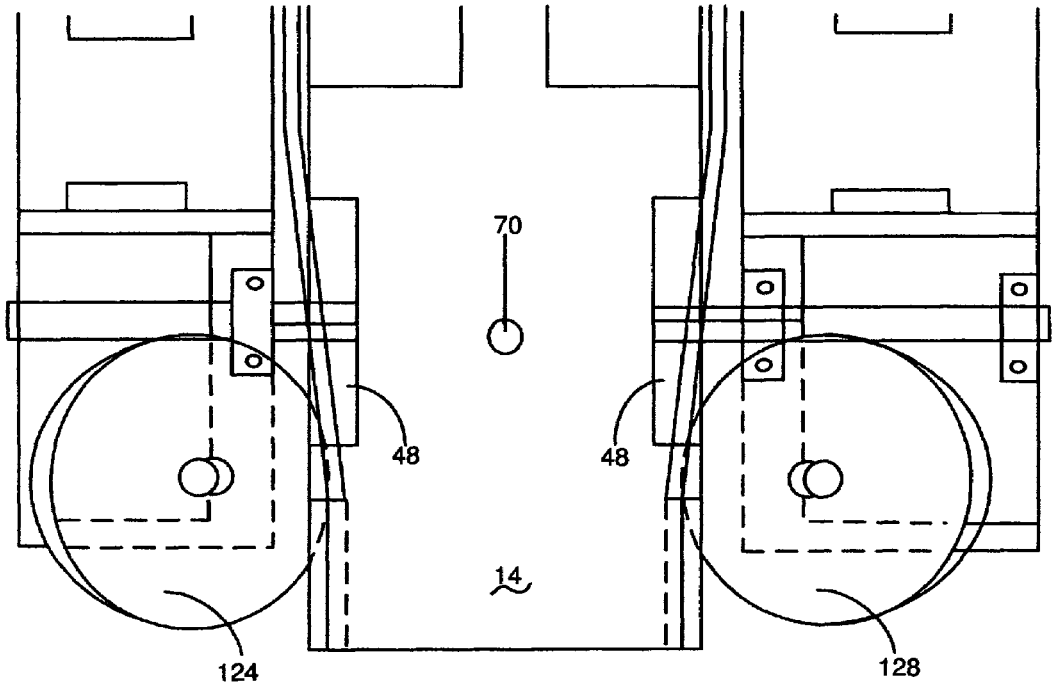
FIG. 23 is a partial top plan view of the rear portion of a roll forming device embodiment constructed in accordance with the present invention.
Figure 24:
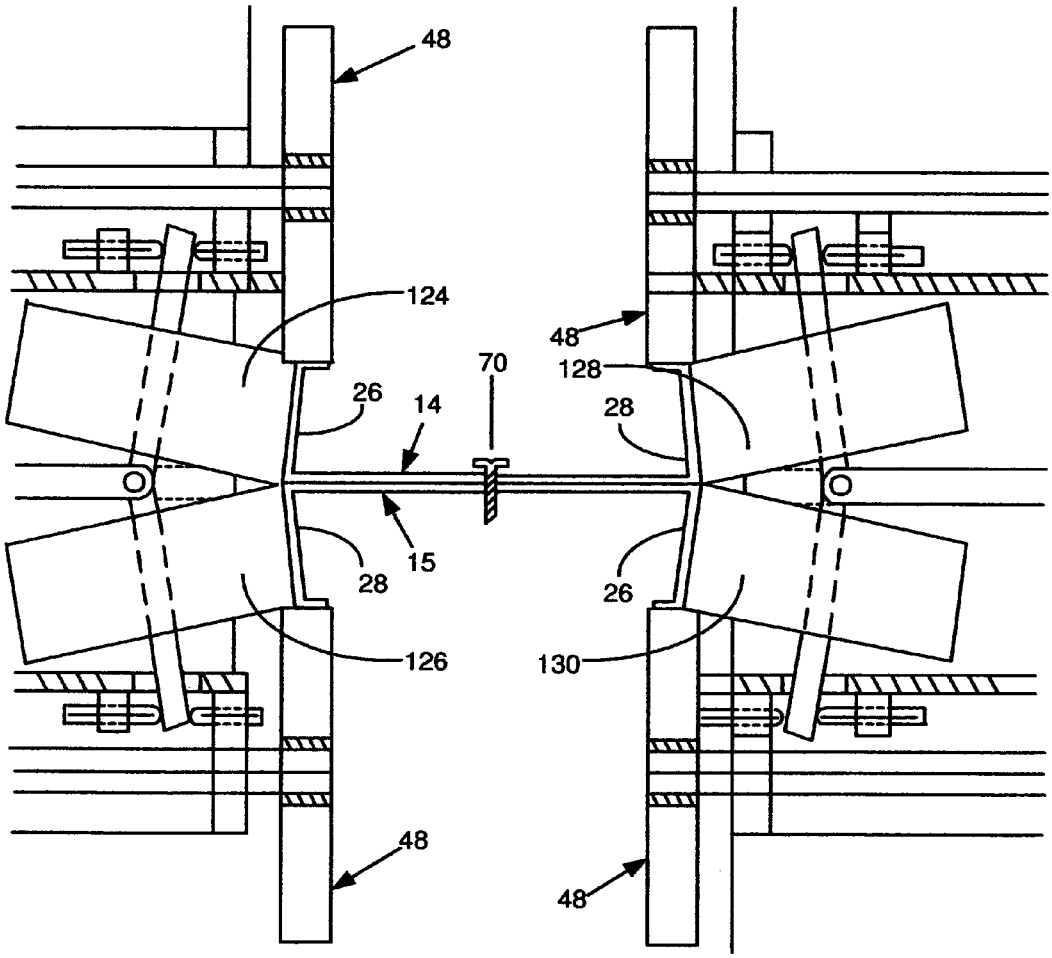
FIG. 24 is an end view of the rear portion illustrated in FIG. 23.

Reference is now made to FIG. 21. For forming the stiffened lip portions or elements 32, 34 of the stud members 30, there are preferably stacks of three idler forming rolls 112, 114 and 116, each having a different diameter. To form the stud elements 30, there are three leg lengths needed. Specifically, a 1⅝" leg with a 0.375" stiffened edge, a 2" leg with a 0.500" stiffened edge, and a 2½" leg with a 0.500" stiffened edge. On the stud elements 30, the first and second roll passes through the device 12 form the stiffened edges 32, 34 up to a 135° angle to what will be the side flanges 26, 28 of the finished component. There are also two removable support collars 118 and 120 and a non-removable support collar 122 disposed under the stack of the three idler forming rolls 112-116 in the first two passes. When a removable support collar 118 and/or 120 is removed from below the stack, the next smaller diameter forming roll 114-112 will move downward into the centerline position between the two steel coil strips 14, 15. In this manner, the stiffened edge or lip elements 32, 34 may first be formed before the remaining forming of the side flanges 26, 28 as the metal strips continue to move through the device 12.

The track members 22 do not include such additional stiffened lip elements. Therefore, the widths of the metal strips for the track members 22 are narrower than their stud element counterparts and are positioned to run through the first two passes of the roll forming device 12 without any stiffened edge forming and therefore without any contact thereby.

Referring now to FIGS. 23-26, it should be mentioned that the last 45 degrees of formation of the side flanges 26, 28 is preferably performed as the track members 22 or stud elements 30 pass through the sizing idler rolls just before the components pass into the punching portion of the roll forming device 12, a portion that is not applied to the stud elements 30. In preferred form, a set of four sizing idler rolls 124, 126, 128 and 130 are provided toward the rear portion 18 of the device 12. The idler rolls 124 and 128 form the flanges 26, 28 of the upper metal strip 14, while the idler rolls 126 and 130 form the flanges 28, 26 of the lower metal strip 15. The flanges 26, 28 are formed to less than a 90° angle to allow for metal snap back after the part has left the device 12, therefore making the final metal component to be substantially U-shaped with a flange angle of about 90°. The drive rolls 48 are positioned to move against the lip elements of the stud members 30 as they pass through this portion of the device 12. Moreover, the delay of the final forming of the side flanges 26, 28 of the stud element 30 allows the side flanges to be so formed without the ends of the lip elements coming into contact with the outer edges of the driver rolls 48 in earlier passes through the device 12.

Figure 25:
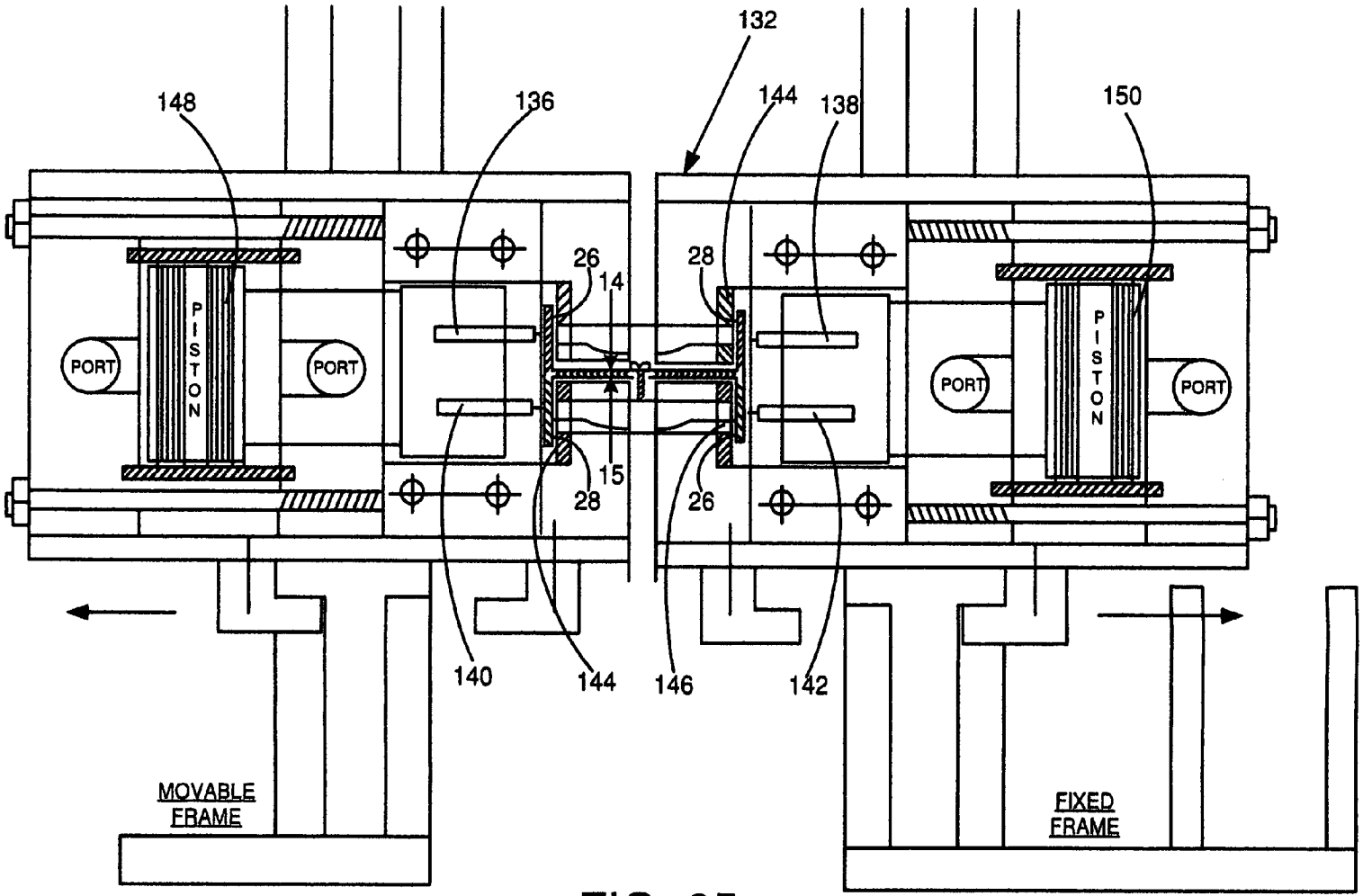
FIG. 25 is a sectional view of the rear exit fixture of the embodiment illustrated in FIG. 23 and showing the track punching heads thereof.
Figure 26:
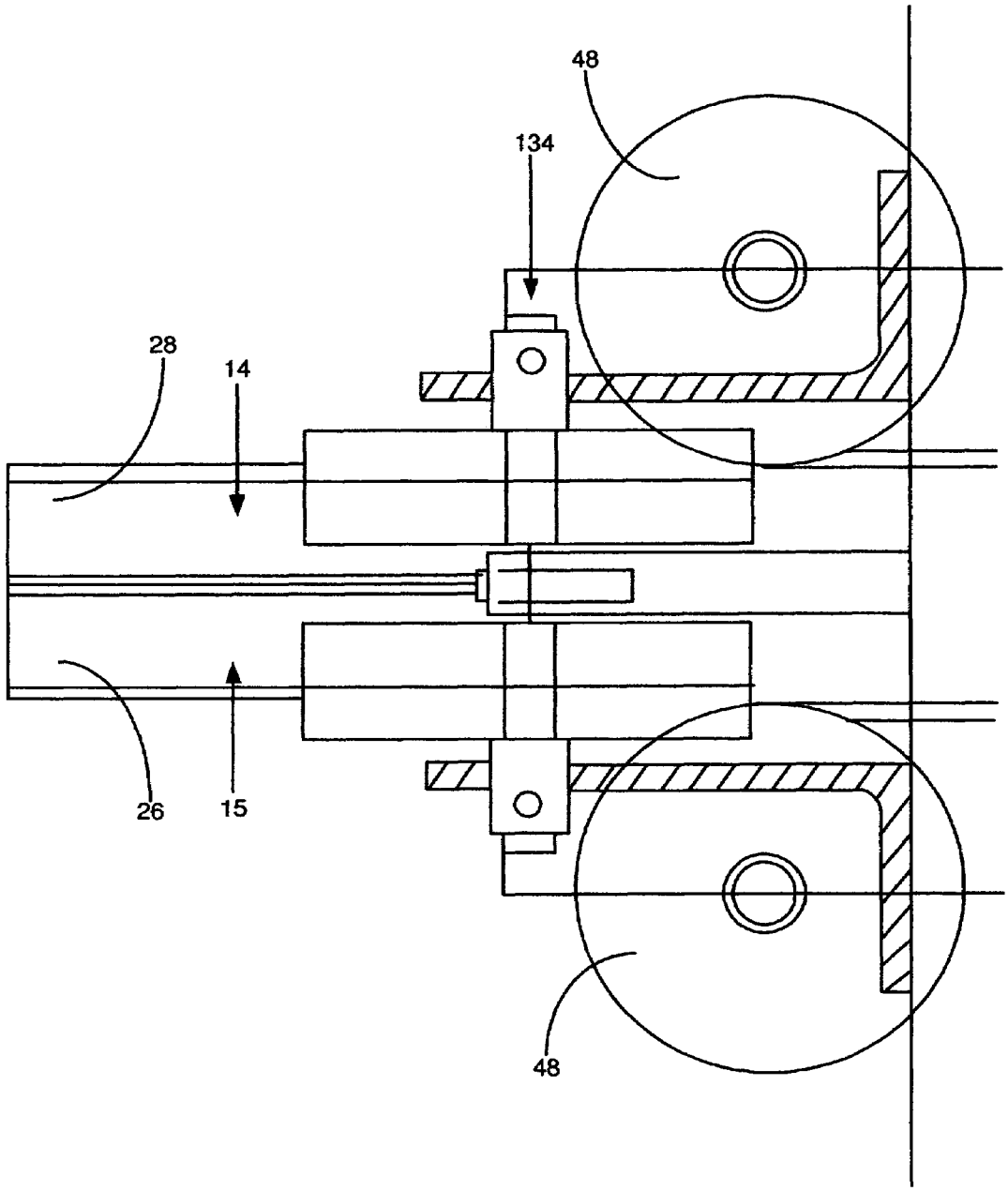
FIG. 26 is a top plan view of the rear exit fixture of FIG. 25.
Figure 27:
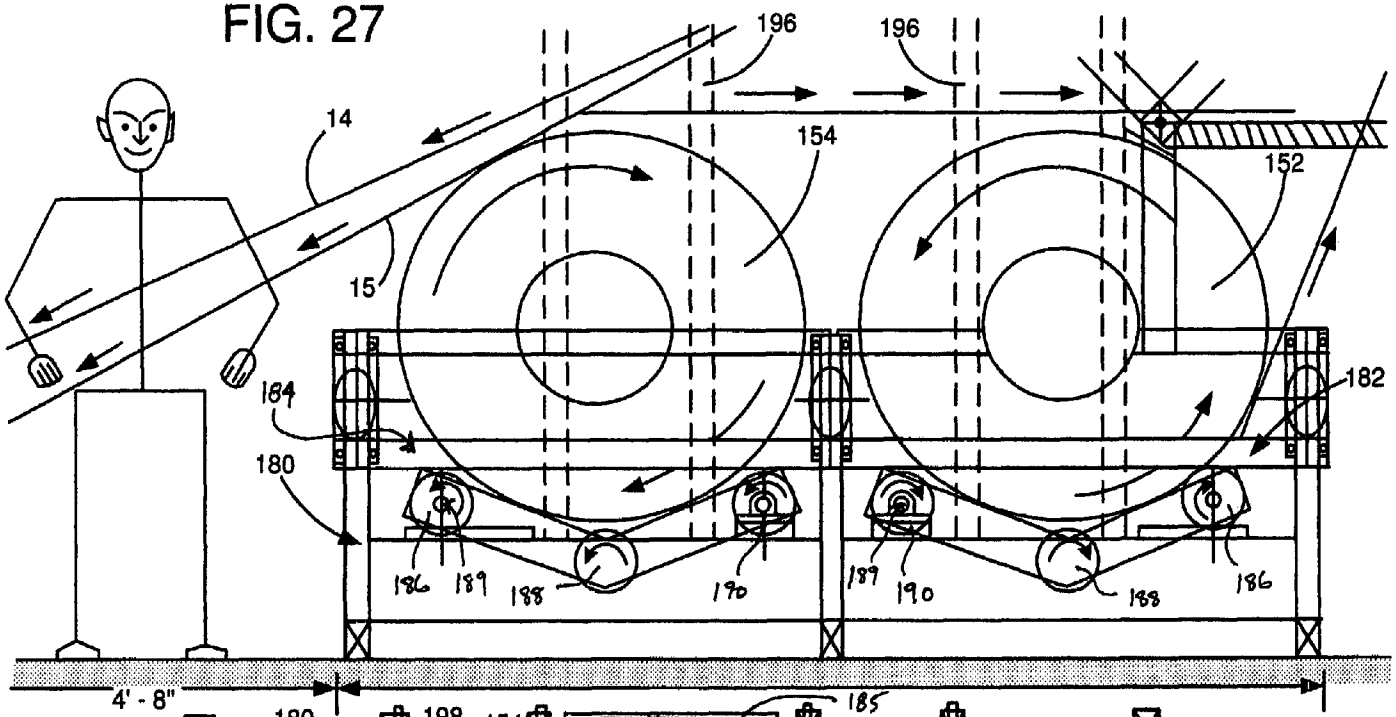
FIG. 27 is an enlarged side view of a first steel coil cradle assembly embodiment for feeding metal strips in the roll forming apparatus constructed in accordance with the present invention.
Figure 28:
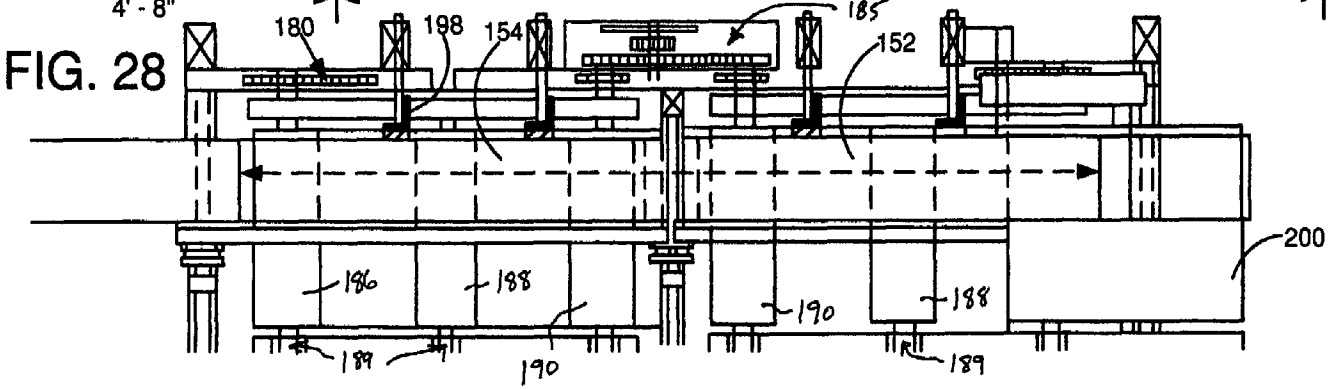
FIG. 28 is a top plan view of the embodiment illustrated in FIG. 27.
Figures 29, 29A:
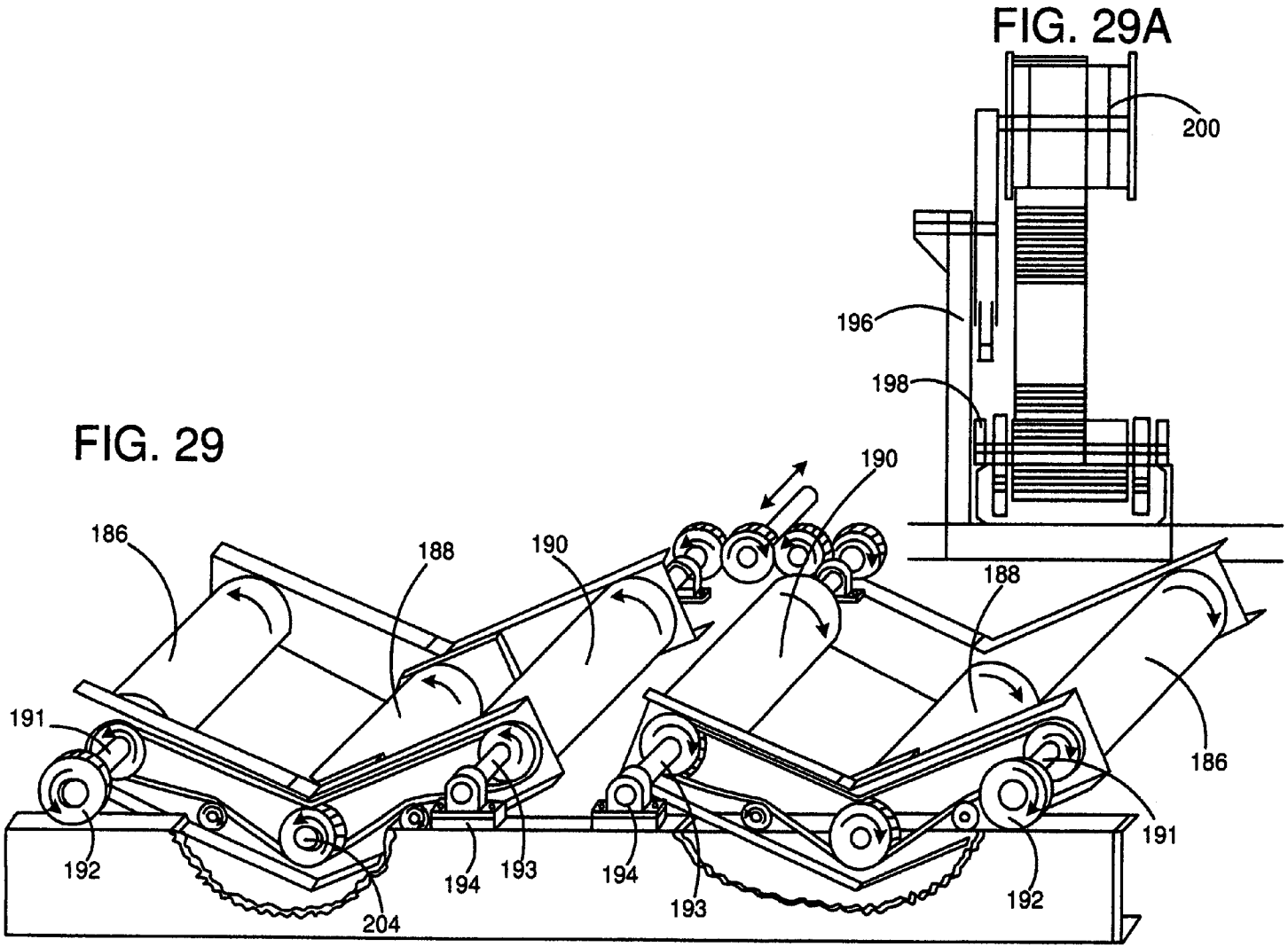
FIG. 29 is a side perspective view of the steel coil cradle assembly embodiment illustrated in FIG. 27.
Figures 30, 31, 32:
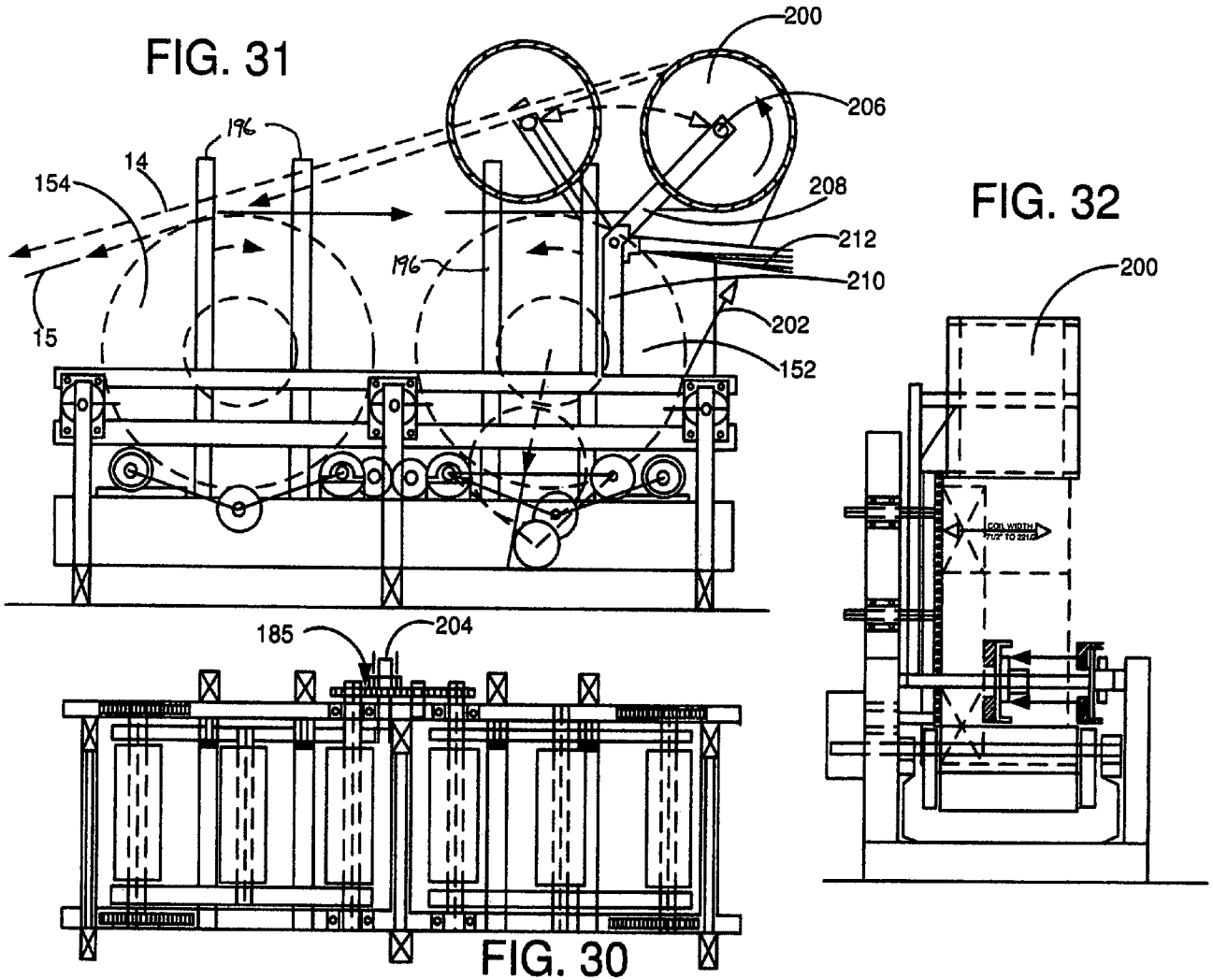
FIG. 30 is a top plan view of the embodiment illustrated in FIG. 29.
FIG. 31 is an enlarged side view of the cradle assembly of FIG. 27 and illustrating the dancer wheel thereof in each of two different positions.
FIG. 32 is an end view of the embodiment illustrated in FIG. 31.
Figure 32A:
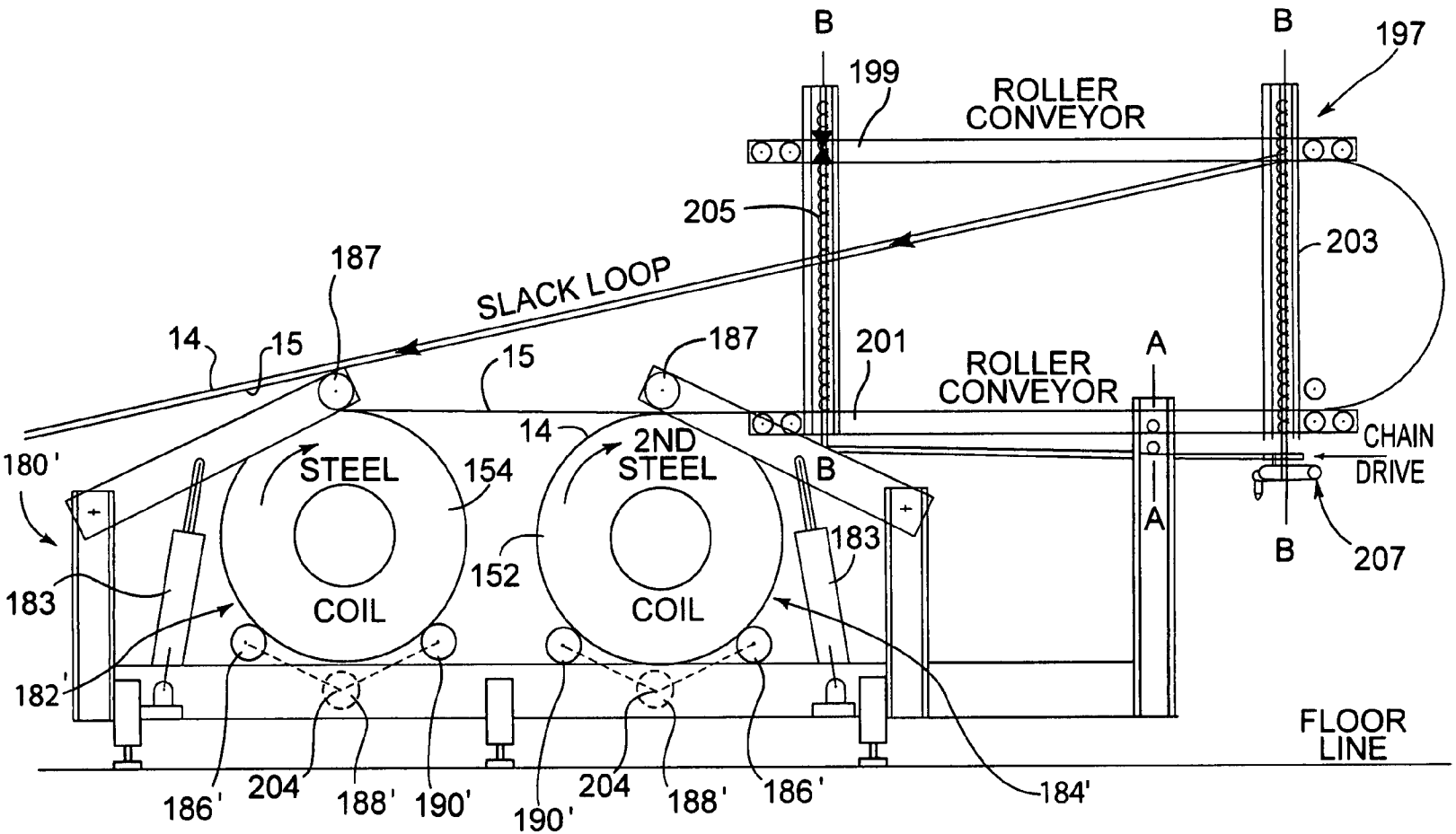
FIG. 32A is an enlarged side view of a second and preferred steel coil cradle assembly embodiment for feeding metal strips in the roll forming apparatus constructed in accordance with the present invention.
Figure 32B:
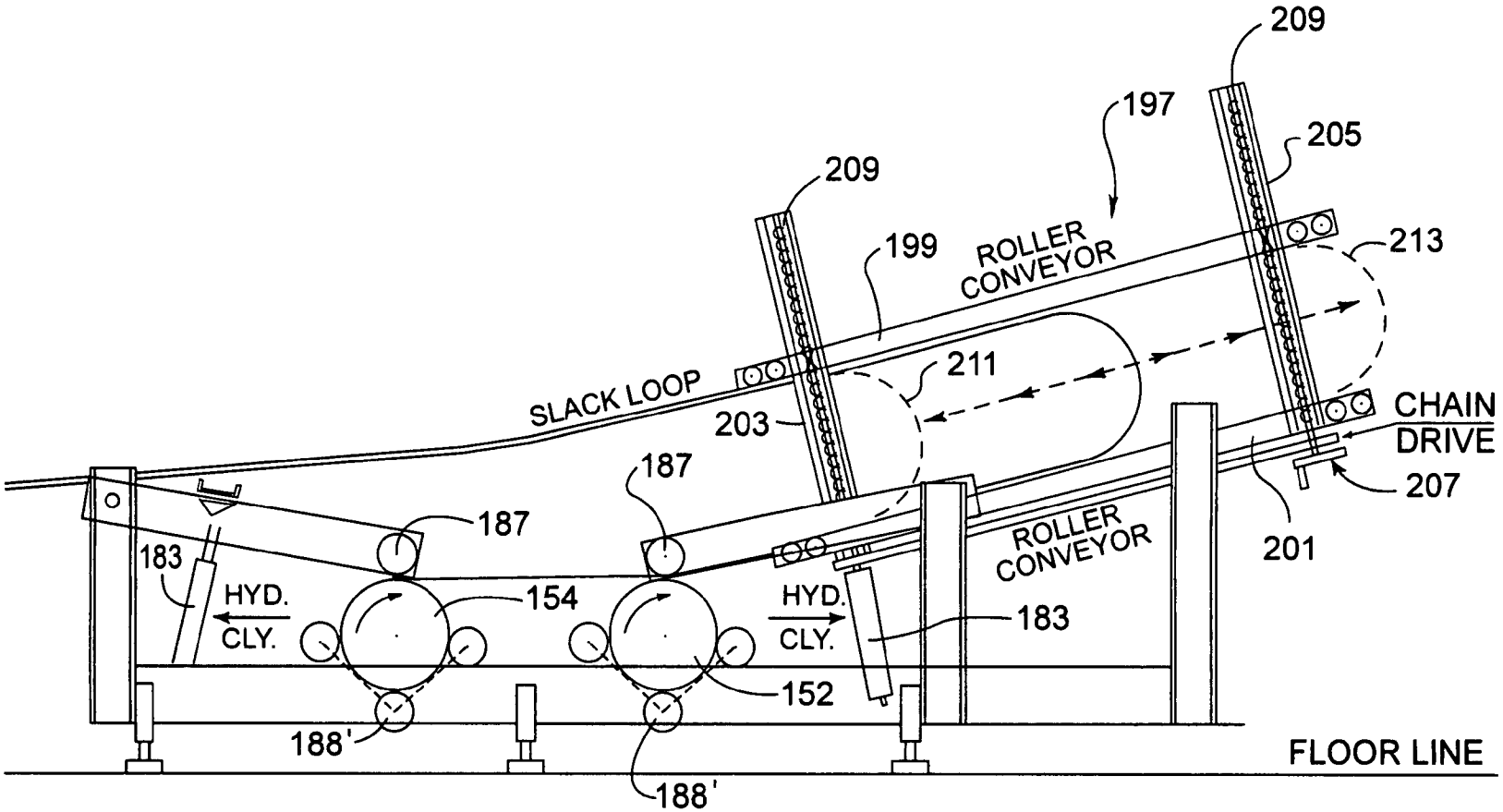
FIG. 32B is an alternate side view of the second steel coil cradle assembly embodiment apparatus constructed in accordance with the present invention.
Figure 32C:
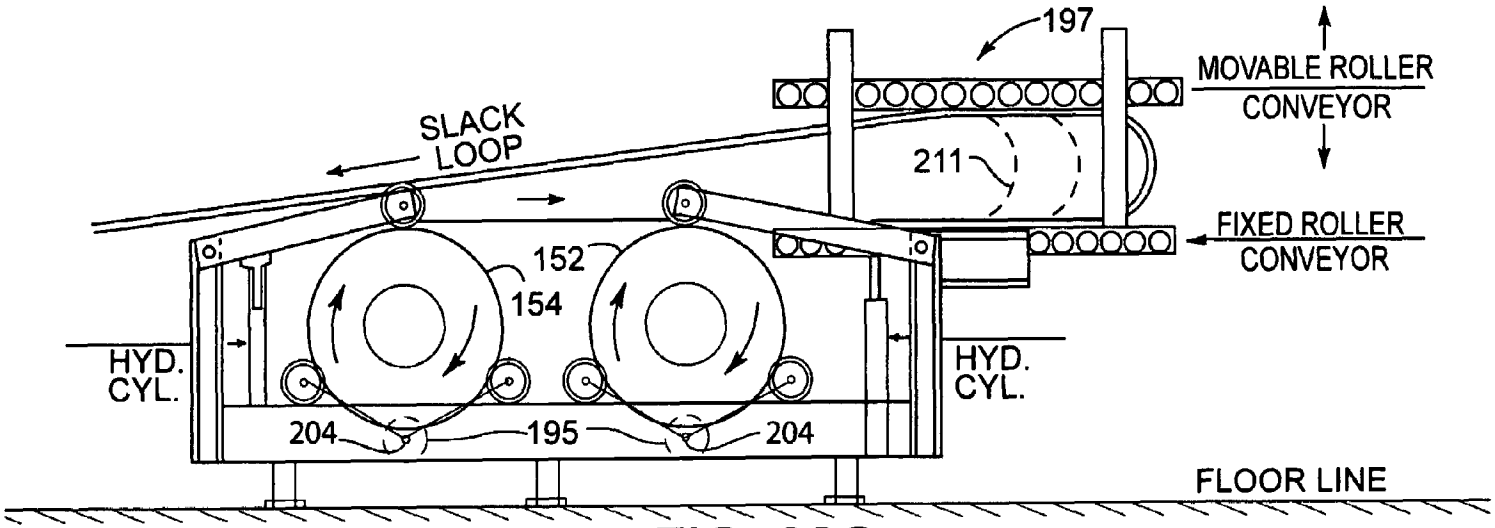
FIG. 32C is yet another side view of the second steel coil cradle assembly embodiment illustrating in particular the driving roller positions for the coils thereof.
Figure 32D:
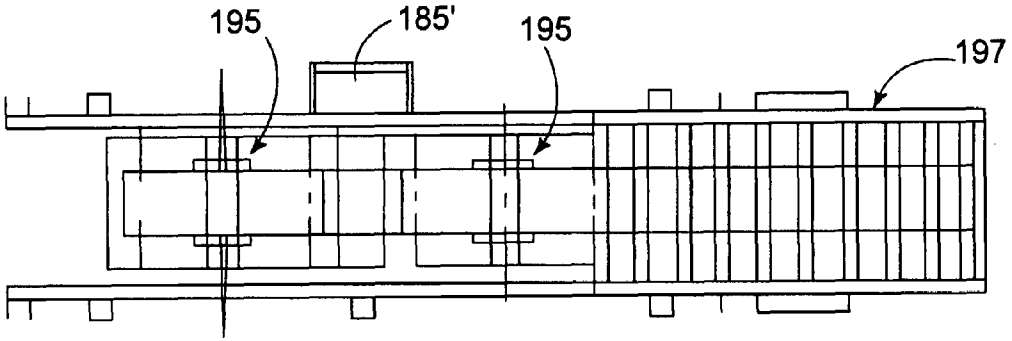
FIG. 32D is a top plan view of the embodiment illustrated in FIG. 32C.
Figures 33, 34, 35, 36, 37:
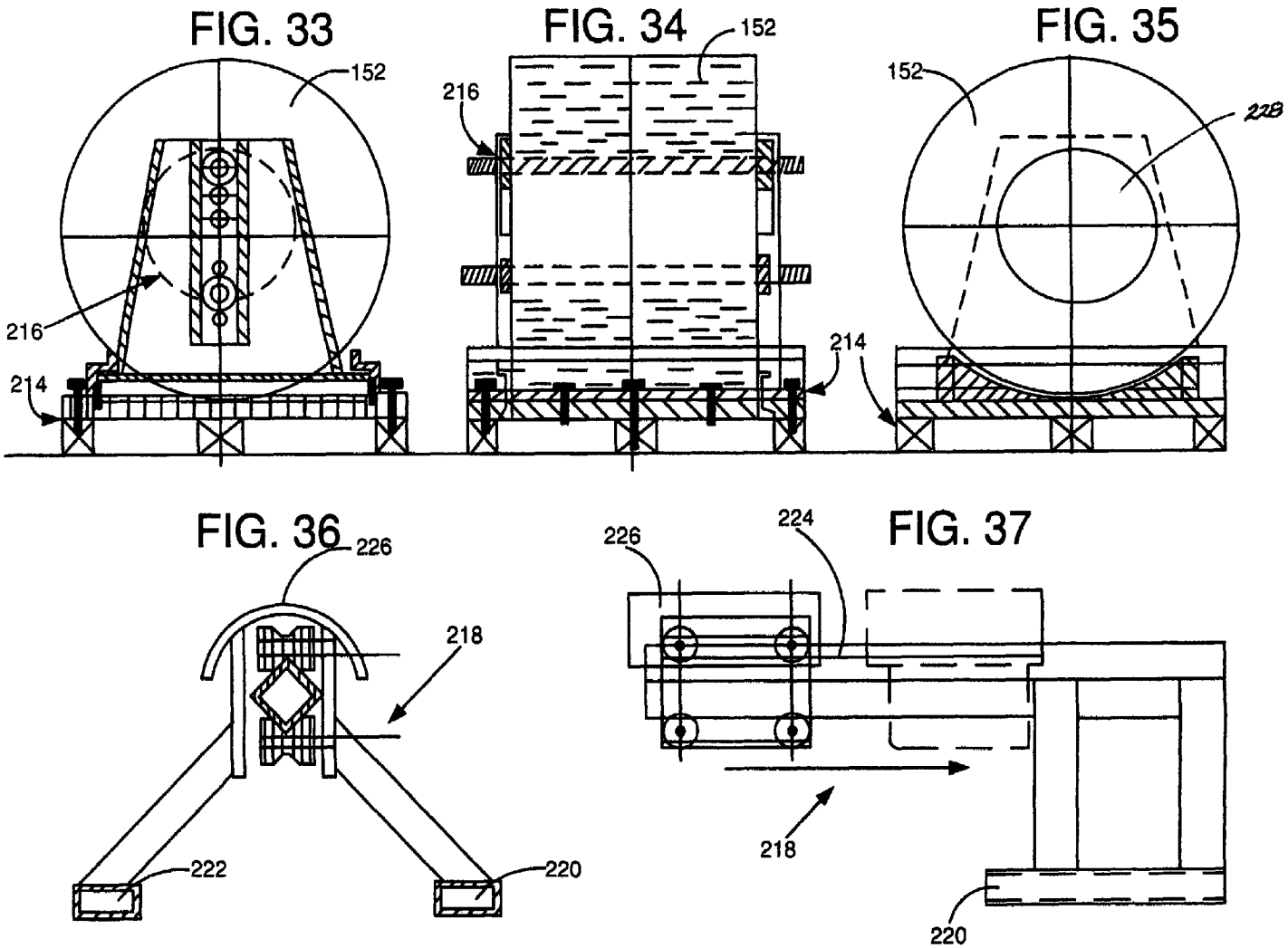
FIG. 33 is a front end view of a steel coil pallet storage fixture.
FIG. 34 is a side view of the embodiment of FIG. 33.
FIG. 35 a rear end view of the embodiment of FIG. 33.
FIG. 36 is an end view of the coil transfer fixture of the present invention.
FIG. 37 is a side view of the coil transfer fixture illustrated in FIG. 36.
Figure 38:
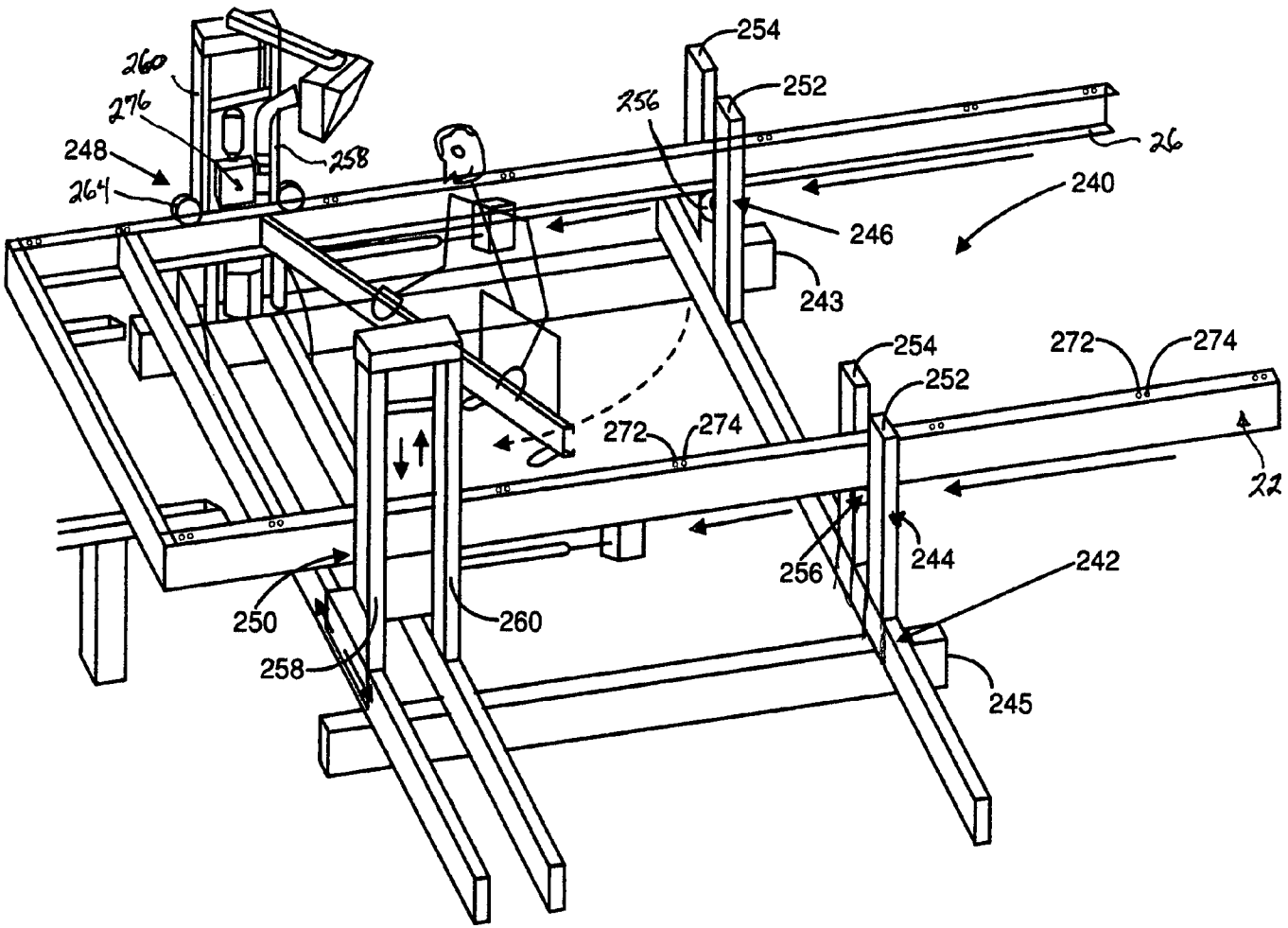
FIG. 38 is a top perspective view of a wall frame assembly device of the apparatus of the present invention.
Figure 39:
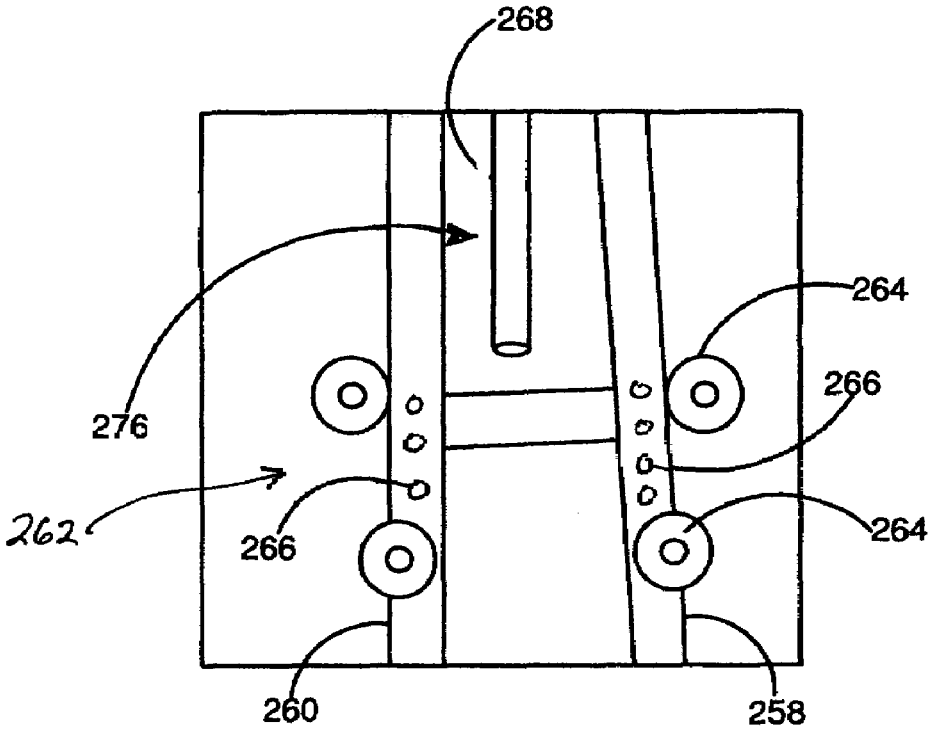
FIG. 39 is a side perspective view of the device for assembling metal tracks and studs into a building wall structure.
Figure 41:
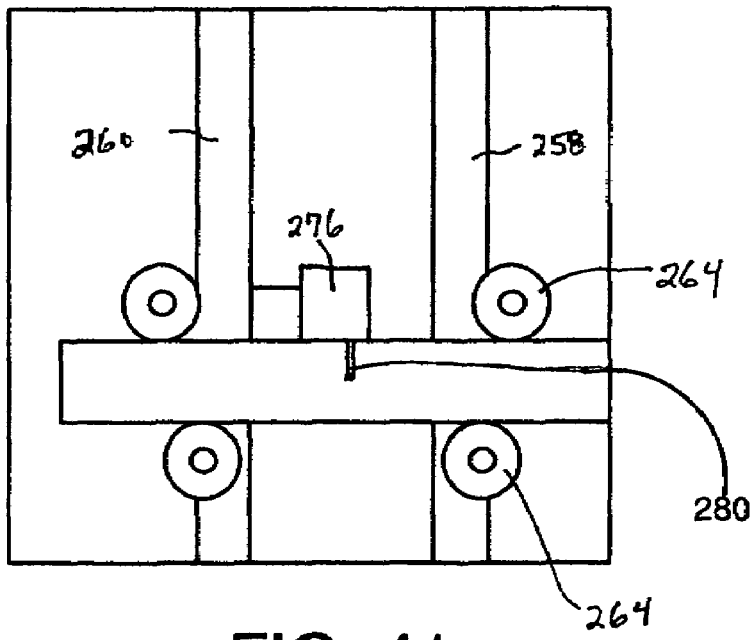
FIG. 41 a side perspective view of the device of FIG. 39 but illustrating a metal track element therein.
Figure 40A:
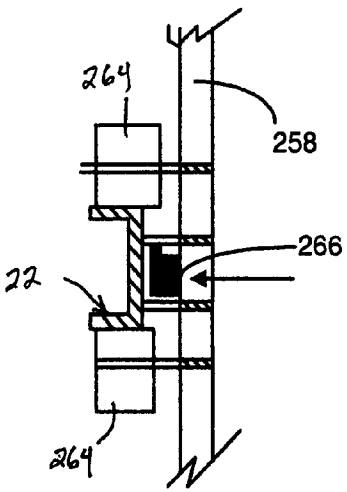
FIG. 40 is a side elevation of the device for assembling metal tracks and studs into a building wall structure.
Figure 40:
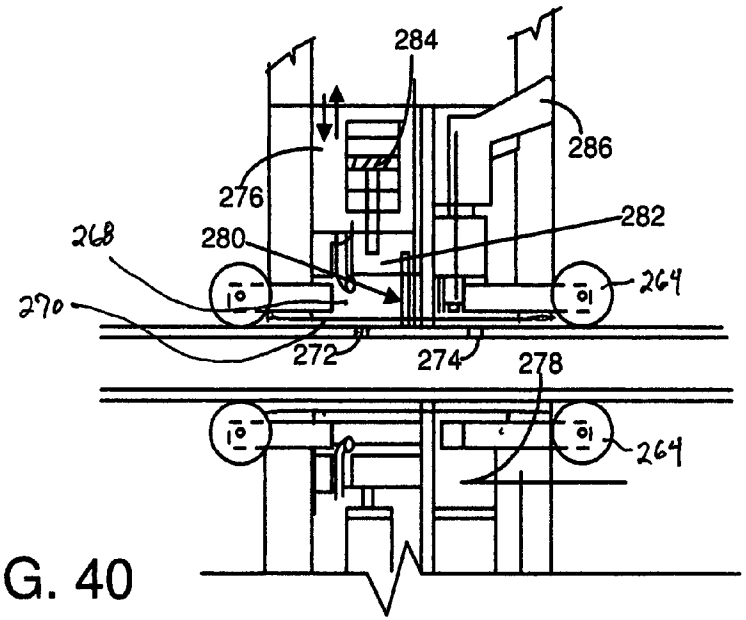

To assist in assembling the metal components into wall frame sections 36, a hole punching system is provided. In one embodiment, the hole punching occurs at the end of the rear portion 18 of the device 12 after the final forming of the side flanges 26, 28. Referring to FIGS. 25 and 26, a hole punching system 132 is preferably disposed immediately before the exit fixture 134. The hole punching system is only activated when track members 22 are formed. A pair of holes are punched into the side flanges 26, 28 of each track member 22 at spaced intervals depending on the desired intervals of the studs to assembled with them to form desired wall structures. Preferably, these intervals are on approximately 16" centers. The side flanges 26, 28 are guided between four sets of paired punch elements 136, 138, 140 and 142 and a back wall member 144. The back wall members 144 have openings 146 to allow the punch elements to pass through the flanges 26, 28 and through the openings 146 to create a pair of holes in the flanges 26, 28. Each punch element includes a pair of punch awls sized to create two different sized holes adjacent each other in the side flanges 26, 28. Pistons 148, 150 are operated by compressed air or any other suitable system. Thus, upon activation of the punching system 132, the pistons 148, 150 move the sets of punching elements 136-142 through the side flanges 26, 28 to create a pair of different sized holes on each side of each side flange 26, 28 at preestablished intervals. The use of these holes in the flanges 26, 28 will be discussed below.

It should also be noted that the punching operation to create holes in the side flanges 26, 28 of each sheet 14, 15 may also occur at the front portion 16 of the device 12. In this instance, the punch elements as described above are arranged at the front portion 16 to punch the sheets 14, 15 at appropriate locations just before and as the sheets 14, 15 are fed into the forming rolls of the device 12. This may occur at the same approximate location in the device 12 as the screw gun 72. Alternatively, the punching operation to create holes may be embodied as an entirely separate machine or device mechanism, operating basically in the manner as described above.

The Metal Feeding Mechanism

Referring now to FIGS. 7, 8, 8A and 27-32, one embodiment of the mechanism for feeding the metal strips 14, 15 into the front portion 16 of the device 12 is illustrated. As previously indicated, the present invention preferably forms two metal sheets simultaneously. In one preferred form, two coils 152, 154 of rolled steel are provided to feed the sheets of steel into the device 12 for simultaneous roll forming. The coil 152 provides the upper strip 14 while the coil 154 provides the lower strip 15. In preferred form, the metal strips 14, 15 are cut to length as they enter the front portion of the forming device 12 so that they are in proper lengths for assembly after they have passed through the device 12 and have been formed into the stud elements 30 or the track members 22 as previously described.

Figure 7:
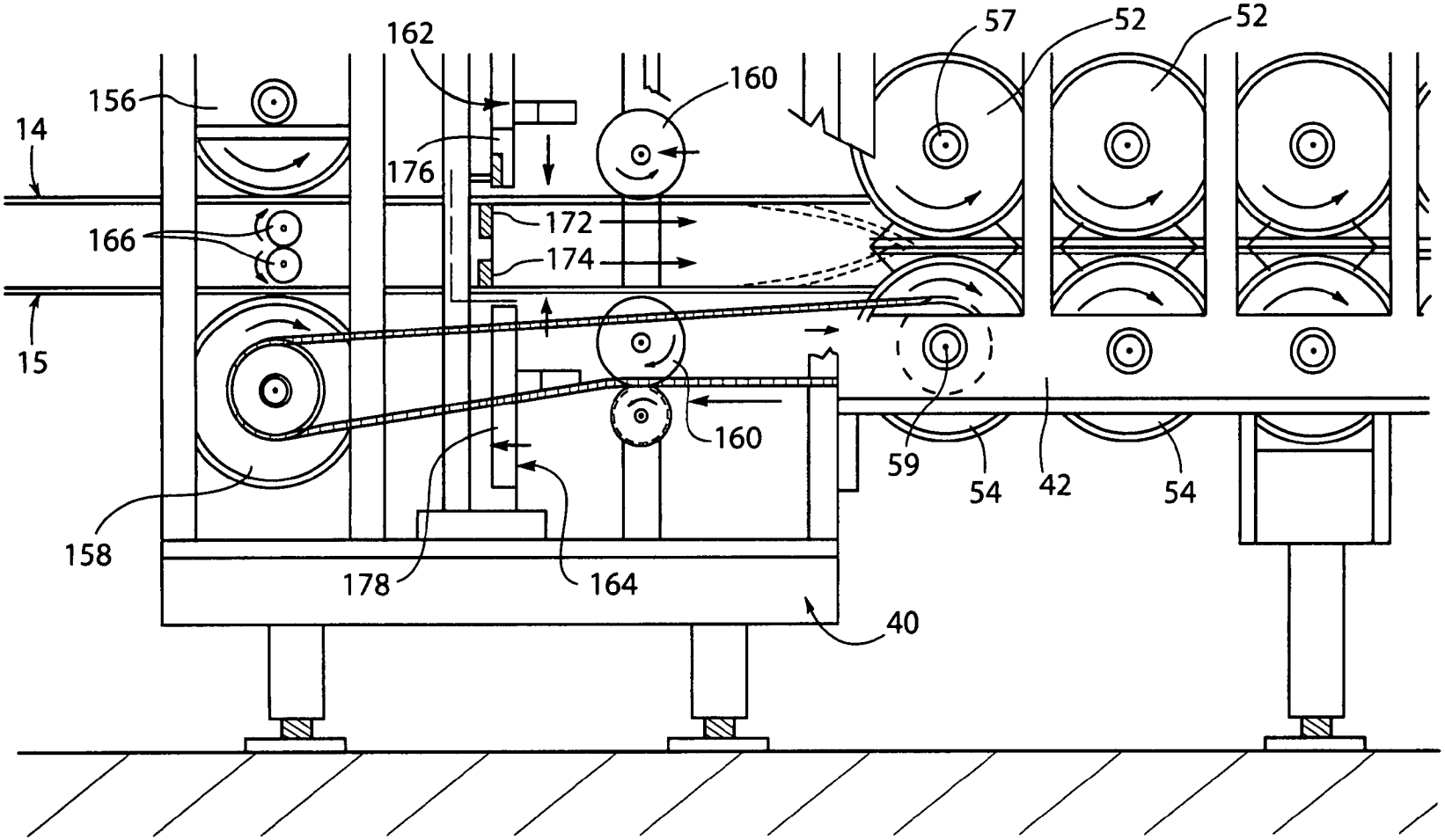
FIG. 7 is a partial, enlarged side view of the front portion of a roll forming device embodiment constructed in accordance with the present invention.
Figure 8:
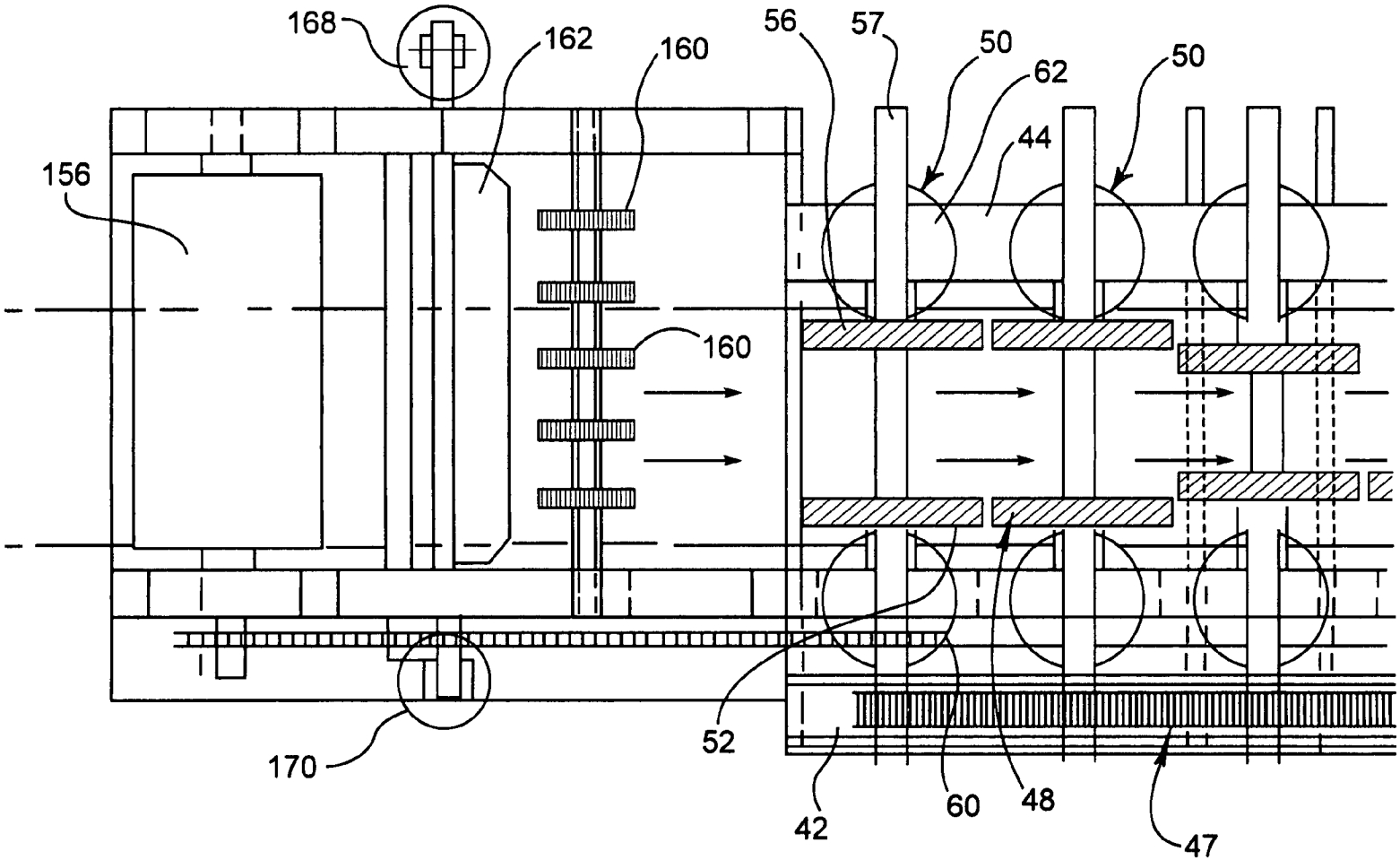
FIG. 8 is a top plan view of the device illustrated in FIG. 7.

Referring in particular to FIGS. 7 and 8, the front portion of the device 12 includes a pair of shear drive rolls 156, 158 for moving the strips 14, 15 into the shearing mechanism. A plurality of upper and lower magnetic roller members 160 assist in moving the strips 14, 15 through the shearing mechanism but also ensure that the metal sheets 14, 15 are maintained separate as they pass through the shearing blades 162, 164. Encoder wheels 166 are provided and measure the length of the metal sheets in thousandths of an inch to ensure that proper lengths are cut. Hydraulic cylinders 168, 170 are provided to operate the shearing blades 162, 164. The dual orbital shear 162, 164 preferably consists of a center stationary section holding stationary blades 172, 174 and upper and lower movable sections and blades 176, 178. The two double acting hydraulic cylinders 168, 170 each with two pistons power the two movable cutoff shears 176, 178 which cut the two strips 14, 15 simultaneously. This shearing action takes place while the drive rolls 156, 158 are stopped, after which they again rotate and drive the now cut coil ends towards the roll former device 12.

Figure 8A:
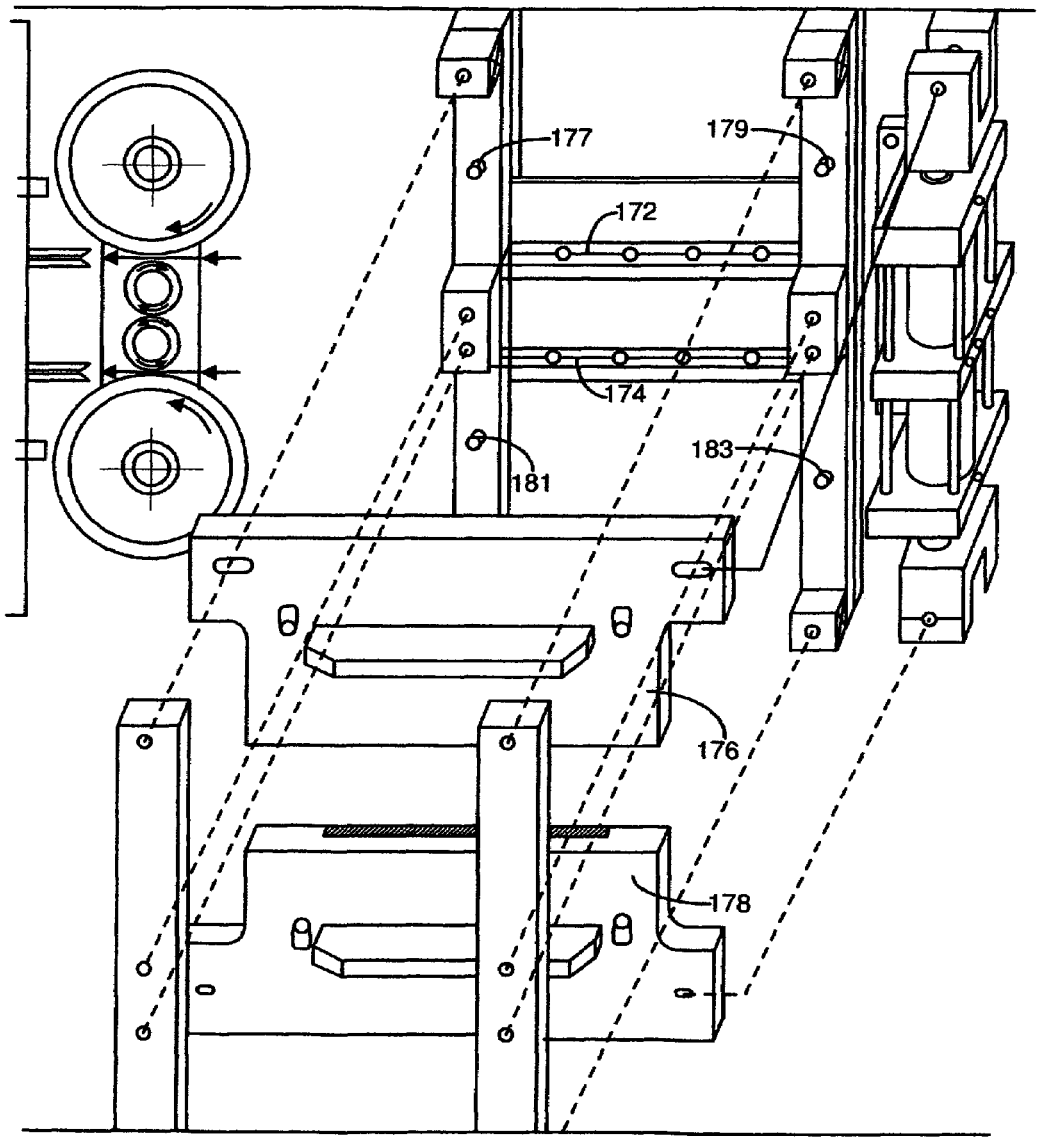
FIG. 8A is a front exploded perspective of one shearing mechanism embodiment utilized in the device of the present invention.

Referring particularly to FIG. 8A, by controlling the sequencing of the hydraulic cylinder operations, the movable shears 176, 178 can each be made to orbit around two respective control pins 177, 179 for the shear 176 and control pins 181, 183 for the shear 178, thereby providing an orbital shearing motion. The shear blades 176, 178 will be required to cut steel strips ranging from 24 gauge to 12 gauge and in widths from 7½" to 22½". By being able to control the fixed and movable shear blades 172-178 in relation to each other from either a parallel position to an angular position, the shear action can be changed from a blanking shear action (parallel blades) to a guillotine shear (angular blades). Blanking shear action requires more shear pressure and a shorter stroke, whereas guillotine shear action requires lower pressure and a longer stroke. Therefore, these options allow for the shears to be controlled for the optimum configuration for each metal strip width and gauge. In addition, the guillotine mode can be made to cut from either side of the metal strip.

The above flexibility permits the shear mechanism of the present invention to be designed lighter in weight than if it were necessary to design it to handle the worst case situation for the widest and heaviest strip within its cutting range. The metal strips 14, 15 are checked by sensors for their gauge and widths as they are fed into the shear coil feed rolls 156, 158, and an onboard computer (not illustrated) which controls all of the machine's actions can thus automatically adjust the shear action for the optimum configuration for the gauge and width of the strip being processed.

The ends of the coils 152, 154 need to be kept separated so that they enter the first set of drive rolls 48 of the device 12 with the upper coil end 14 above the center point 66 of the first set of idler forming rolls 50 and the lower coil end 15 below the point 66 of the idler forming roll 50. To keep this separation and maintain it uniform up to the driver rolls of the first pass of the device 12, the sets of upper and lower magnetic idler rolls 160 are provided as described above. These magnetic rolls 160 attract the steel coil ends to each set of metal strips. The rolls 160 rotate while holding the strips apart. When the ends of the strips 14, 15 reach the driver rolls 48 of the first pass, the ends are bent toward the idler forming rolls 50 by the driver rolls 48 while still being held in contact with the magnetic rolls 160. Eventually the stiffness of the coil ends will overcome the magnetic holding power of the magnetic rolls 160, and the coil strips 14, 15 will pull free of the rolls 160. However, by properly spacing the distance between the magnetic rolls 160 and the driver rolls 48 in the first pass and the magnetic power of the rolls 160, this separation does not occur until the coil ends are within the circumferences of the first pass idler forming rolls 50 and are kept properly separated to be formed with the upper coil 14 upwardly and the lower coil 15 downwardly.

Referring in particular now to the embodiment of FIGS. 27-31, each of the two steel coils 152, 154 feeding the roll former device 12 is preferably loaded onto a cradle assembly 180. In one preferred embodiment, each cradle assembly 180 includes two cradles 182, 184 for receiving and holding the two coils 152, 154, respectively. Each cradle 182, 184 includes three support rollers 186, 188 and 190 on which a coil 152, 154 rests. All of the support rollers 186, 188, 190 are driven at the same peripheral speed and are arranged so that their drive surfaces stay in equal contact with the outer wraps of the coils 152, 154, respectively, as each coil gradually decreases in outside diameter as the coils are unwound by the rotation of these driven support rolls 186, 188, 190. In preferred form, the drive shafts 189 in each set of three rollers 186, 188, 190 are mounted in pillow block bearings located in fixed positions as shown and are driven by a drive gear assembly 185. The outside shafts of the sets of the three drive rolls 186, 188, 190 are in free turning wheels whose radius is equal to the fixed shafts center distance from the channel flange to which they are mounted. The weight of the steel coil 152, 154 rests on all three of their respective drive rollers 186, 188, 190. As the outside diameter of each coil 152, 154 is unwound, the center roll 188 will descend while the outside roll 186 of each set whose shaft 191 is supported by the free turning wheel 192 will move toward the drive roll 190 with the shaft 193 supported in the fixed position bearing blocks 194.

In this particular embodiment, there are preferably vertical support members 196 located on both sides of each coil 152, 154 which are adjusted to the coil's width and keep it located on the three drive rollers 186, 188, 190 in the desired location. The support members 196 prevent any tendency for the coil 152, 154 to tilt out of a vertical position as it uncoils. There are preferably a series of ball rollers located along these support members 196 which allow the coil 152, 154 to turn against them with little friction. Since the coil drive is subject to slowing down and stopping during the unwinding of each coil, it is necessary to have braking blocks 198 which press the sides of a coil 152, 154 whenever the speed of the coil is slowed or stopped. The reason this is required is that this same inertia of the inner wraps of each coil during slowing or stopping of the coil would cause these inner wraps to spin within the coil and the outer wrap, thereby causing the coil to go soft and lose its firm round shape. It should be noted that this same inertia effect would also occur if the coil were to be mounted on a shaft or spindle with an expanding arbor support located in the coil inside diameter.

As previously discussed, the cradle assembly 180 feeds out two metal sheets at the same time for simultaneous forming in the device 12. To assist in this endeavor, a dancer or tensioner wheel 200 is provided in this particular embodiment. The dancer wheel 200 provides a means of establishing a slack loop 202 of the two strips of coil 14, 15 feeding into the shearing blades 162, 164 and the roll former device 12. It also detects whether the rate of the unwinding coils 152, 154 on the cradle assembly 180 is greater or less than the speed of the coil moving through the roll former device 12. Initially, as the ends of the unwound coils are wound over the wheel 200 to form the slack loop 202, it is necessary for each of the two coils 152, 154 on the cradle assembly 180 to be able to turn independently of each other. This is accomplished by allowing the drive gear 185 of the cradle assembly 180 which is keyed to the drive shaft 204 driven by the variable speed motor to slide out of gear with the teeth of the gears on either side of this driven gear. When the required coil has been unwound from each coil 152, 154 by turning the coil by hand to establish the slack loop 202, the gear is again slid back into place to complete the gear drive to both coils.

The dancer wheel 200 is free to turn on it's support shaft 206 which projects at right angles from a tubular member 208 which in turn is supported by a vertical tubular member 210 with a projecting shaft about which the dancer wheel tubular support is free to pivot. There is a counterweight 212 mounted in a manner to allow it to be adjustable. This weight is heavier than the weight of the dancer wheel 200. Thus, the dancer wheel 200 is counter-balanced and can rotate in an arc about its pivot shaft 208 to sense whether the coil 14, 15 is being fed off the coils 152, 154 at a rate faster or slower than the roll former device 12 is processing it. The purpose of the slack loop 202 is to allow smooth coil in-feed to the roll former device 12 without jerking or strain on the strips 14, 15. This would be the case if the strips 14,15 were to be pulled directly off the coil by the action of the pull of the strips 14, 15 passing through the roll former device 12, which would require overcoming the inertia of the considerable weight of the coils 152, 154.

This arrangement of the invention utilizes a variable speed drive motor to turn the two roll drive shafts in opposite directions. Since the coils 152, 154 are being unwound by contact with their outer surfaces, by the drive shafts and by their associated drive rolls 186, 188, 190 which support the coils 152, 154 being driven at the same rpm, each coil will be unwound in equal lengths at the same time regardless of whether or not the two coils are of equal outer diameter. A sensing switch on the dancer wheel 200 assembly varies the motor speed to keep the uncoiling feed rate from the coils to the slack loop 202 equalized for variations of coil in-feed rate to the roll former device 12 caused by stopping or slowing the roll former device 12 for cutoff and punching operations.

Referring to FIGS. 32A, 32B, 32C and 32D, an alternate and most preferred cradle assembly embodiment 180' is illustrated, with like components having like numbers. As in the prior cradle assembly embodiment 180, the assembly 180' also includes two cradles 182', 184' that are adapted for receiving and holding the two coils 152, 154, respectively. In this particular embodiment, each cradle 182', 184' includes four support rollers including the three rollers 186', 188' and 190' on which a coil 152, 154 rests. However, in this instance, the center lower roller 188' may or may not be driven as desired, and a fourth roller 187 is provided at the upper portion or apex of each of the coils 152, 154 as a hold down roll. Hydraulic cylinders 183 are provided to both lift the upper roll for ease of loading the steel coil as well as create the desired downward load pressure from the rollers 187 against the coils 152, 154. The rollers 187 are chain driven with and rotate at the same speed as the rollers 186' and 190'. The fourth roller 187 not only drives the coils 152, 154 along with the rollers 186', 190', but it replaces the dancer wheel 200 of the prior embodiment by stabilizing the metal sheets as they unwind from the coils as well as prevent "slapping back" effects. It should be noted, however, that in this particular embodiment the two coils 152, 154 are rotated in the same direction rather than in opposite directions as in the previous embodiment and are rotated by three rollers equidistantly positioned about the outer perimeter of the coils 152, 154. As a result, the metal sheets 14, 15 that wind off the coils 152, 154, respectively, both unwind from the top or upper portion of the coils and move in the same direction as described below.

The rails 196 of the prior embodiment are eliminated in this particular embodiment. In lieu of such rails, large guide rings 195 are provided on the axial ends of the shafts 204 which carry the rollers 188. The guide rings 195 are of sufficient diameter dimension so as to overlap the bottom outer edges of the coils 152, 154 to prevent sway and tipping of the coils 152, 154. Preferably, three full dog point set screws are utilized to hold the guide rings 195 in position.

As previously indicated, the dancer wheel 200 of the first embodiment has been eliminated in this particular embodiment. In lieu of a dancer wheel, a slack loop formation assembly 197 is provided. The assembly 197 includes an upper conveyor member 199 spaced from a lower conveyor member 201, both conveyor members being mounted to brackets 203, 205. The upper member 199 is movable along the brackets 203, 205 by use of an adjustment element 207, which may be a hand operable wheel as illustrated herein or any other type of appropriate device, and a chain drive mechanism 209. In this manner, the spacing between the conveyor members 199, 201 may be selectively adjusted. A slack loop 211 is then created with the metal sheets 14, 15 after they have been unwound from the coils 152, 154. The slack loop 211 represents the paired sheets 14, 15 being bent back in a direction opposite of their unwinding direction to be fed to the roll former as previously described.

In order to assist in creating the initial slack loop, a curved bracket 213 generally in the form of a half circle is pivotally attached along one edge to the end of the assembly 197 and removably attached at its opposite edge. This enables the bracket 213 to be positioned in order to create an initial slack loop 211 by forcing the strips 14, 15 into a controlled bend which is the reverse of the bend which created the coil set in the strip as it was originally wound into the steel coils 152, 154. Once the slack loop 211 is formed, the bracket 213 is pivoted out of the way.

A simple sliding spur gear transmission and drive 185' is provided and permits each coil 152, 154 to be driven individually during loading and initial feed-out to form the slack loop 211. After forming the slack loop 211, the transmission 185' is shifted so that both steel coils 152, 154 are driven and unwind the same lineal footage from each steel coil.

Referring now to FIGS. 33-37, a unique arrangement is provided for transferring the coil from pallet to coil cradles 182, 184. Typically a coil 152 is stored on a pallet 214 having an end plate 216. To transfer the coil 152 from the pallet 214 to a cradle 182, a fixture 218 is provided with a set of sleeves 220, 222 designed to fit on the outer ends of the forks of a conventional fork lift which has the capacity to lift the coil 152. An extension arm 224 is provided and terminates in a saddle assembly 226 sized and shaped to fit the inside opening 228 of the coil 152. The saddle assembly 226 is inserted into the eye or center 228 of the coil and lifted off the pallet 214. The forklift then moves the raised coil 152 into position over a cradle 182 and then deposited onto the rolls 186, 188, 190 of the cradle 182.

The Frame Assembler Apparatus

Once the metal components are cut, formed into stud elements 30 and track members 22, and then punched, they must be assembled into building wall frame units 36. To accomplish this with more expediency and efficiency, a frame assembly device 240 is provided. Despite the costs of steel framing leaning more and more in steel's favor as compared to wood framing, the cost for assembling the steel framing in situ on the job site compared to comparable costs for wood framing has been significantly higher, especially for residential construction projects. The lack of readily available experienced and skilled metal framing crews in most areas further increases this cost difference.

One approach to this problem has been the in-house plant panelized framing where frame sections are produced in-plant under controlled conditions by less skilled labor and then trucked to the job site. While generally more cost effective compared to prior typical job-site assembly, this approach has its own set of problems and limitations. The frame assembly device 240 obviates these problems and can be used on the job site or in-plant with the same effectiveness.

The roll former device 12 provided pre-cut stud elements and track members with pre-punched holes in the flanges. The roll former device of the present invention essentially produces an "erector set" of metal wall frame components which are taken by the assembler device 240 and assembled into finished framed sections complete with door and window openings as designed by a computer software program.

Referring now to FIGS. 38-42, one assembler embodiment is illustrated. In this embodiment, the device 240 preferably includes a base support frame 242 having a first stationary support rail 243 and a movable second support rail 245 to accommodate different size wall structures. The support frame also includes a first set of receiving stations 244, 246 and a second set of receiving stations 248, 250. The first receiving stations 244, 246 each include a pair of uprights 252, 254 which are mounted to each of the support rails 243, 245 and are spaced from each other. A guide roller element 256 is mounted between each set of the uprights 252, 254. Each roller element 256 is freely rotatable and is sized to receive a track member 22 on its side edge so that one side flange 26 is moved along the guide roller element 256 as the track member 22 progresses through the device 240. The track guide roller elements 256 are provided simply for support and ease of horizontal movement of the track members 22 through the device 240

Each of the second receiving stations 248, 250 also include a pair of uprights 258, 260, one set of each being secured to each of the support rails 243, 245. In this instance, each second receiving station includes an attachment station 262. Each attachment station 262 is in the form of a plurality of track guide roller elements 264 mounted to the uprights 258, 260 for guiding and carrying a track therealong substantially cross-wise relative to the support member with the side flanges 26, 28 of the track being movably engageable with and between the roller elements 264. A plurality of magnets 266 are provided along the uprights 258, 260 between the roller elements 264 so as to hold the track members 22 firmly in position within the attachment station 262.

A mounting plate 268 is provided between the uprights 258, 260 in such alignment that the track member 22 passing between the guide roller elements 264 will abut the bottom edge 270 thereof. When the side flanges of the track members 22 are punched as described above, there are two holes 272, 274 punched to provide a set of holes on each side flange 26, 28 immediately across from each other. The first hole 272 is preferably the larger of the two and is approximately 0.250" in diameter, while the second hole 274 is preferably 0.188" in diameter. The set of holes 272, 274 pass immediately below the bottom edge 270 of the mounting plate 268.

A pair of hole finder assemblies 276, 278 are attached to the mounting plate 270 along each flange 26, 28 of the track member 22 passing through the attachment station 262. The lower hole finder assembly 278 is in a fixed position, while the upper hole finder assembly 276 is adjustable to accommodate the various sizes of track members 22. In each hole finder assembly, a hardened ¼" steel rod 280 with the point preferably machined to a 0.220" tip is provided and held in an aluminum rectangular block 282. The block 282 is attached to and controlled for up and down movement by a double acting pneumatic cylinder 284 connected to the block 282. A screw gun 286 is positioned adjacent to the block 282 and is adapted to shoot screws downwardly, or upwardly as the case may be, toward the track member 22 upon activation.

During assembly operation to attach a stud element 30 to a track member 22, a light air pressure (2-3 psi) is applied to the down-stroke side of the piston 284 which causes the steel rod 280 to ride lightly along the side flange 26, 28. When the larger hole 272 comes beneath the rod 280, the air pressure on the cylinder causes it to descend into the hole 272. The lever operated air valve is actuated by the downward movement of the aluminum block holding the rod, applying a higher air pressure (15-20 psi) to the down side of the piston. This drives the rod 280 down until the block 282 bottoms out against the side flange 26, 28 of the track member 22 of the angle illustrated. A similar action takes place on all four hole finder assemblies 276, 278. The hardened rods 280 extend through the larger holes 272 with the side flanges 26, 28 acting as stops against which either the web 24 or the stiffened lip edge 32, 34 of the stud element 30 is placed into position for fastening. The web side 24 of the stud element 30 is typically termed the "hard side" while the stiffened lip edge side is typically termed the "soft side".

The adjustable clutch screw gun 286, which preferably utilizes collated strip screw feed as described above, is positioned so that the screws it drives will be directed through the smaller holes 274 in the side flanges 26, 28. It is very important that the ends of the stud element 30 and the inside flange surface 24 of the stud elements 30 are in firm contact with the track 22 before the stud flanges 26, 28 are fastened to the track flanges. A pneumatic cylinder 288 serves to move the movable rail 245 toward the fixed rail 243.

Sensing switches are actuated as the block 282 holding the rod 280 reaches its bottom position. When all four switches are in a closed position, the pneumatic cylinder 288 is actuated to compress the track members 22 against the ends of the stud elements 30, firmly holding the members for fastening. Another sensing switch closes when the cylinder 288 reaches a pre-determined level indicating that the compression of the rail 245 is complete. At this time, air cylinders attached to each of the four screw guns 286 are actuated, thereby driving screws down through the smaller holes 274 in the track member flanges 26, 28 and on through the flanges 26, 28 of the stud element 30. While any type of screw or other fastener may be utilized, the preferred is a self-drilling "tek" screw.

The pre-punched holes 274 for the screws create several advantages. First, they eliminate the time required to drill through the track-flange which, while small, does add up when one considers the number of screws required in the course of a production day. Second, the hole 274 presents the screw with a pocket to guide it as it starts to drill. Also, a screw will take an amount of time to get started drilling through the metal. Without the pre-punched hole 274, as a screw penetrates the first flange and starts through the second flange, this time lag can allow the threads of the screw to engage the metal of the first (track) flange. This jacks or forces it upwardly and separates the two flanges. The looser the fit between the two flanges, the more likely that this will happen. This is called screw jacking, and the pre-punched hole 274 prevents this.

Moreover, during typical hand assembly with a screw gun, it is difficult for the individuals assembling the framework to consistently keep the webs of the tracks firmly and uniformly against the ends of the stud in a tight relationship while operating the screw gun. The importance of this tight fit is to allow the vertical loads on the framework to be transferred directly from the tracks to the studs without putting shear strains on the screw joints fastening their flanges to each other. Such strains will tend to loosen the joint by elongating or, in the worst cases, stripping the threads in the joint. In the case of the screw jacking mentioned above, the tip of the screw can tend to walk on the flange of the side as it is getting started, resulting in a relocation of the stud to a somewhat off center location than originally intended. The frame assembler device 240 of the present invention obviates all of these problems.

Figure 42:
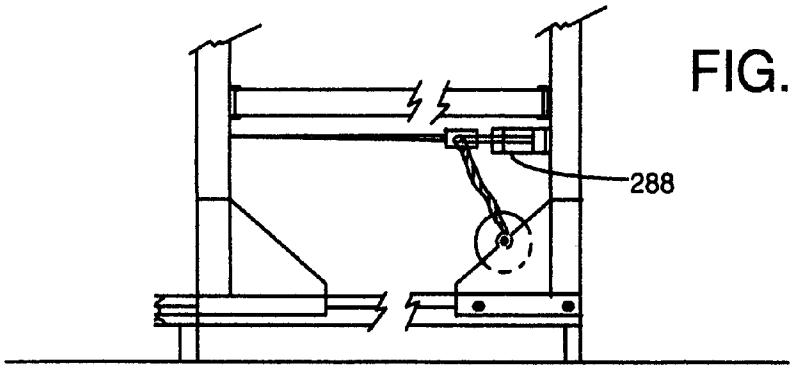
FIG. 42 is an end view of the embodiment illustrated in FIG. 38.
Figure 42A:
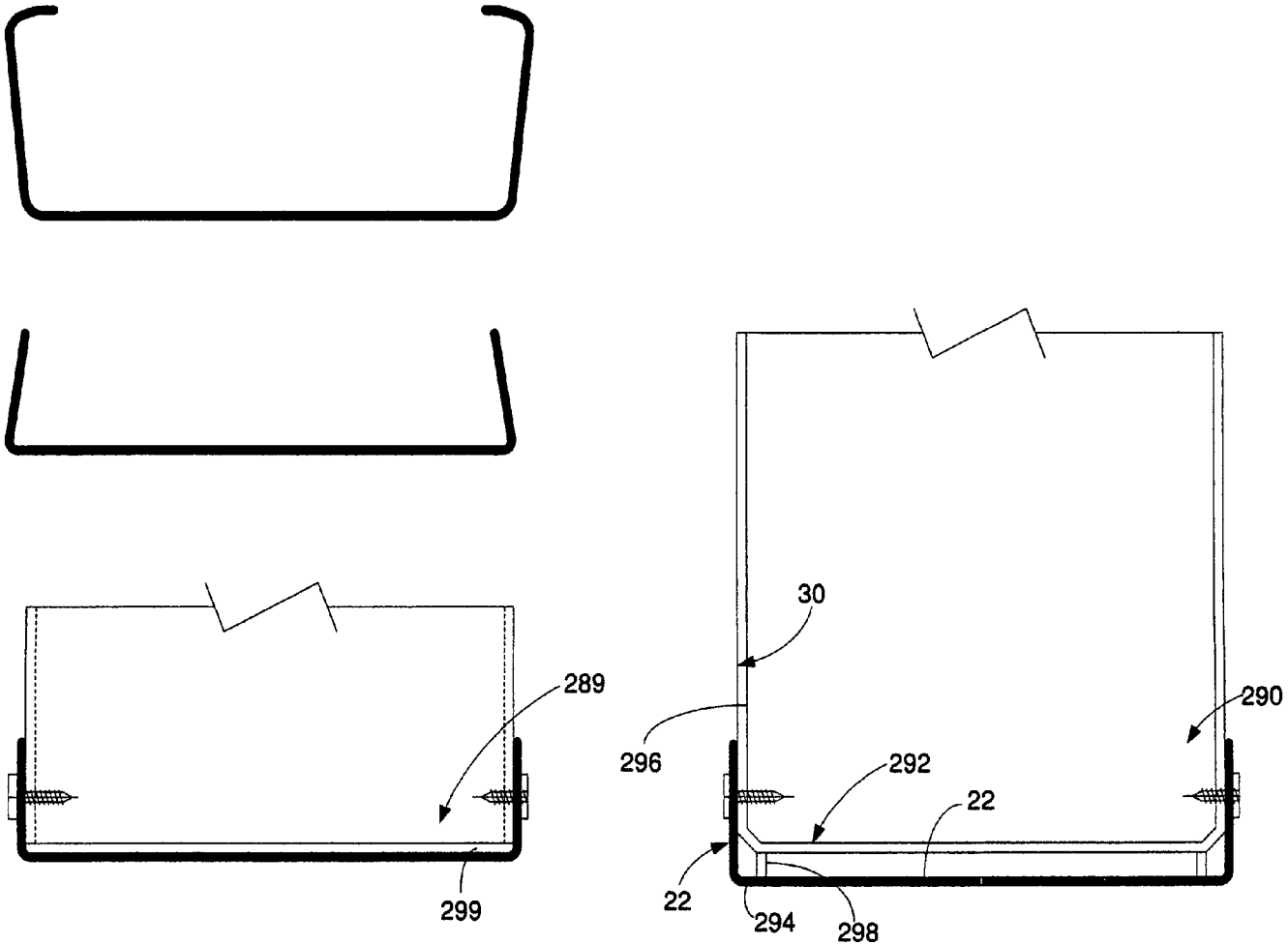
FIG. 42A is a side schematic of a standard stud element joint along with a modified stud element joint.

To assist in the tightest fit possible between the end portion of a stud element 30 and the web surface of a track member 22, the end portions of the stud elements may be modified by deformation. Referring to FIG. 42A, a typical joint 289 between an end portion of a stud element and its associated track member is illustrated along with a modified joint 290. In this modified embodiment, the end portion 292 of the stud 30 is compressed on all side to form a reduced cross-sectional portion 294 as compared to the standard size cross-section 296. In this manner, the terminal edge 298 of the stud end portion 292 can readily abut the web surface 20 of the track 22 when the studs 30 are pressed against the tracks 22 by action of the movable rail 245 and the pneumatic cylinder 288. Otherwise, a gap 299 may occur at the junction as in the typical joint 289.

The deformation of the stud end portion 292 to create the reduced portion 294 may be performed as part of the final stud formation process in the device 12, or it may be performed on an as needed basis at the site of assembly into wall units 36. This election is most preferred since a non-load bearing wall section will function quite well with a typical joint 289. However, a load bearing wall application will preferably benefit substantially from a modified joint 290 arrangement.

In its simplest form, the assembler device 240 depends on the operators to move the framing through the machine as it is assembled. The ends of the tracks are positioned against movable and adjustable position stops and an override switch is actuated which causes the four rods 280 to be pushed into the larger holes 272. The operator then places the stud element into position between the flanges of the tracks and against the rods 280 which function as the stop pins for aligning the studs within the tracks. The operator then activates the screw guns, and when this has been completed, the rods 280 are automatically withdrawn, freeing the operator to push the tracks forward through the device 240. A fiber optic beam then senses the passage of the screw heads as the tracks are moved forward through the device 240 and then lowers the rods 280 onto the track flanges in their low-pressure mode. The process in then repeated until the wall section 36 is complete.

An alternative mode of the above includes a powered track pusher. This arrangement automatically moves the tracks through the device 240 in lieu of hand operation described above. The time saved allows the operators to pick up and position the next stud element. Once the frame section 36 is complete, it exits the device 240 onto a conveyor table or the like for arranging the walls sections or temporarily storing the same.

An alternate embodiment of the assembler device 240' is illustrated in FIGS. 43-47. In this particular embodiment, a number of features have been modified as compared to the prior assembler embodiment in order to automate more aspects of the device, such as the tracks 22 being moved forwardly through the device 240' by a track pusher device rather then manually by the operator. It should be understood that like components are referenced by like numbers.

Figure 43:
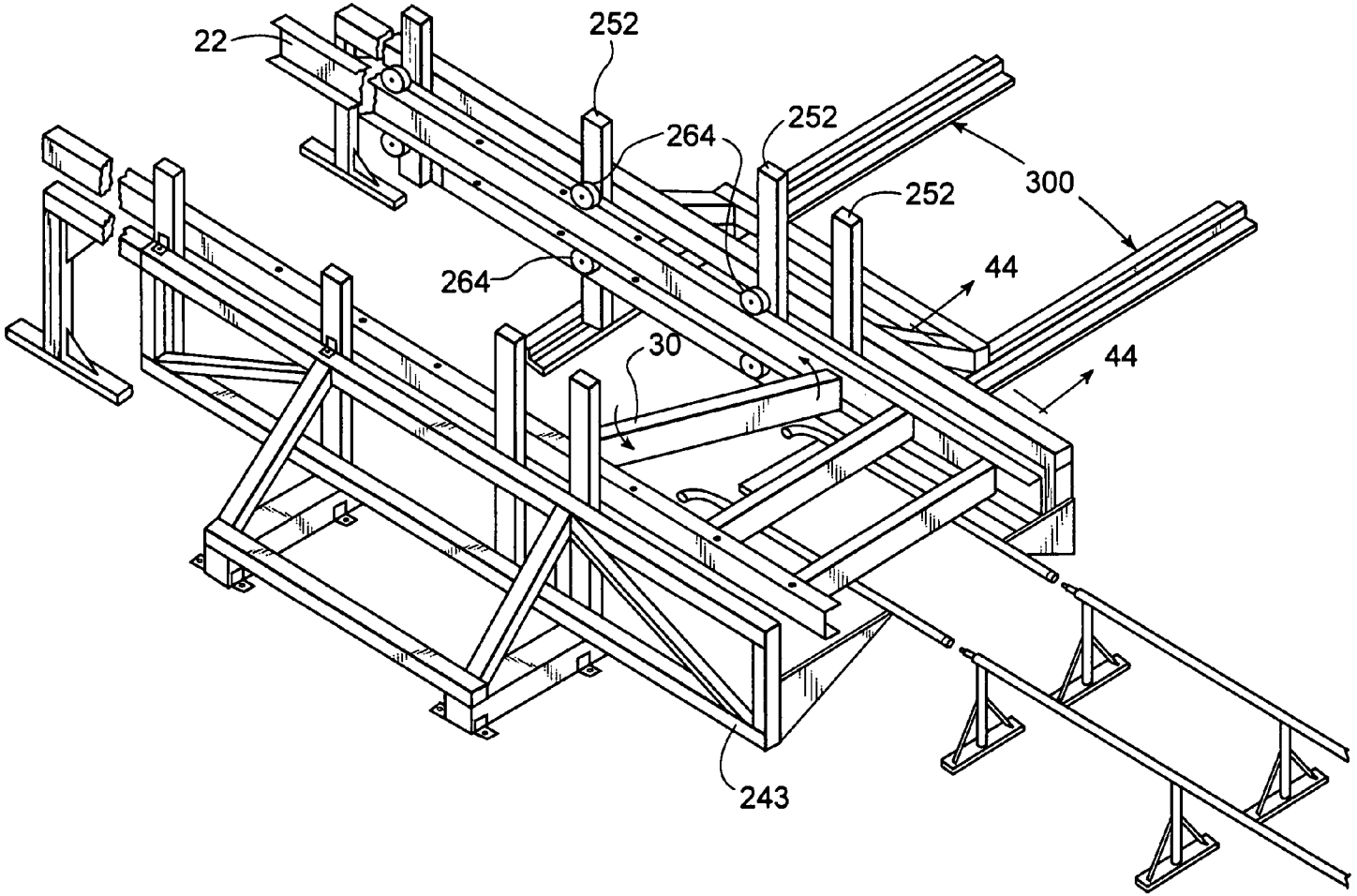
FIG. 43 is a front perspective view of a second embodiment for a wall frame assembly constructed in accordance with the present invention.
Figure 44:
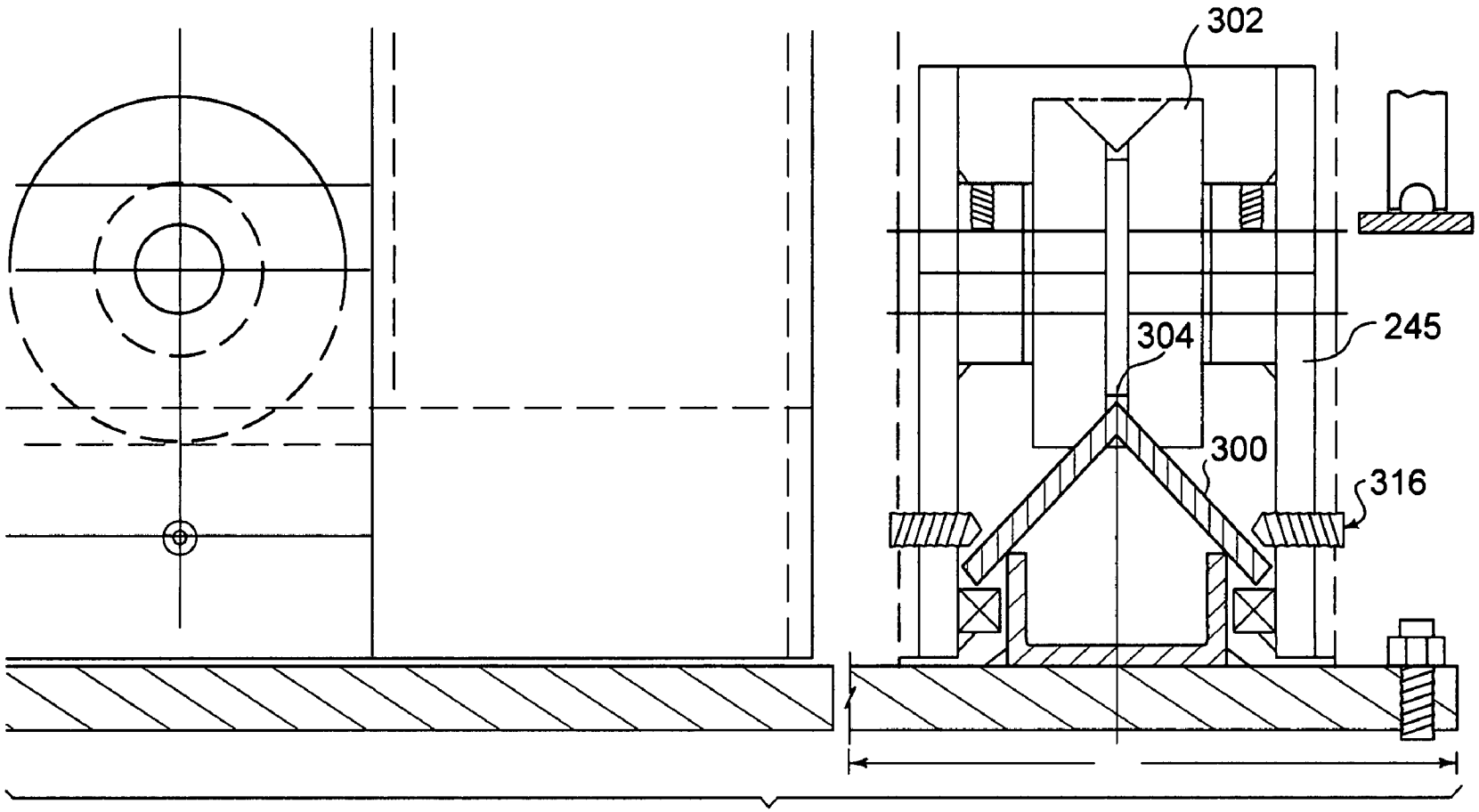
FIG. 44 is a cross-sectional view taken substantially along line 44-44 of FIG. 43 and illustrating the movable rail assembly in use with the embodiment of FIG. 43.

FIGS. 43 and 44 illustrate the device 240' having the basic support frame 242 with a stationary support rail 243 and a movable second support rail 245. The movable rail 245 is mounted for selective movement along a pair of base rails 300 in a spaced parallel relationship to the stationery rail number 243. The framework of the device 240' is formed primarily of steel tubing members with each side being basically a welded truss member to which other machine components can be attached. In preferred form, the movable rail 245 includes grooved wheels 302 which move along the angled apex portion 304 of the rails 300. As in the previous embodiment, upright support rails 252 along, with the spaced wheels 264 are provided to guide to track members 22 as they move along the apparatus 240'.

Figure 46:
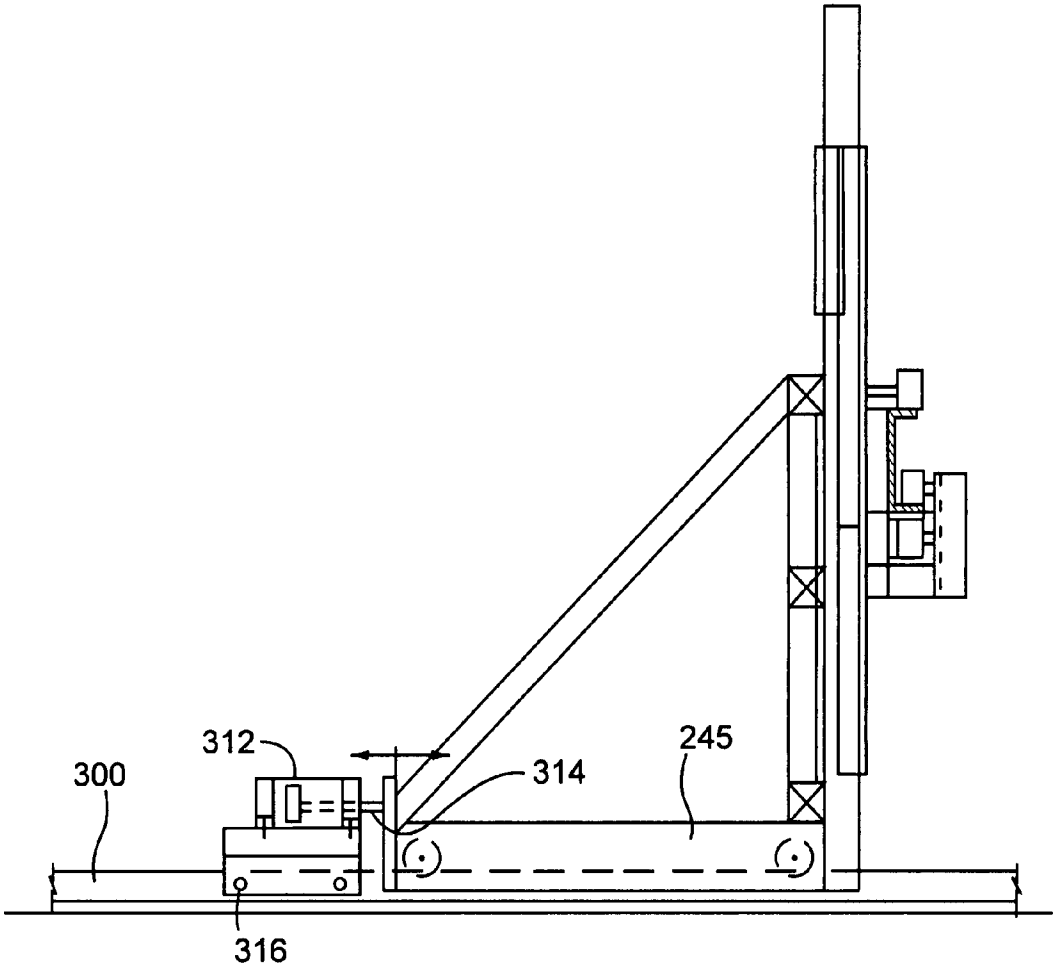
FIG. 46 is a sectional side view of the track moving structure for the embodiment of FIG. 43.
Figure 45:
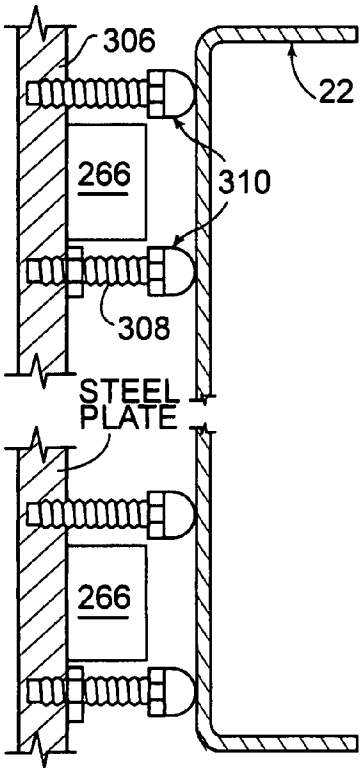
FIG. 45 is an enlarged sectional view of a magnetic track holder device for use in the embodiment of FIG. 43.
Figure 47:
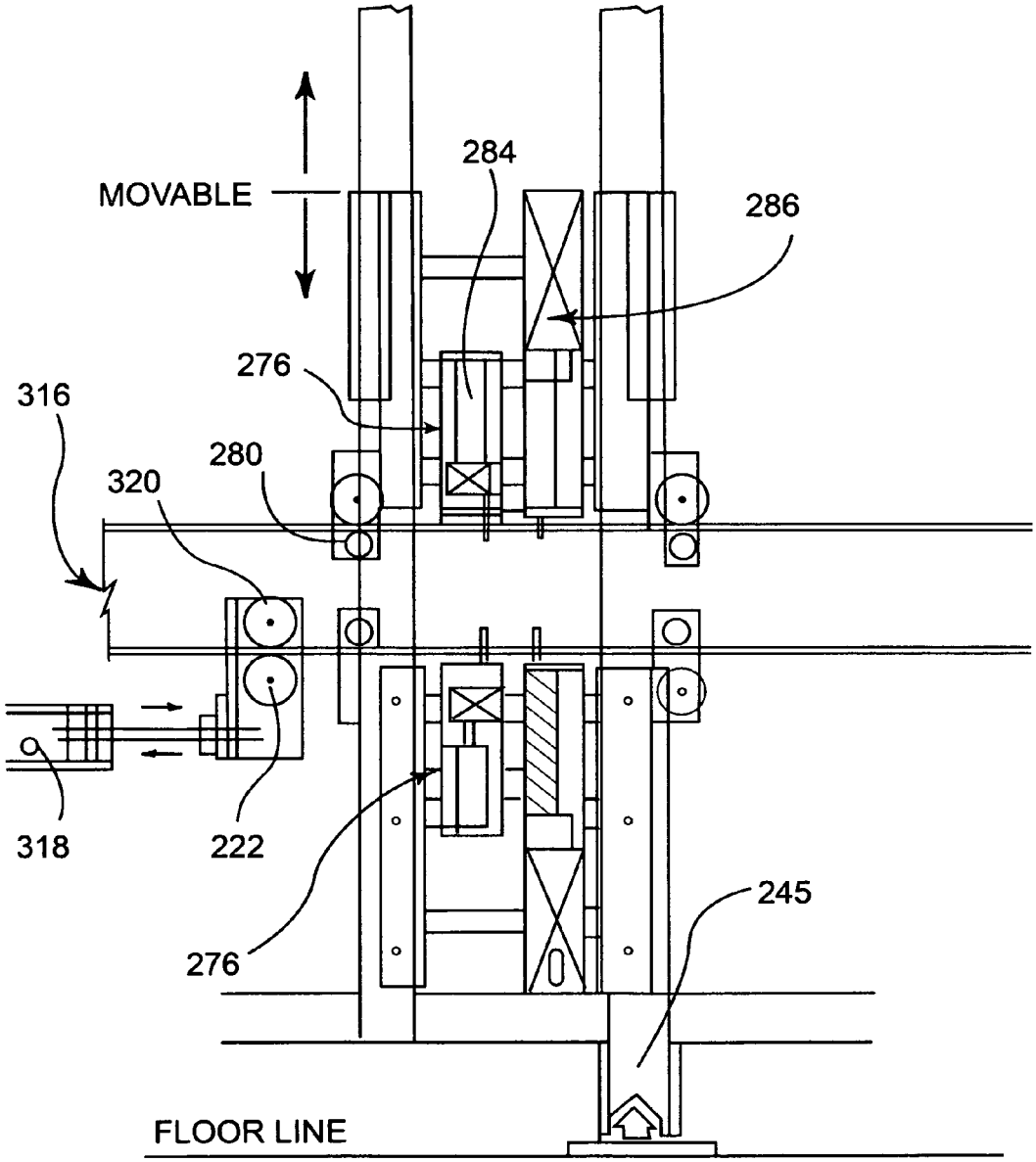
FIG. 47 is a partial side view of the screw attachment embodiment for use with the embodiment of FIG. 43.
Figure 48:
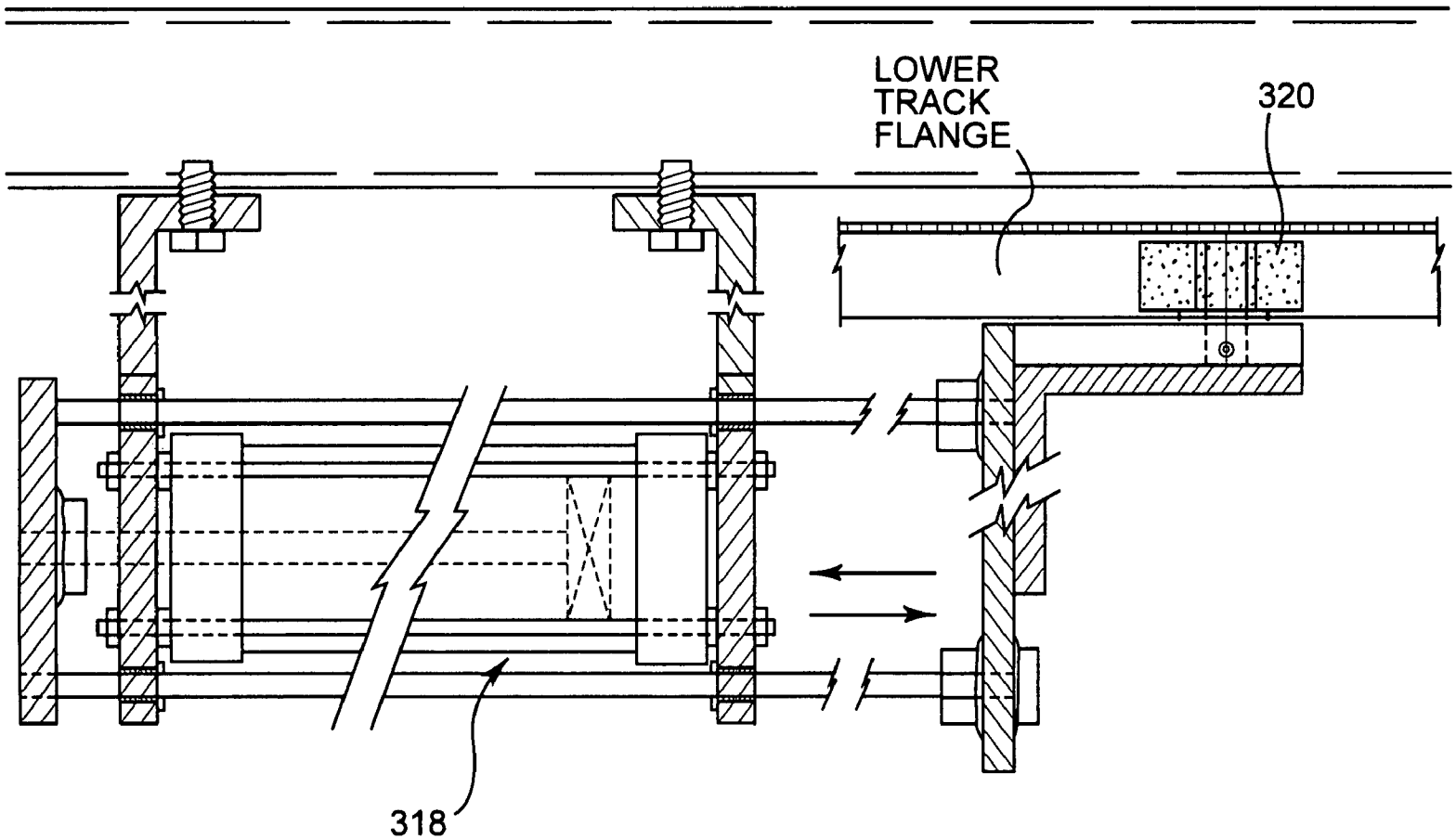
FIG. 48 is an enlarged top plan view of a track pusher assembly for use with the embodiment of FIG. 43.
Figure 49:
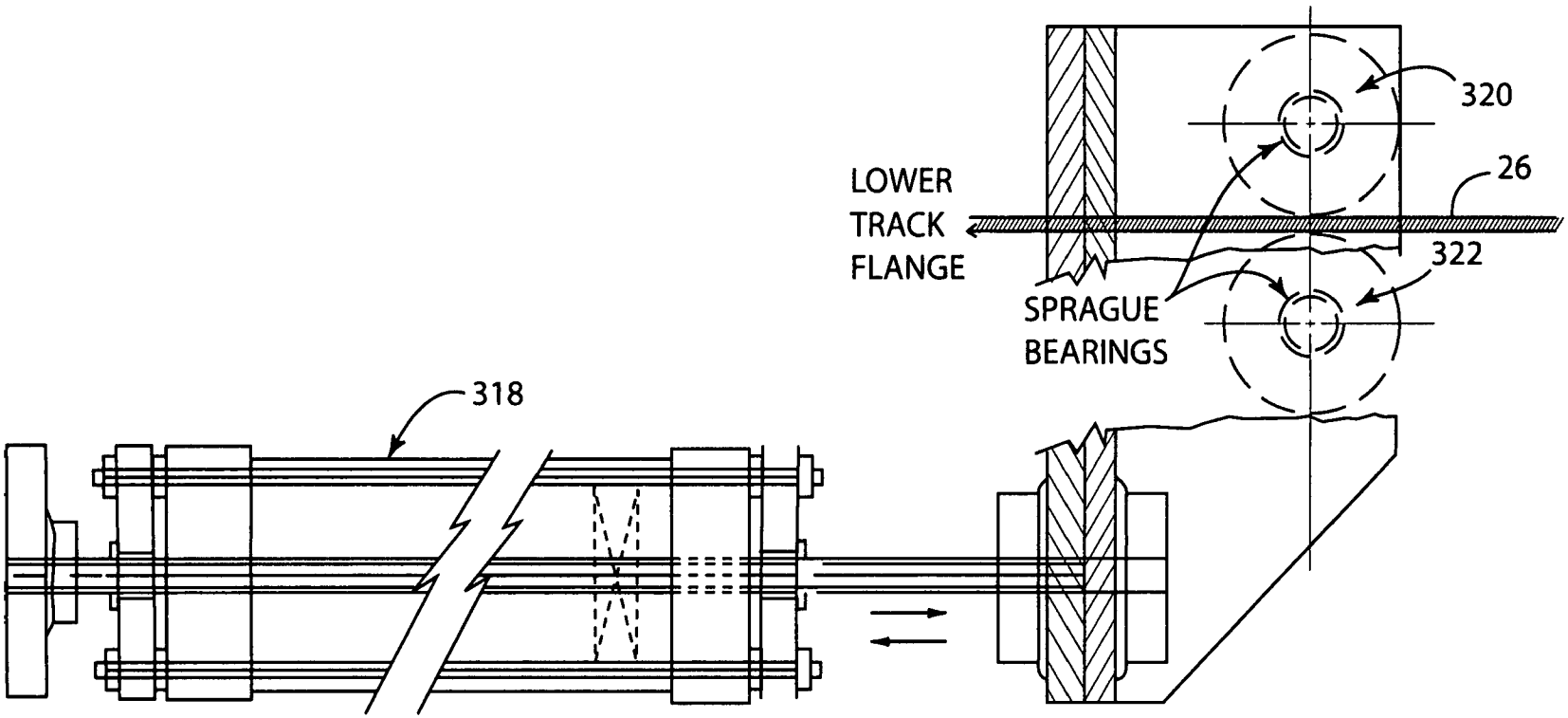
FIG. 49 is a side view of the track pusher assembly of FIG. 48.
Figure 50:
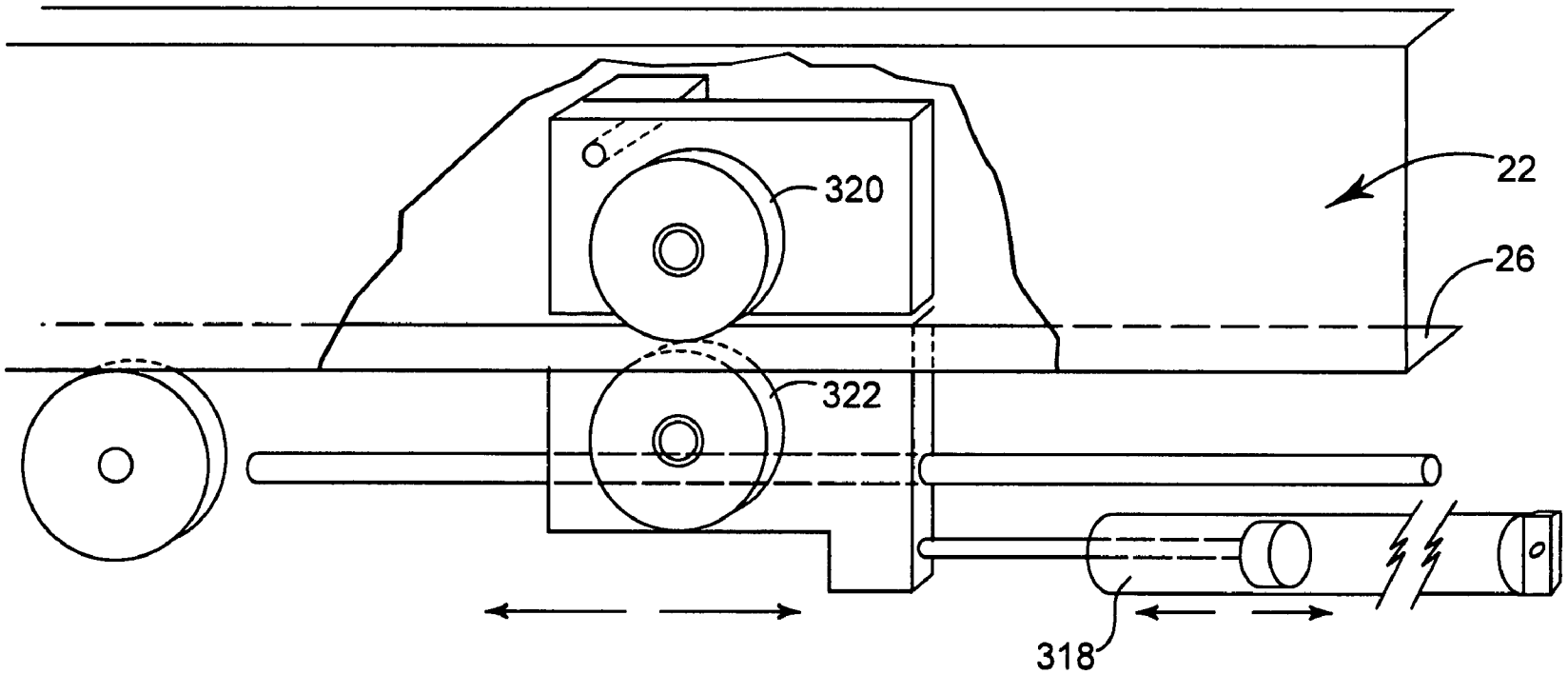
FIG. 50 is a perspective view of a track pusher assembly of FIG. 48.
Figure 50A:
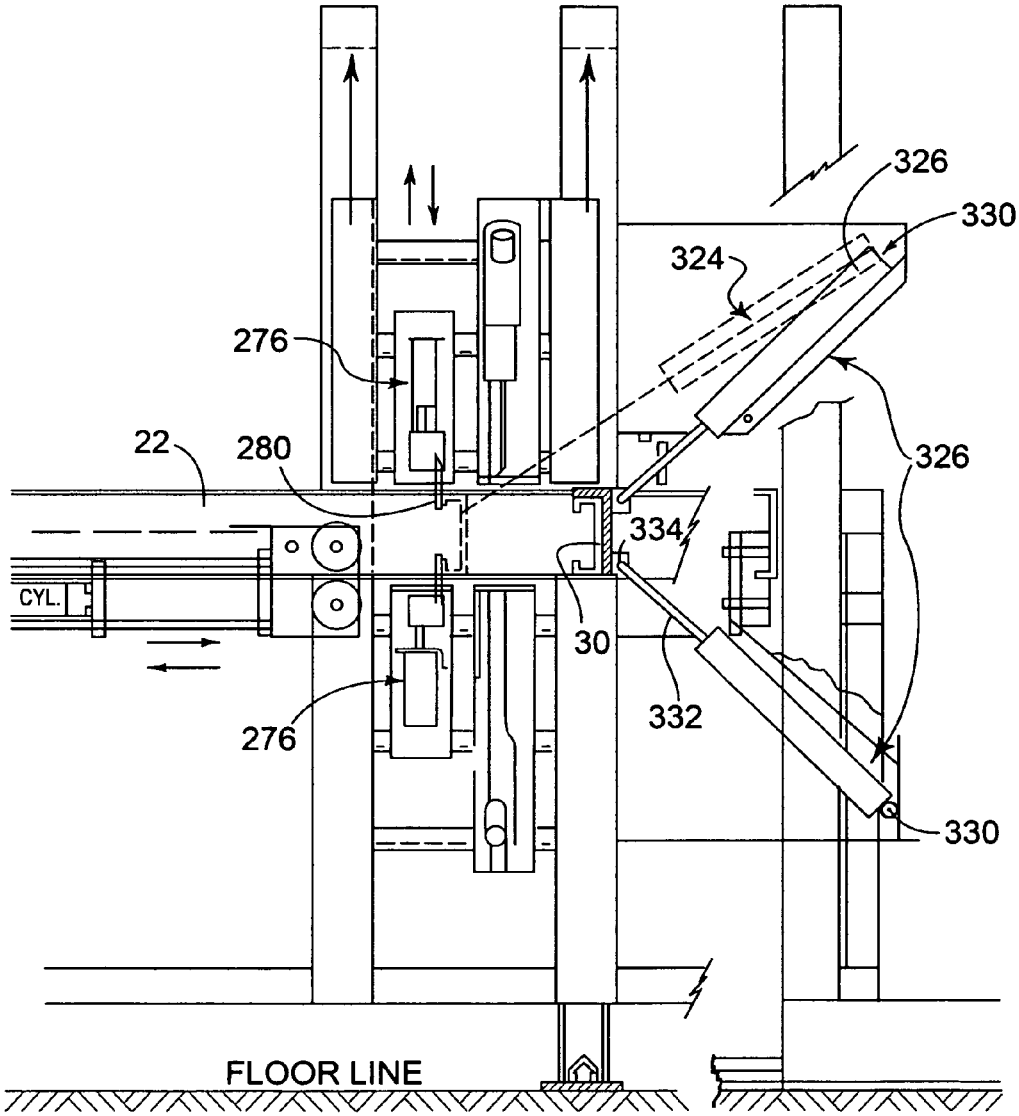
FIG. 50A is a side view of the end portion of the assembly of FIG. 48.

Referring now more particularly to FIGS. 45-47, various details of the device 240' are illustrated. The track members 22 are magnetically held in position as they move through the device 240' by providing high strength magnets 266 positioned on a vertical steel plate 306. The magnets 266 hold to the plate by their own magnetism. The web of the track 22 is attracted to the magnets 266 but are prevented from contacting their surface by a plurality of set screws 308 protruding from the steel plate 306. In preferred form, the set screws 308 protrude from the steel plate 306 and include hardened stainless steel acorn-type nuts 310 on their outer ends. While only two magnets 266 are illustrated in FIG. 45, it should be understood that additional magnets with additional set screws may be utilized as desired to increase the magnetic pull as needed for larger and heavier track members 22. The magnetic pull can be increased or decreased by adjusting the space between the face of the magnet 266 by either adjusting the extension of the setscrew nuts 308 outwardly from the steel plate 306, or by using one or more steel shims (not illustrated) between the magnet and the steel plate. The magnets 266 will always be more attracted to the steel plate 306 than to the steel web of the track 22 as long as the plate 306 is thicker than the track web. This combination of the magnets and the setscrew nuts hold the web of the track 22 in an exact vertical position while allowing the track 22 to be moved laterally on the rounded heads of the acorn nuts 310 with relatively little thrust or pressure. If the face of the magnets number 266 were to be in direct contact with the web at the track 22, as in the prior embodiment, it would require many times the thrust and would wear away the face of the magnets over time.

FIG. 46 illustrates a side of the movable frame 245 and the base rail 300. When the fixed and movable frames 243, 245, respectively, are positioned to accommodate various frame heights and stud lengths, they are positioned to allow slightly greater spacing between the inside of the two track webs to make the insertion of the studs 30 easier. However, before assembly screws are driven to join that track and stud members together, it is necessary to remove this extra space. An air cylinder 312 is preferably provided with a piston rod 314 attached to the base of the movable frame 245. This unit 312 may be held in a fixed position by utilizing a plurality of set screws 316 located on either side thereof and which when tightened bear against the inverted angle of the base rail 300 (see FIG. 44). When this air cylinder 312 is locked in place to the base rail 300, the cylinder 312 is pressurized. This moves the movable frame 245 toward the fixed frame 243 and pushes the track inner web surfaces tightly in contact with the ends of the stud 30, thereby holding them in position as the primary assembly screws are driven in place by the four screw guns as previously described. Once this is accomplished, the air pressure in the cylinder 312 is reversed to again establish the original frame and tracks spacing.

Referring now to FIGS. 47-50, a track pusher assembly 316 is illustrated. The purpose of the track pusher 316 is to move the tracks 22 forward to a point where the tapered end of the rod 280 in the hole finder 276 locates and starts to enter the larger hole 272 which has been punched in the flange of the track 22. In one preferred form, the track pusher 316 comprises a double action air cylinder 318 which pushes a set of spring loaded pinch rollers 320, 322 which sandwich the lower flange of a track 22 thereby pinching the flange between them. The rollers 320, 322 are preferably equipped with Sprague-type needle bearings. This type of bearing turns freely in one direction, but immediately locks up in the opposite direction, thereby allowing rotation thereof in only one direction. In this manner, as the air cylinder 318 moves the pinch rollers 320, 322 in one horizontal direction, they freely roll on the flange of the track 22. However, when the cylinder 318 reverse in the opposite direction, the rollers 320, 322 lockup and push the track 22 forward.

The hole finder 276 preferably includes a hardened steel pin 280 with a tapered lower end extending from a metal block which block is connected to an air cylinder 284. As previously discussed, the tapered end of the pin 280 rests lightly on the outer surface of a track flange 24, 26 under a pressure from the air cylinder 284 of approximately 8-10 psi. As the track 22 moves along beneath the end of the pin 280 and encounters the larger punched 0.25 in. hole 272, the end of the rod 280 will start to descend into the hole 272. At this time, two things occur substantially simultaneously. The downward motion of the rod 280 triggers an air valve which increases the air pressure from the cylinder 284 to approximately 3540 psi. This drives the rod 280 firmly through the punched hole 272 where it becomes a stop pin against which a stud 30 can be placed or indexed. The downward movement of the rod 280 also actuates a normally closed micro switch which in turn cuts all the air pressure to the track pusher cylinder 318 to stop the motion of the track pusher 316.

A stud 30 is next rotated into position (see FIGS. 38 and 43) against the stock pins by the stud position cylinders described in greater detail below. As previously discussed, there is extra space left between the tracks to facilitate easier insertion of the stud into the tracks. The air cylinders 312 are actuated to clamp the stud 30 tightly between the track members 22. The four screw guns 286, previously discussed, are actuated to secure the stud to the tracks. This completes one stud/track fastening cycle. The cylinders 284 which control the rods 280 in the hole finders 276, move the rods to their upward position, and air pressure is reversed to the cylinders 312 which pushes the frames apart, thereby restoring the original spacing between the tracks 22. Air pressure is also returned to the track pusher cylinders 318, and the entire assembly cycle is repeated.

Figure 51:
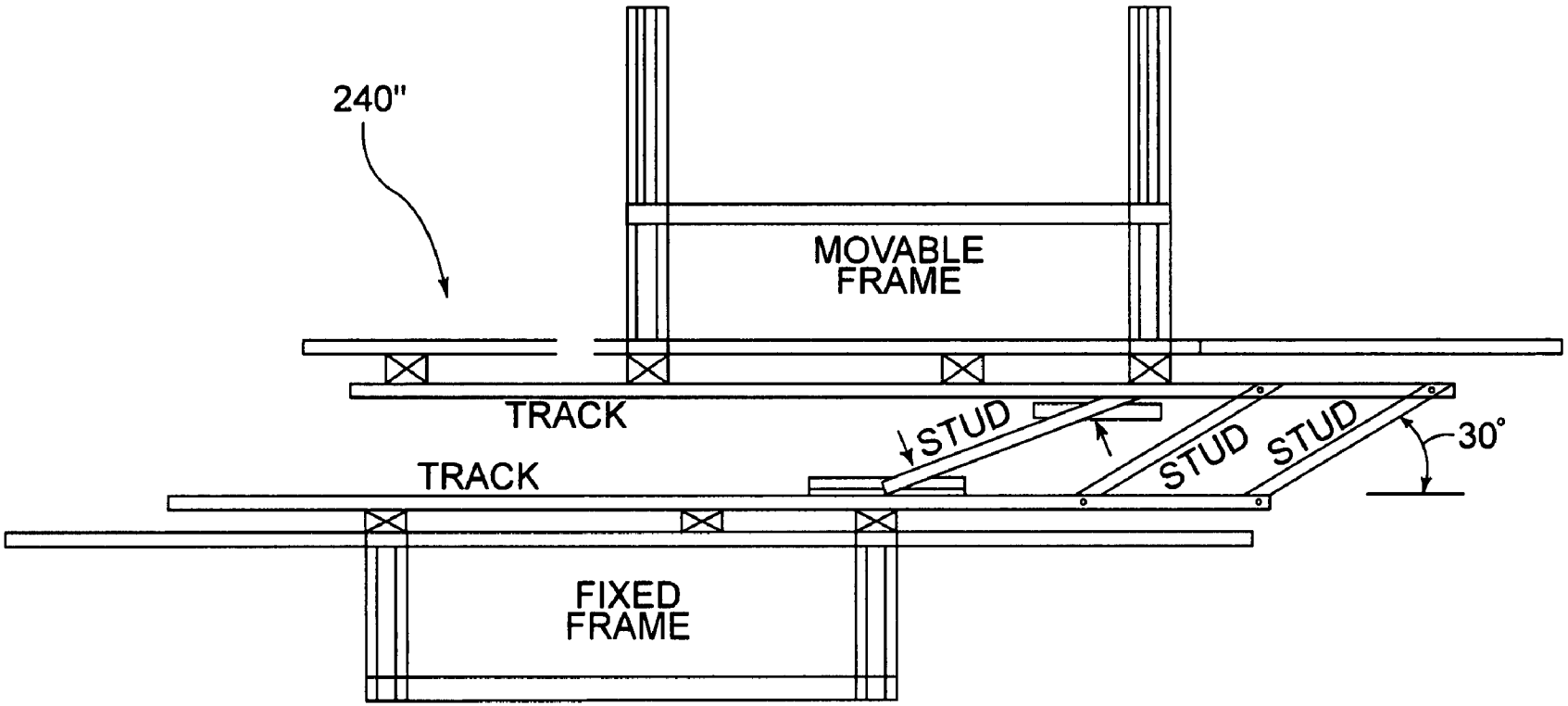
FIG. 51 is a top plan view of yet another alternate embodiment of a wall frame assembly constructed in accordance with the present invention.
Figure 52:
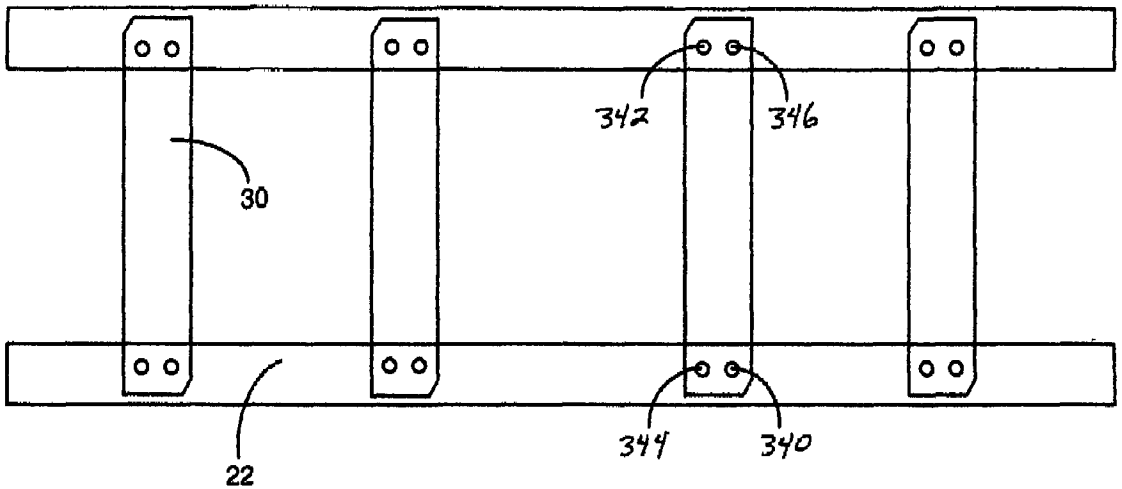
FIG. 52 is a side elevation view of a collapsible wall section constructed in accordance with the present invention and in full upright position.
Figure 53:
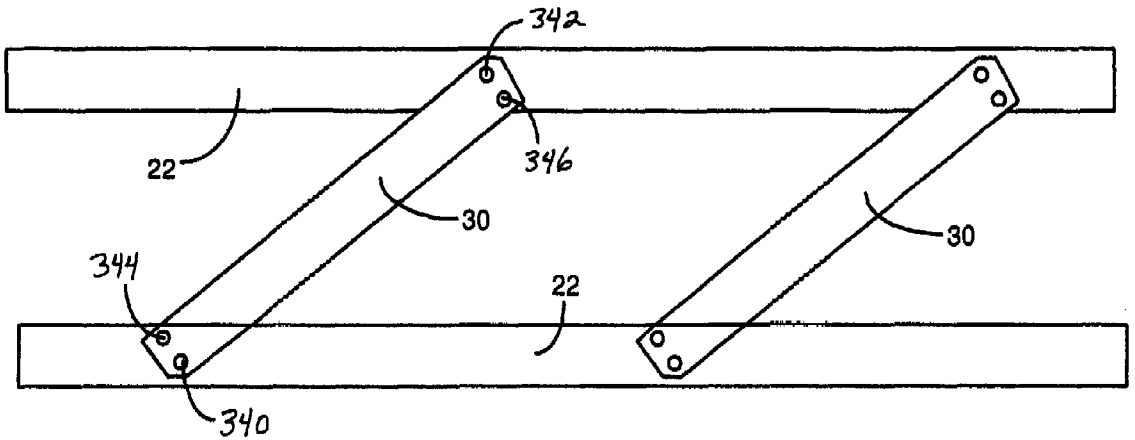
FIG. 53 is a view similar to that of FIG. 52 but illustrating the wall section in a full collapsed state.

While the studs 30 may be positioned by hand between the tracks 22 for attachment thereto, as previously illustrated, an alternate embodiment includes the use of a stud positioner assembly 324 as illustrated in FIG. 51. In preferred form, there are two sets of stud position cylinders 326, 328, which are utilized with the assembly 324, two being located to push one end of the stud into place. The stud positioned cylinders 326, 328 are preferably slanted or angled downwardly and upwardly, respectively. In this manner when they are extended, they will push this stud 30 into position against the rods 280. There is a second set of stud positioners 326, 328 which are on the other track and face in the opposite direction (not illustrated). This second set pushes the other end of the stud 30 into position in similar fashion. In preferred form, each stud positioner cylinder has its base end attached at a pivot point 330 and includes a piston rod 332 terminating in a pusher pad element 334. The pad elements are designed to engage the end of the stud 30 as illustrated in FIG. 51. The stud positioner cylinders 326, 328 extend their piston rods 332 to where the pads 334 engage the stud 30 and hold it against the stop rods 280 until the screws are driven in place. The cylinders 324, 326 then retract to a closed position which places the pusher pads 334 out of the way of the assembled frame and allows its movement to the next stud location. In preferred form, the pusher pads 334 on the terminal ends of the piston rods 332 are magnetic. This feature enables them to firmly set in position on the stud 30. Once the screws have completely fastened the stud 30 to the tracks 22, the retraction of the piston rods 332 will readily pull the pads free from the stud 30.

Turning our attention now to FIG. 51, the prior embodiment illustrates assembling the studs at 90° to the tracks. This requires considerable floor space since full stud length is required between the fixed and movable frames. If the machine 240" is configured as illustrated in FIG. 51, wherein the studs are at approximately 30° to the tracks, the distance required between machine frames is just one half the stud length. Furthermore, the need to allow extra space for easy stud insertion into the track is eliminated as the stud positioner cylinders take care of this and eliminate the need for the clamping operation previously described. The stud positioner cylinder length and stroke are also considerably reduced, while the required length of the base rails, like the distance between the fixed and movable frames, is also approximately cut in half using this embodiment.

If welded frames are desired rather than screwed frames, the screwguns of the prior embodiments may be replaced by small Mig welders. The welded frames would be limited to non-foldable frames and the 90° configuration of the assembler device 240 and 240".

Referring now to FIGS. 52-61, the completed frame units can be assembled as described above, or they can be assembled into folding frames as described below. The advantage of the folding frame arrangement is that they can be transported in a very compact manner and then easily erected on site without any particular requirement for metal framing skills. The embodiments of the automated assembler device as described above require only about one fourth of the man-hours that manual assembly of frame panels requires. This is a savings of about 75-80 percent of the typical on-site manual assembly time of wood or metal frames. When the metal frame panels are preassembled in folding frame arrangements, the frame panels typically require only approximately 20-23% of the on-truck trailer space required for the unfolded frames. Typically, a tractor-trailer can haul approximately 50,000 lbs. of the folded frames while only being able to load approximately 8-12,000 pounds of non-folded frames. In addition, trucks may very well need to obtain an over-width permit at extra cost to haul non-folded metal frames if such frames project over the trailer bed width.

At the job site, a light crane is normally required for unloading the non-folded frames, while folded frames can usually be unloaded by hand. In addition, the folded frames can be stacked in less space at the job site and can pass through openings between studs when folded. This provides substantially easier on-site handling of the frames. In addition, there is a significant shortage of steel framers, while there are plenty of wood framers in the market. It would be relatively easy to train existing at wood framers to work with steel frames when they are preassembled and folded.

Figure 58:
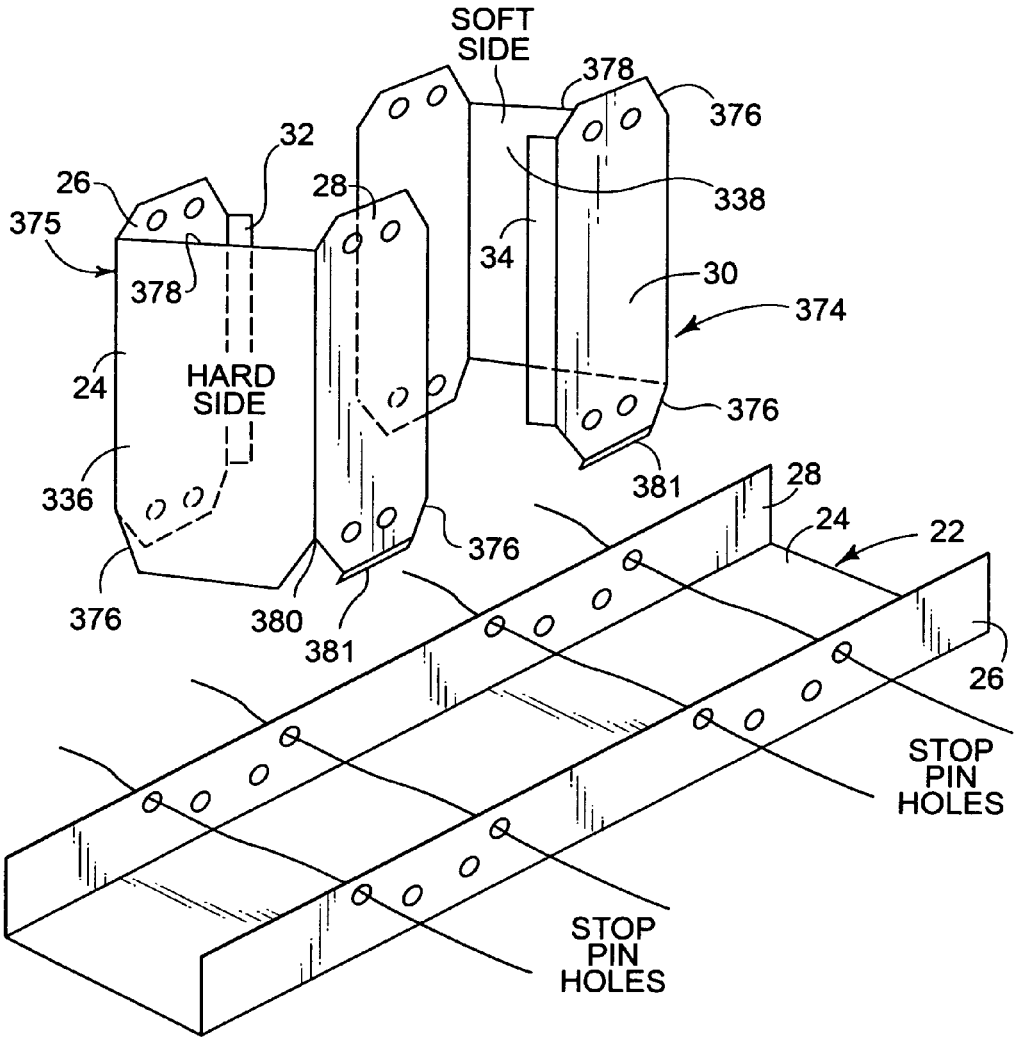
FIG. 58 is a side perspective of a foldable wall frame embodiment as constructed in accordance with the present invention.

A variety of folding frame arrangements or embodiments are illustrated below. The folding frame embodiments require that two web sides of a stud 30, that is the hard side 336 and the soft side 338 as illustrated in FIG. 58 for example, form hinges points with the upper and lower track flanges as illustrated below. In all of the embodiments illustrated below, the same general hinge concept is incorporated. In frames that form outer walls, these frames must be load bearing, while interior walls are not.

In non-load bearing wall sections, which are primarily interior wall sections, the stud ends are left cut square with the studs cut short as illustrated below. In the embodiment illustrated in FIGS. 52 and 53, the tracks 22 are attached partially to the studs 30, and this arrangement is particularly useful for non-load bearing interior wall frames. In one form, the ends of the studs 30 are attached by one screw 340 at one end and a second screw 342 at the opposite end. Preferably, the screw 340 is offset at opposite edges from the screw 342. While the remaining holes 344, 346 are preformed, there are no screws secured through these holes. In this manner, the tracks 22 can be swiveled around the screws 340, 342 and thereby fold the upper track 22 down against the lower track 22. During the assembly operation, collapsible spacers, as further described below, are used between the ends of the studs and the inner surface of the track webs. The spacers are then collapsed and removed after the primary screws 340, 342 are in place. No preparation of the stud ends is required as with load bearing walls described below.

Alternatively, the studs 30 may be attached to the tracks 22 using metal clips 348. In this embodiment, the stud elements 30 are attached to the metal clips 348 at each end thereof. The clips 348 each have two spaced apertures 350, 352, and a screw secures the aperture 350 at one end to a track member 22 and the opposite aperture 352 at the other end. In this manner, the upper track member 22 may be folded down onto the lower track member 22 as in the prior embodiment. Since such folded wall structures are much more compact than the fully assembled wall structures discussed in great detail above, they become much more transportable since they do not take up nearly the space in their folded form.

A folded frame section typically only occupies about 20-30% of the space of the unfolded frame. This compactness of the folded frame is a factor of the size of the stud leg and the stud center spacing. The folded frame section can be handled more easily in most job site situations. The smaller size allows the folded section to pass through standard door openings or between studs in already erected wall sections for instance, and a simple two wheel dolly can carry the weight and allow easy turning of the section. In situations where the foldable wall section is to be load bearing, certain modifications can be made. It should be understood that this folding concept is also applicable to wood frames as well.

Figure 55:
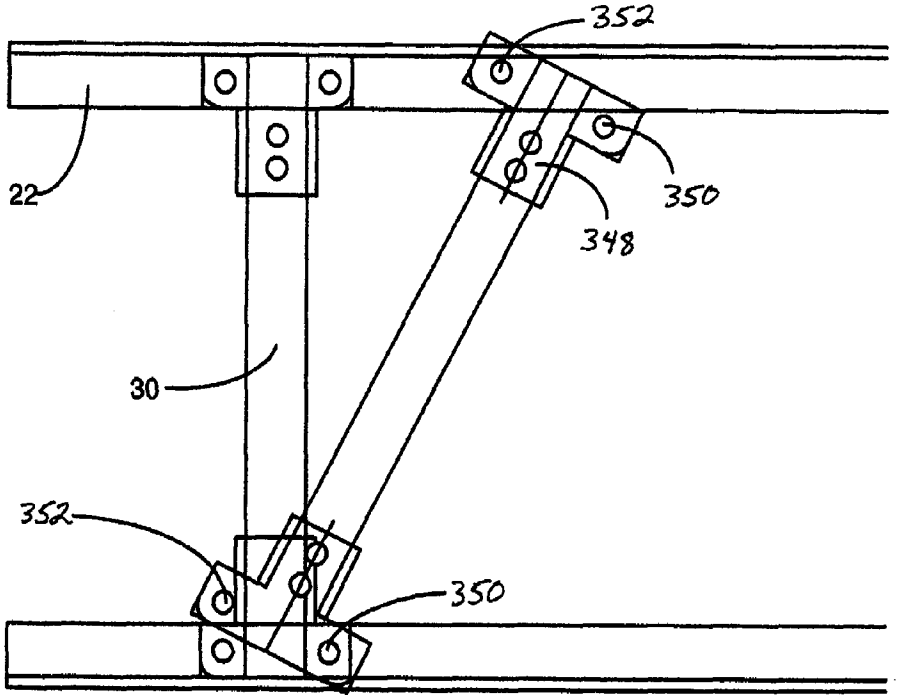
FIG. 55 is a side elevation of the device of FIG. 54.
Figure 56:
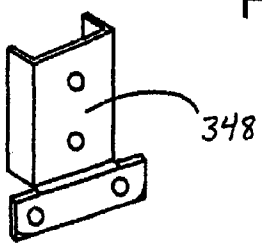
FIG. 56 is an enlarged front perspective of a clip for securing a stud element for use in the embodiment illustrated in FIG. 54.
Figure 54:
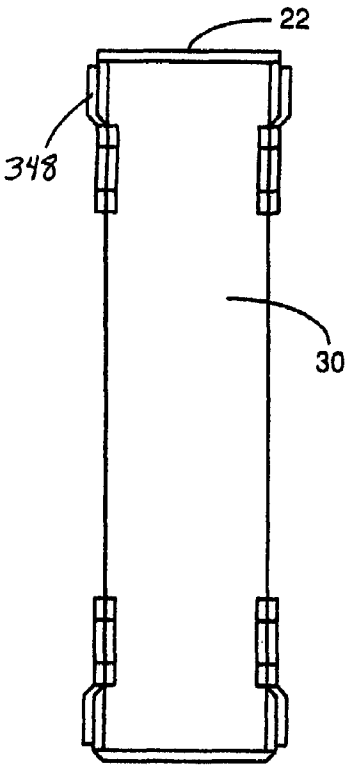
FIG. 54 is an end view of yet another embodiment of a collapsible wall section constructed in accordance with the present invention and in full upright position.
Figure 57:
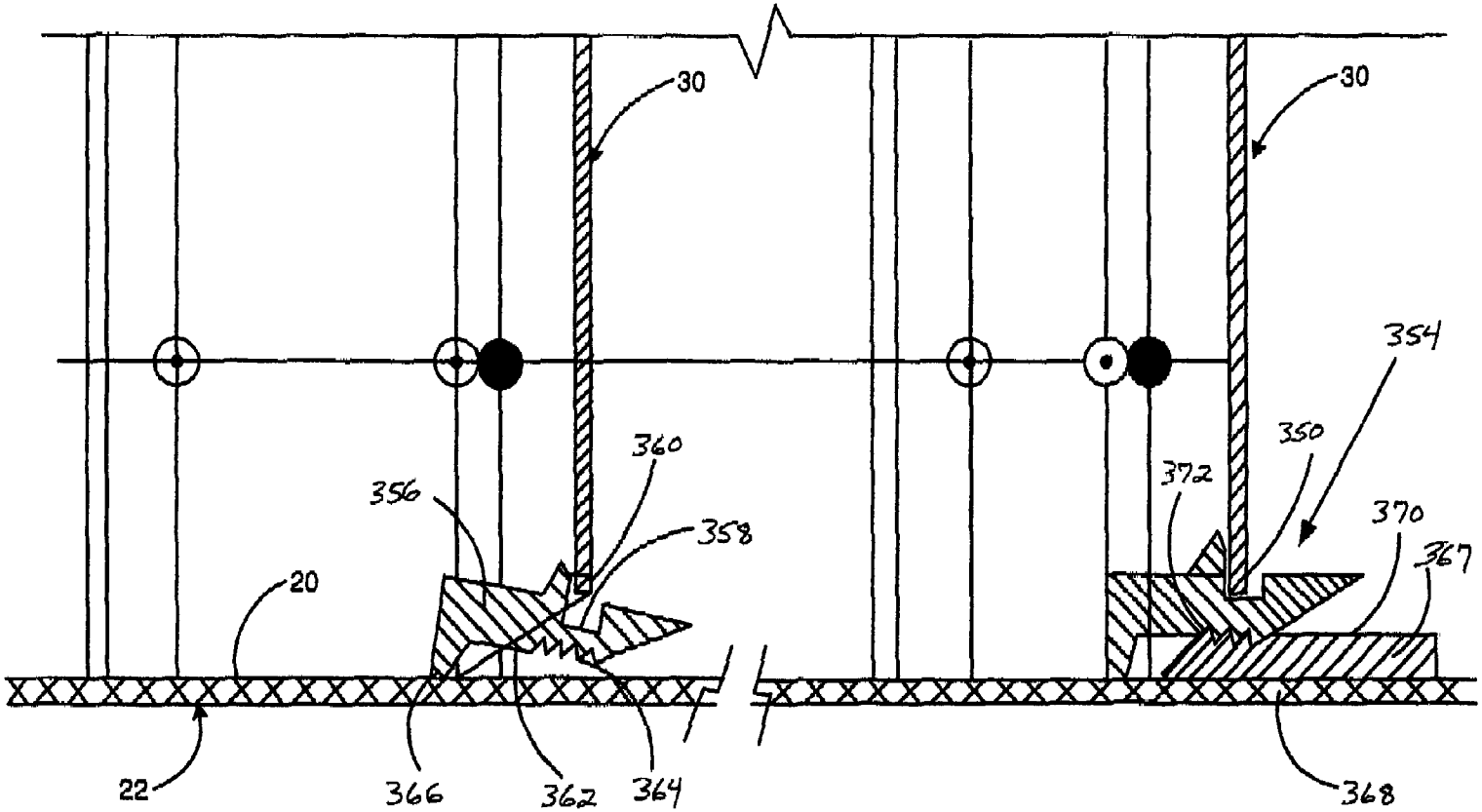
FIG. 57 is an enlarged view of another embodiment of the collapsible wall section constructed in accordance with the present invention.

Referring in particular to FIGS. 54-56, the end portions of the studs are preferably mounted to the clips 348. To secure the studs in place after unfolding the wall section, an interlocking retainer mechanism 354 may be utilized for load bearing situations. In this embodiment, a first member 356 is provided with a recessed portion 358 in its upper surface adapted to receive an end portion 360. The first member 356 preferably has a flat lower surface 362 with teeth 364 and a pivot point 366. A second member 367 is provided having a flat lower surface 368 and a flat upper surface 370 with teeth 372. To utilize the retainer mechanism 354, the end portion 360 is inserted into the recess 358 of the first member 316, and the second member 327 is then wedged beneath the first member 356 so that the teeth 364 interlock with the teeth 372. This assists the retainer mechanism 354 from slipping while providing a firm load-bearing surface to transfer loads from the track 22 through the studs 30.

Because of the radius that must always be present at the band between the web and flange of the track 22, it is not possible for the web of the stud to rest tightly against the inner face of the track web. Without accounting for this issue, downward load transfer between the track and stud would place a sheer strain on the fasteners which join the two members as described below. These fasteners are primarily intended to hold the track and studs in position laterally with each other. Therefore, in load bearing walls the extreme lower edge of the trackway is bent inwardly to transfer the downward load directly between the tracks and studs. This basically relieves the fastener of the shear load and improves the structural qualities of the panel frame.

Figure 59:
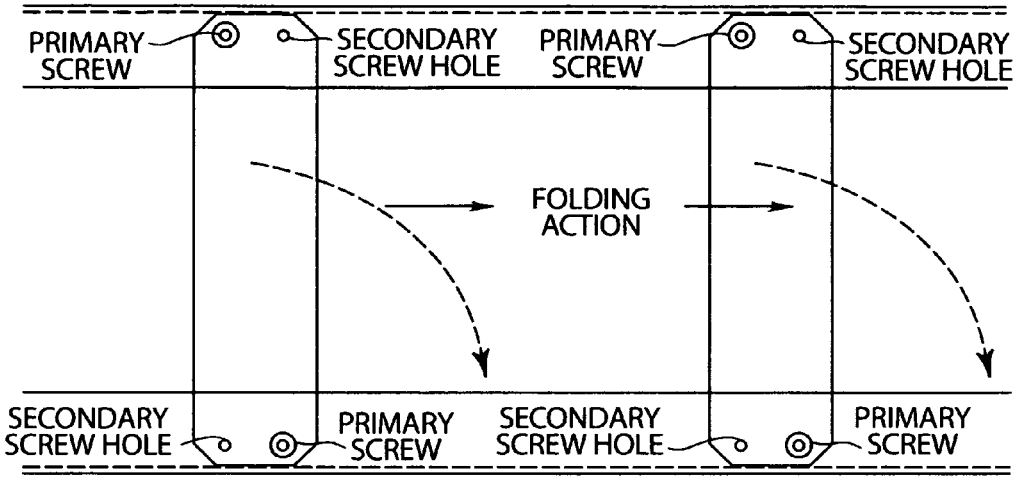
FIG. 59 is a side view of a load bearing foldable wall frame embodiment in an erected position.
Figure 60:
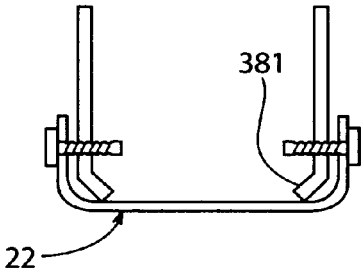
FIG. 60 is an enlarged, partial sectional view illustrating the junction of the stud and track of the embodiment illustrated in FIG. 59.

Referring now to FIGS. 58-61, load bearing wall frames are illustrated. In this embodiment, the lower end portions 374 and upper end portions 375 of the studs 30 are modified by a steel cutting saw to create the notch pattern illustrated. This allows the studs 30 to fold in relationship with the tracks 22. In this particular embodiment, angular cuts 376 are made in each corner of both the upper and lower portions 375, 374 of the flanges 26, 28, in the soft side web 338. In addition, the web 24 is cut across between the cuts 376 to form a cut edge 378. In addition, the upper end portion 375 of the stud forming the hard side 336 is also cut in a manner similar to both the upper and lower portions 375, 374 of the study carrying the soft side web 338. in the case of the lower end portion to resume for how the hard side web 336, a crosscut 378 is not performed. As a result, these angular cuts 376 in the lower portion 374 create V-shaped notches 380 and the use the bulk of the web hard side 336 intact at its lower portion 374. The purpose of this arrangement is to allow the stud webs end members 381 to firmly contact the web of the track 22 when the studs and tracks are at 90° to each other as illustrated in FIGS. 59 and 60.

Figure 60A:
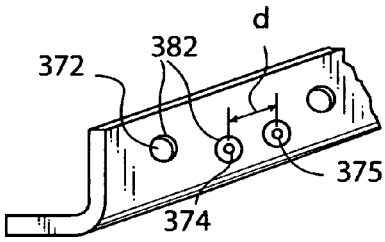
FIG. 60A is an enlarged perspective view of a track flange and a hole pattern therein.
Figure 60B:
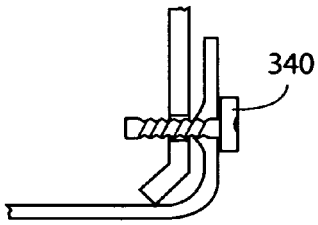
FIG. 60B is an enlarged section of the embodiment illustrated in FIG. 60 and illustrating an attachment screw therein.

It should be noted that the design of the punch unit that punches the four hole pattern as illustrated in FIG. 60A, creates dimples 382 in the metal surrounding the screw holes 372, 374. This arrangement relieves most of the friction between the interface of the legs of the stunt and track members. This enables a smoother folding action, and allows the screw head 340 to remain stationary in relationship to the track. In other words, it acts somewhat like a lock nut between the interface of the track leg and the underside of the screw head 340. In addition, the distance "d" between adjoining smaller holes 374 and 375 may be varied to accommodate different widths of stud legs in the various foldable embodiments illustrated herein. However, as previously indicated, only one of the two adjoining holes 374, 375 will be utilized to create a hinge to permit the folding of a stud relative to the tracks to which it is attached.

Figure 61:
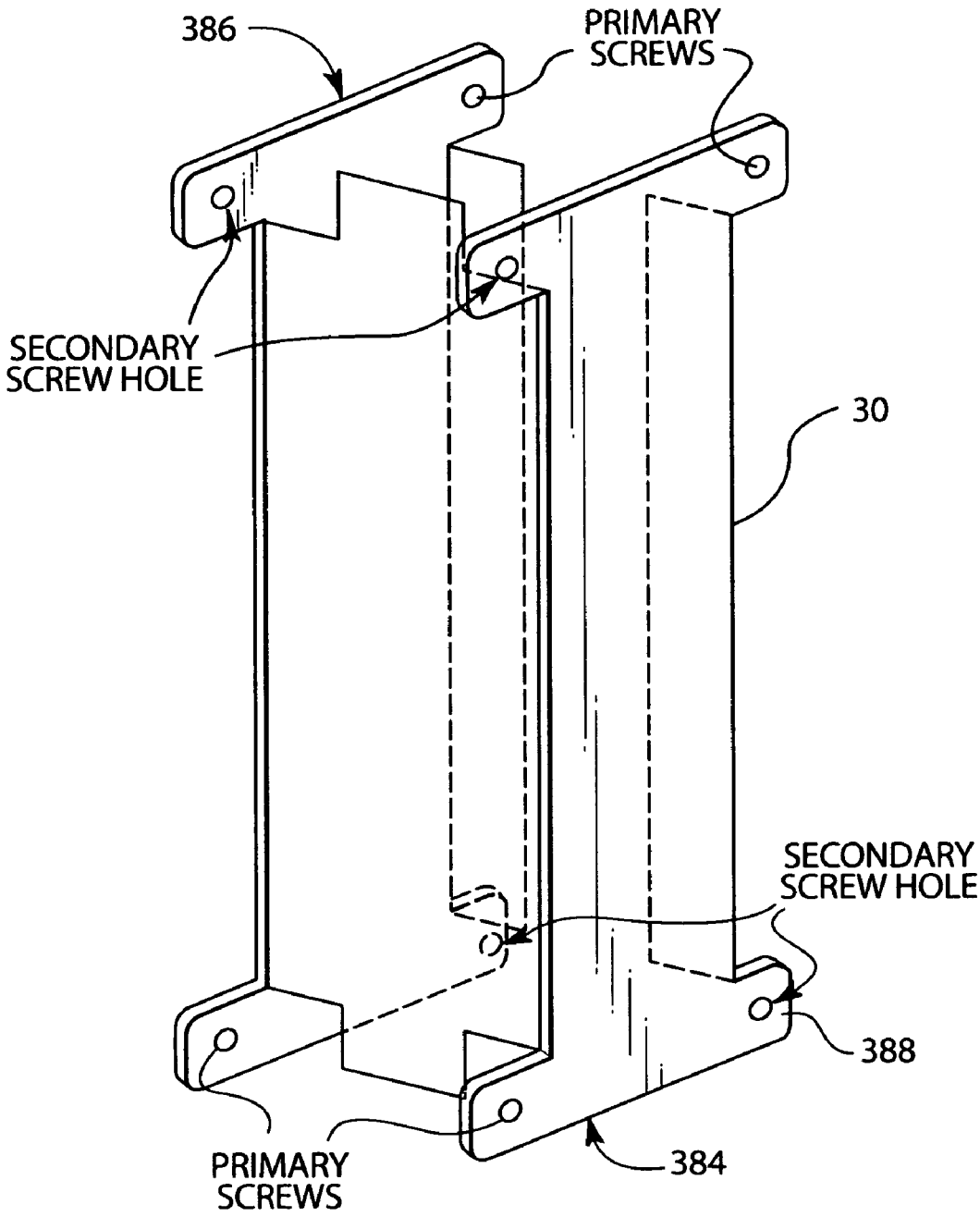
FIG. 61 is a perspective view of yet another modified embodiment of a stud member constructed in accordance with the present invention.

Referring now to FIG. 61, the ends 384, 386 of the stud 30 are modified. In this embodiment, each end 384, 386 is stamped with a blanking and forming die which pushes out a portion of the web and stiffened edges to form attachment elements 388 as illustrated. With this stud arrangement, the hard and soft sides can be positioned however desired as compared to the embodiment illustrated above. This stud then functions and performs similar to the embodiment illustrated in FIGS. 54-56 without requiring an additional component 348. In this embodiment, the attachment elements are integral with the stud itself.

Figure 62:
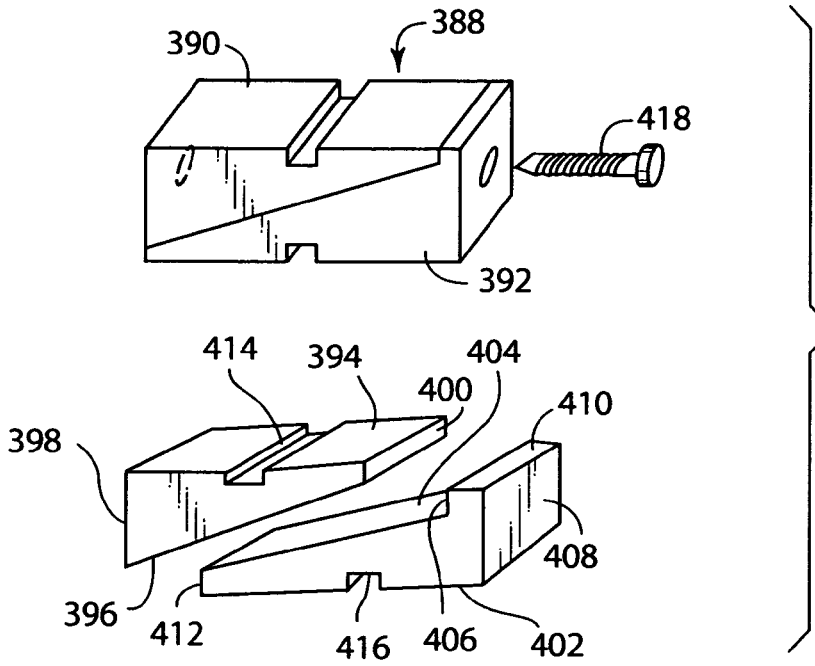
FIG. 62 is a perspective view of a collapsible spacer element for use with non-load bearing foldable wall frame members.

As previously discussed, collapsible spacers are utilized to center the studs evenly between the inside track web surfaces of the upper and lower tracks for non-load bearing wall sections. Referring to FIG. 62, each spacer 388 includes a pair of spacer wedges 390, 392, preferably made of extruded aluminum. The upper wedge 390 includes a horizontal upper surface 394, a beveled surface 396, an end surface 398 and a wedge end surface 400. The other wedge 392 includes a horizontal bottom surface 402, a beveled surface 404 which terminates in a shoulder surface 406, an upper section surface 408, an end surface 410 and a wedge end surface. Each of the horizontal surfaces 394 and 402 include a notch 414, 416, respectively. The beveled surfaces are designed to slidingly fit against each other with the wedge end surface 400 of the upper wedge 390 abutting the shoulder surface 406 of the lower wedge 392. Each end surface 398, 408 includes a hole which are coaxial with each other to receive a screw 418 for attaching them together or for collapsing them by backing off the screw 418. When the screw is backed out, the two spacer wedges 390, 392 slide downward and apart to allow removal. The edges of the stud end portions are designed to be fitted within the notches 414 or 416 to hold the studs in position and center them evenly until attached to the tracks 22.

The spacers 388 may also be used to convert non-load bearing frame members to load bearing. In this instance, the studs in the load bearing position need to be a proper gauge for supporting the load, and neither be used with the extruded aluminum spacers 388 or changed out for the load bearing stud arrangements previously described. When the spacers 388 are utilized for such conversion, the screw 418 is driven into place. The spacer 388 is placed under the stud web, and the screw 418 is tightened to expand the spacer 388 to support load transfer from the stud web to the track web. Since only a portion of a wall frame may need to be load bearing, the spacers 388 may be utilized only in the necessary and appropriate positions within the frame.

Figure 63:
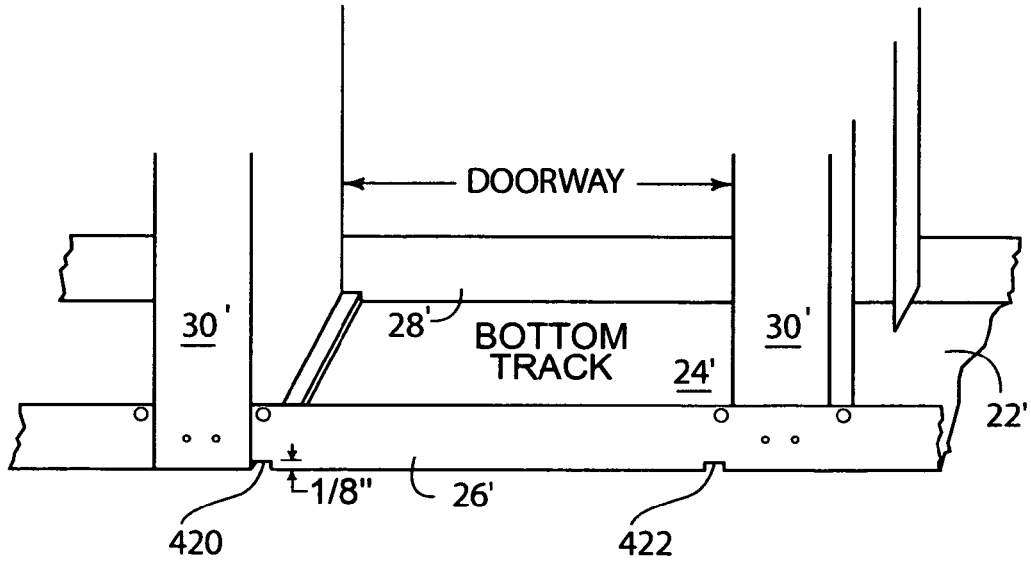
FIG. 63 is a side perspective view of a foldable track and stud frame arrangement modified for use as a door frame.
Figure 64:
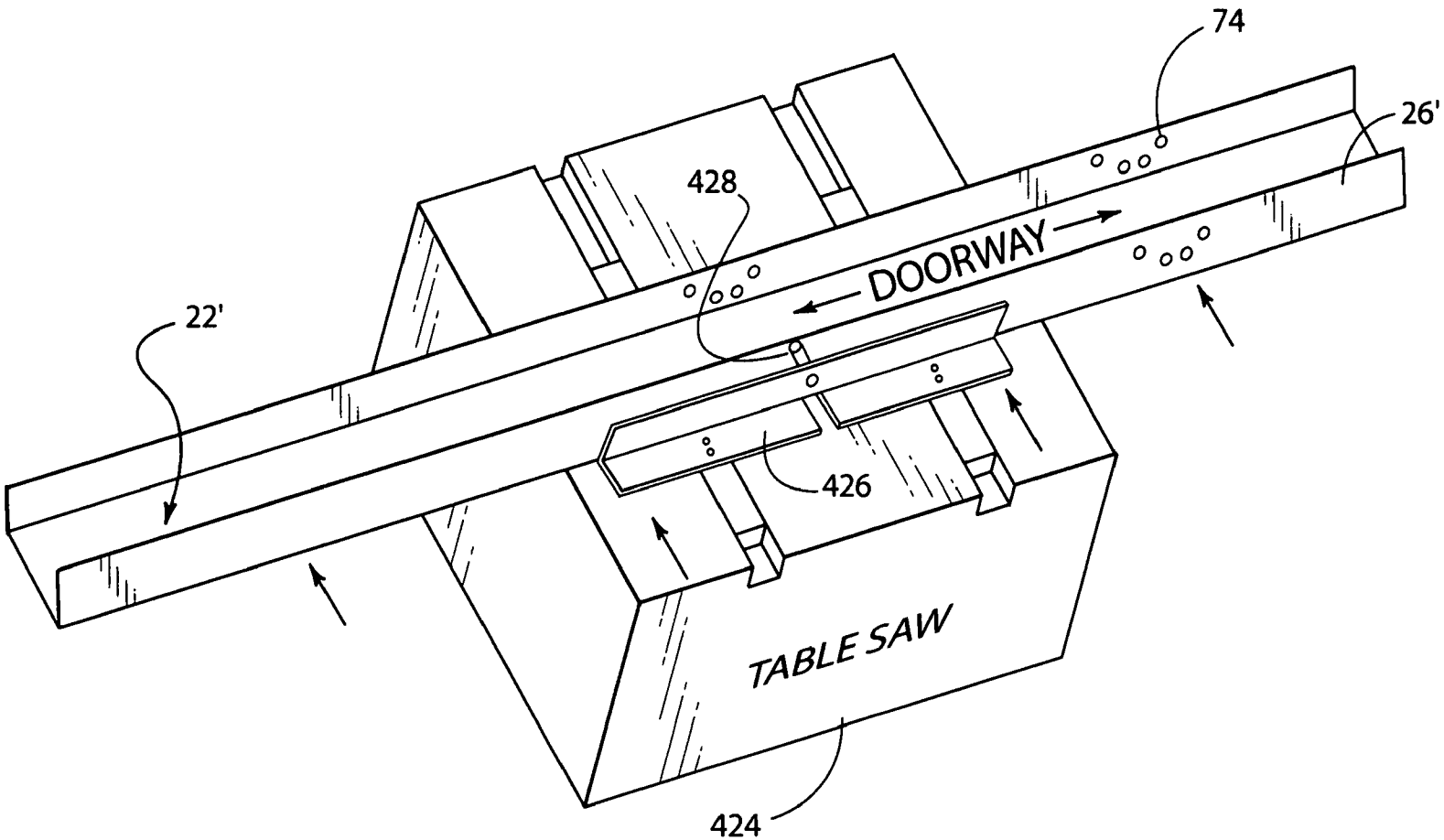
FIG. 64 is a top perspective view of a saw device for creating the embodiment illustrated in FIG. 63.

In certain instances, the foldable framed units need to incorporate doorways therein. In order to accomplish this and as illustrated in FIG. 63, the web 24' of the bottom track 22' is cut to form a pair of substantially parallel notches 420, 422 along the inside edges of adjacent studs 30'. The notches are approximately ⅛ inch deep. This leaves the track flanges 22' basically intact during shipping and framing erection on site. Once the frame is in place and before a door and frame are installed, the flanges 26' and 28' are cut with a hacksaw or snips at the notches 420, 422 to make easy removal across a door threshold after wall frame erection on-site. FIG. 64 illustrates a device and method of notching the lower track web 24' at a doorway site. The tracked 22' is positioned on a table saw 424, and a jig 426 includes a pin 428 sized to engage a hole 274 in the track flange 26' to position the table saw. The notches of 420, 422 are then created at the appropriate locations.

All framing used on exterior walls will be covered with some type of the sheathing. This can range from the wood plywood, wood chipboard, exterior grade sheetrock, high-density wood fiberboard, high-density foam board and similar other products. Almost all of these sheathing materials are fastened to the framing using self-drilling sheet-metal screws. These sheets are normally 4 ft. wide by 8, 9 or 10 ft. long. The sheathing can be cut to the required length and width with a skill type of electric handsaw. Panel saws are also commonly used and will do more accurate and faster cutting in most cases but are less common for on-site cutting. Their common meet used for implant penalizing where wall frame sections are shipped to a job site with a sheathing attached to the metal framing. One question to be addressed is where the sheathing can be most productively and cost-effectively attached to the metal framing, either in-plant or at the job site. In either case, cutting the sheathing on panel saws in-plant is more efficient. Moreover, a device which can pre-drill lines of screw attachment holes in the pre-cut sheathing panel sections can save time whether the sheathing is to be applied in-plant or on-site.

Referring now to FIGS. 65-70, a lateral bracing member 430 is illustrated and is particularly useful in providing lateral stability between studs attached to tracks, especially in the foldable frame embodiment just discussed above. The brace member 430 includes an elongated metal strip 432 having a flat center portion 434 and a pair of side wing portions 436, 438. Each wing portion includes a substantially flat end portion 440, 442 which are substantially parallel to the center portion 434, and an angularly inclined element 444, 446 which interconnects each of the flat end portions 440, 442, respectively, to the center portion 434. This arrangement creates a channel 448 defined between the center portion 434 and the inclined elements 444, 446.

One axial end portion includes a pair of opposing notches 450, 452 in the flat end portions 440, 442, respectively. A similar pair of notches 454, 456 are disposed in the flat end portions 440, 442, respectively, of the opposite axial end portion of the brace member 430. In addition, a third pair of opposing notches 458, 460 is defined in the flat end portions 440, 442, respectively, spaced proximate to the notches 454, 456. The distance between the notches 458, 460 and the notches 454, 456 is defined as distance "A", while the distance between the notches 450, 452 and the notches 454, 456 is defined as distance "B". In preferred form, the distance "A" is approximately equal to the width of a stud flange 26, while the distance "B" is approximately equal to the stud center-to-center distance in a wall frame structure.

Figures 65, 66:
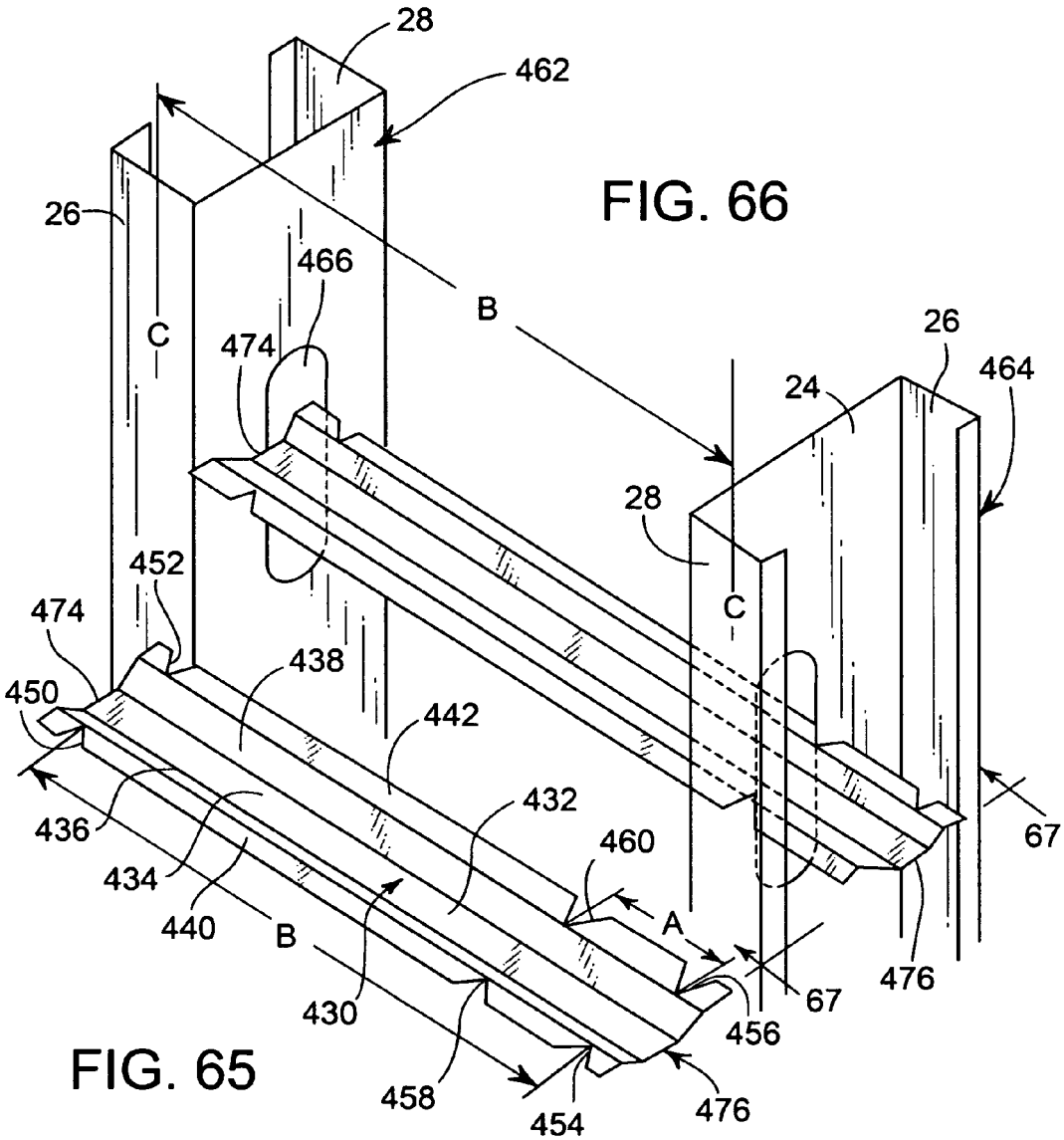
FIG. 65 is a side perspective view of a snap-on brace member for use between stud elements of a metal frame panel for support purposes.
FIG. 66 is a side perspective view of a snap-on brace member in position between a pair of spaced stud elements of a metal frame panel.
Figure 67:
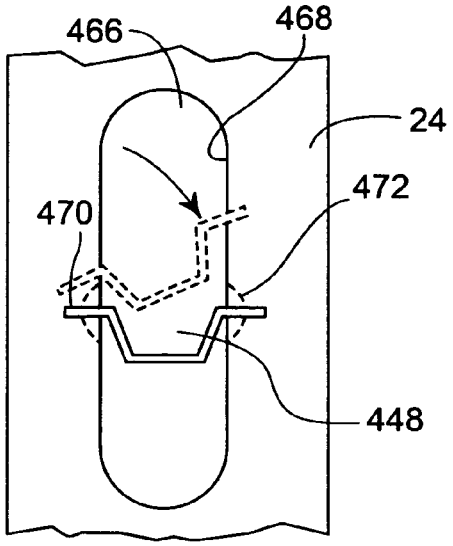
FIG. 67 is a front elevation view of the snap-on brace member in position in a metal frame panel as taken substantially along line 67-67 of FIG. 66.
Figure 68:
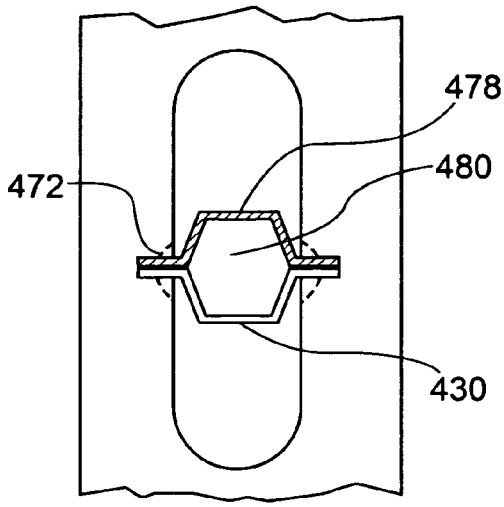
FIG. 68 is a front elevation view similar to FIG. 67 but illustrating two such snap-on brace members in position in a metal frame panel forming a conduit for wire.

In the illustrated embodiment, the webs 24 of adjoining studs 262, 264 each includes an elongated opening 466 defined by a side edge 468. These openings are typically stamped into the web 24. The openings 466 also include opposing notches or slots 470, 472. The brace member 430 is twisted so that one axial end 474 is inserted through a opening 466, and the notches 450, 452 interengaged snugly with the notches 470, 472 defined in the side edges 468 of the opening 466 as illustrated in FIG. 67. The notches 458, 460 of the opposite axial end 476 are similarly engaged with the notches 470, 472 of the next adjoining stud 464 so as to firmly snap fit the brace member 430 into place between the studs 462, 464 as illustrated in FIG. 66. This arrangement provides significant lateral support and strength to a wall frame. The second set of notches 454, 456 in the axial end portion 476 are provided for when the hard and soft sides of two adjoining studs are reversed from that illustrated in FIGS. 65 and 66.

Figure 69:
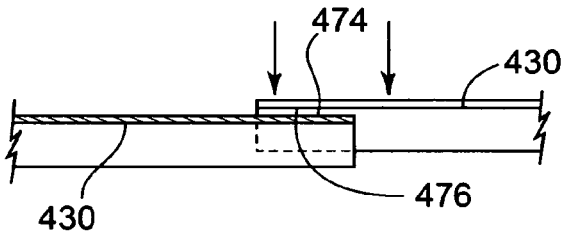
FIG. 69 is an expanded side view illustrating two snap-on brace members nested together to illustrate continuous connection.
Figure 70:
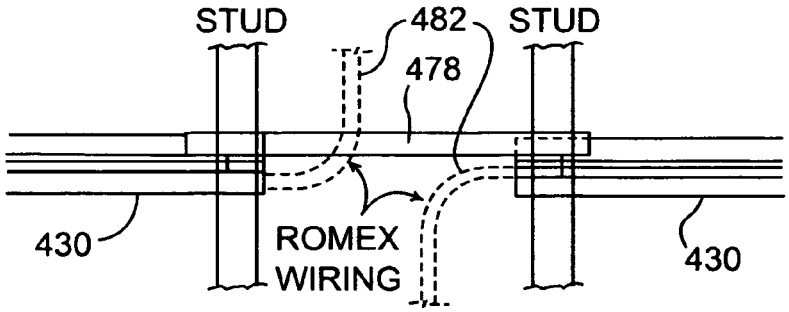
FIG. 70 is a side schematic illustrating a plurality of snap-on brace members in position in a metal frame panel forming a conduit for wire.

FIG. 69 illustrates how the overlapping ends 474, 476 of two separate brace members 230 can internest and snap into the same retaining slots or notches 470, 472 in a web opening 466 to provide a continuing brace support between several adjoining studs in a wall frame. Moreover, it should be clear that the brace members 430 can not only be hand fastened in place without the use of tools or fasteners, but they will also readily fold along with the foldable frame embodiments previously described. Finally, and with reference to FIGS. 68 and 70, a pair of brace members 430 and 478 can be snapped into place with the brace member 478 being inverted relative to the brace member 430. In this manner, the channels 448 of each of the brace members 430, 478 create a conduit opening 480 in the wall frames and through which wires 482 and the like may be threaded and run once the wall frame is erected.

Figure 71:
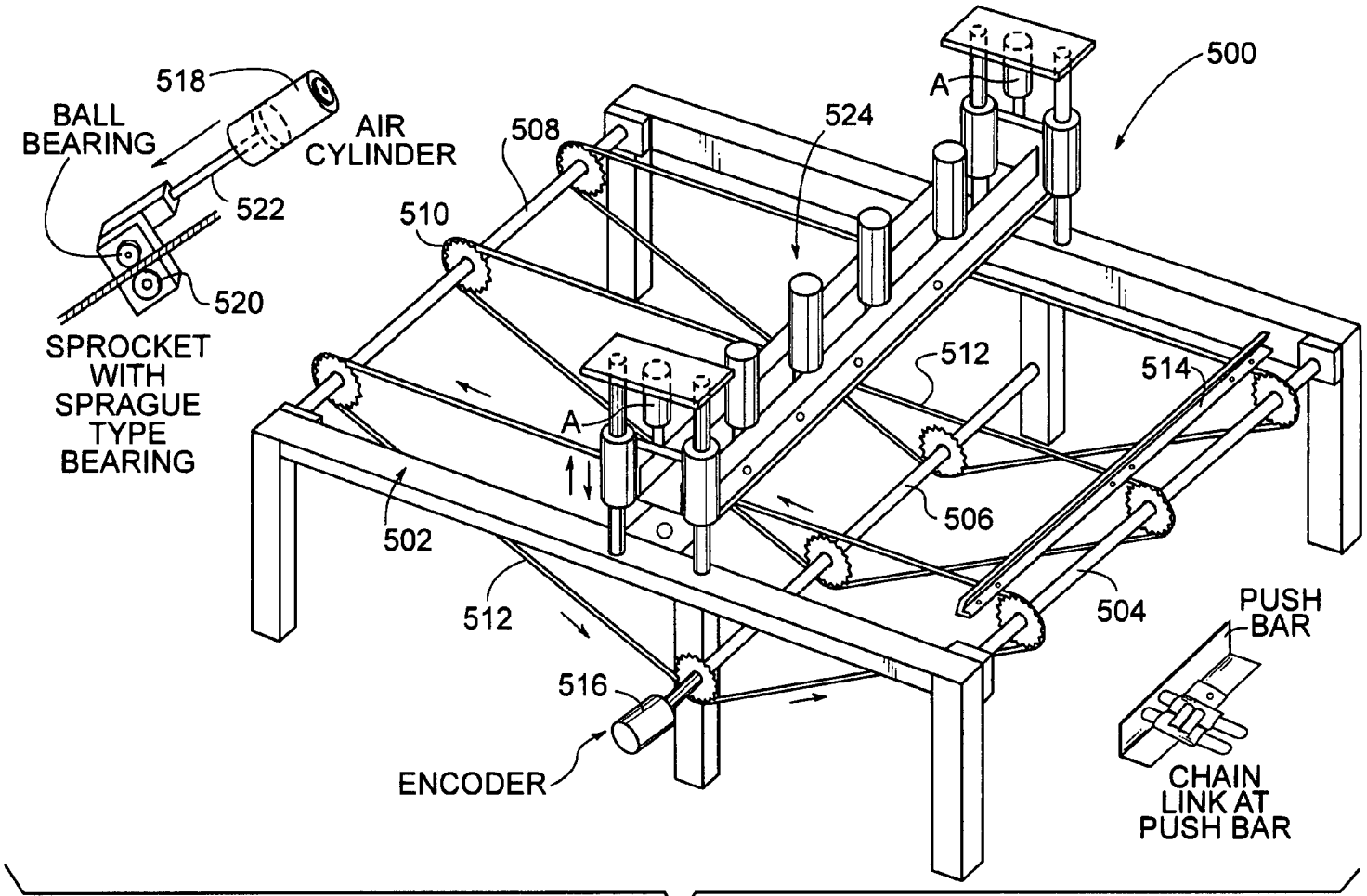
FIG. 71 is a front perspective of a sheathing fastener hole predriller device for use in the present invention.
Figure 72:
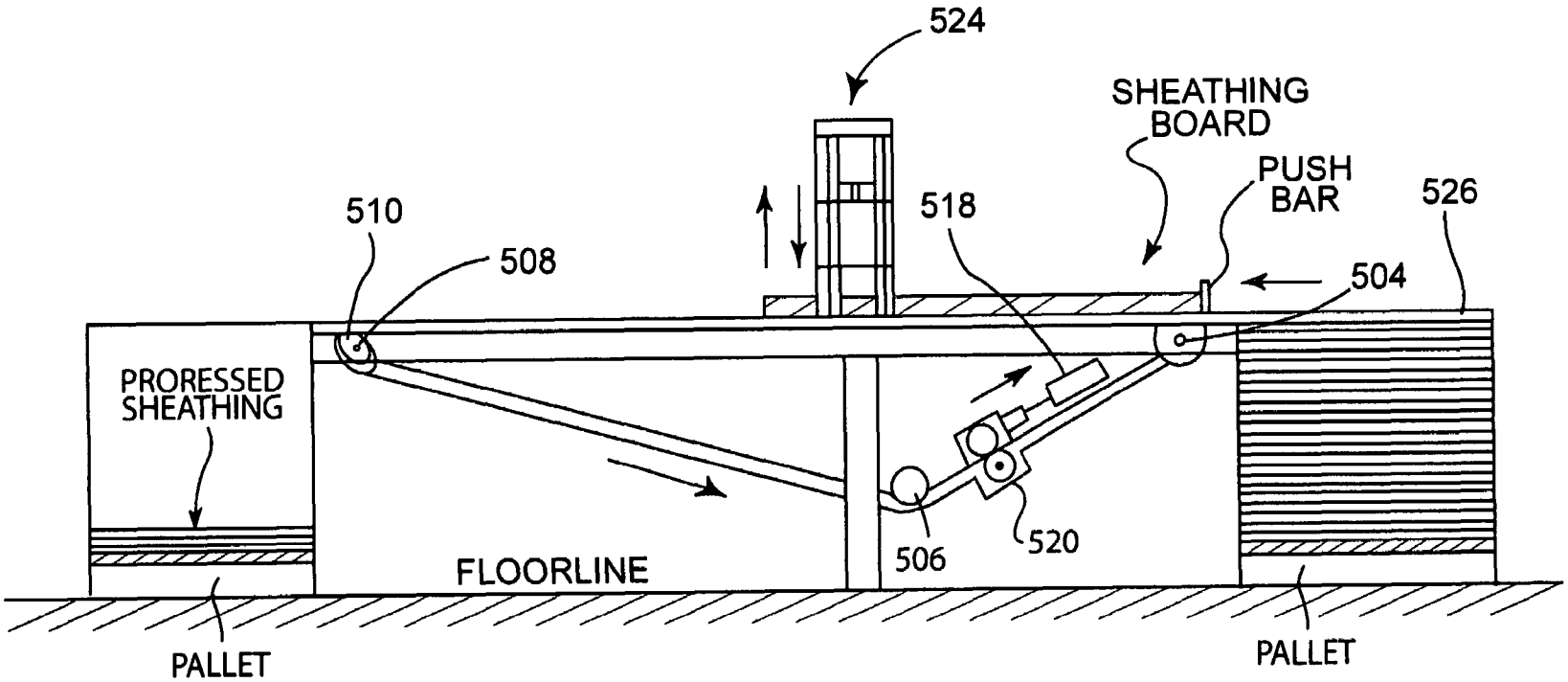
FIG. 72 is a side view of the device illustrated in FIG. 71.
Figure 73:
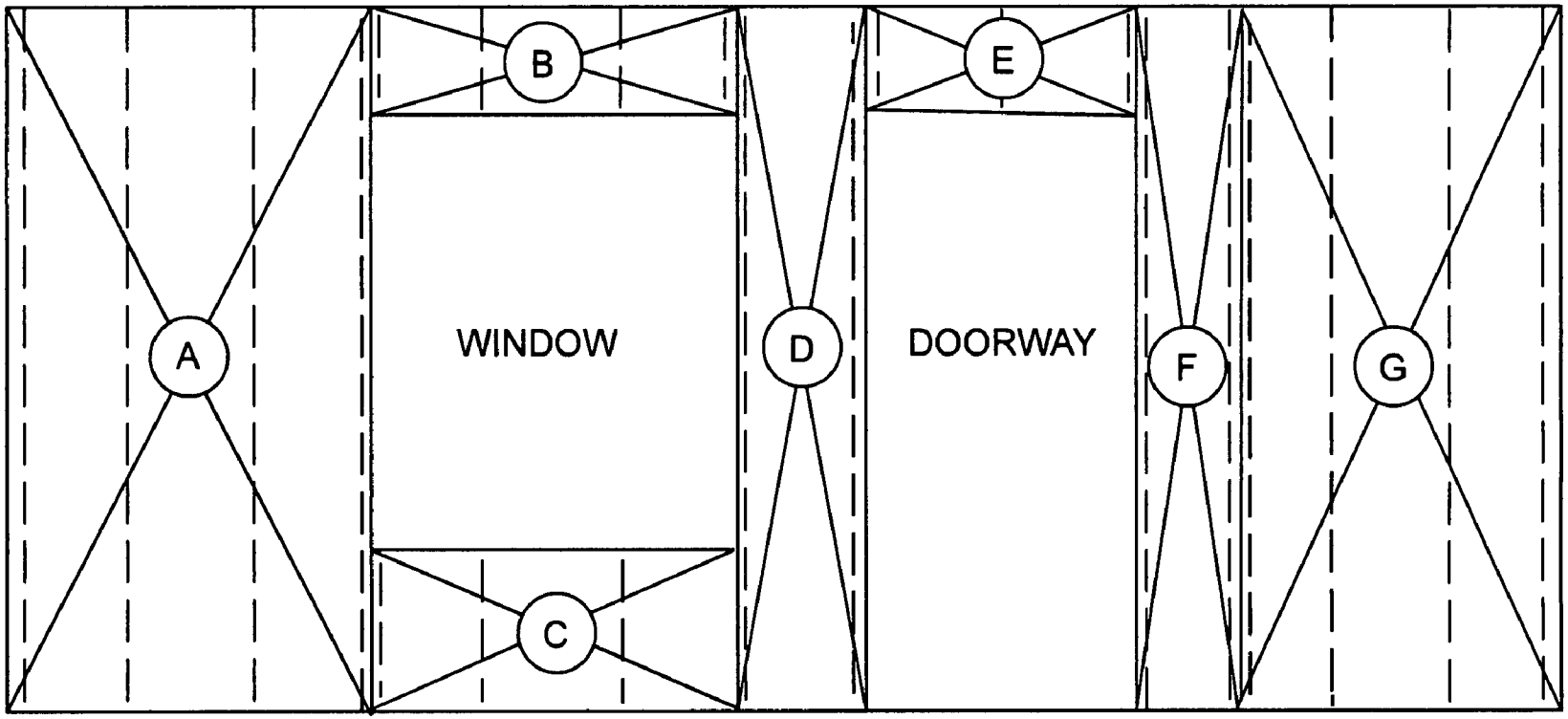
FIG. 73 is a plan view of a wall frame manufactured with the present invention and including the sheathing panels attached utilizing the embodiment illustrated in FIGS. 71-73.

Referring now to FIGS. 71-73, a sheathing assembly apparatus 500 is illustrated. A frame structure 502 is provided and preferably includes three drive shafts 504, 506 and 508. The shafts 504-508 move the various sprockets 510 which in turn move the chains or belts 512 that operate the push bar 514. An encoder 516 is coupled to a drive shaft 506. The chain 512 is moved by an air cylinder 518 which in turn moves a sprocket 520 with a Sprague-type needle bearing. A ball bearing keeps the chain 512 in mesh with the sprocket teeth. The Sprague 520 rolls freely as the piston in the air cylinder 518 retracts, but locks up with a sprocket pushing the chain forward on outward movement of the piston rod 522. This is the same basic mechanism used to move the two track members through the assembler device 240. There is preferably an embedded computer on board the sheathing device 500 which controls the movement of the cylinder and chain in relationship to the multiple drill head 524. The push bar 514 moves the sheathing panel under the drill head and stops as instructed by the computer.

While there is only one push bar 514 illustrated, there would preferably be others spaced approximately every 50 inches apart along the three drive chains 512. In preferred form, the sheathing panels 526 to be drilled would be stacked on a pallet at one end of the machine 500 and then placed by hand on the end of the machine. Alternatively, automated loader and unloader devices can be added. The panels move over the chains 512 to the drill heads 524, and screws are then attached to secure the sheathing to the frames. As a result, pre-made metal frames may be assembled in-plant and then covered with sheathing to produce a completed wall section for shipment to a job site as illustrated in FIG. 67.

As can be seen from the above, a new and unique roll forming apparatus and assembly device have been disclosed herein. The roll former of the present invention separates the sheet metal driving functions from the forming functions and consequently provides a much more efficient device that prevents stress and strain in the formed metal components. The invention also permits doubling the capacity by providing the simultaneous forming of two metal sheets into roll formed component parts. Self-adjusting clearances enable the device of the invention to automatically adjust for different metal gauges. The roll former of the invention is light weight and includes a completely unique metal coil delivery system. The present invention provides for the cutting, forming and punching of cold rolled metal components all in one throughput of the machine. The invention also provides a novel assembly device for rapidly and effectively securing the metal components produced by the novel roll former into wall frames without requiring any particular metal assembly skills. Moreover, the invention includes a unique and new approach to prefabricated wall frames by providing a new foldable wall frame structure that can be simply and easily erected on site without requiring metal working experience and training, thereby reducing the expense of erecting building structures as well as increasing the available work force for performing such tasks.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. An apparatus for roll forming metal components including substantially channel-shaped members for use in a building structure, said apparatus comprising:

a support frame assembly having front and rear portions;

a mechanism for selectively feeding at least one metal strip into said support frame assembly, said metal strip having a pair of side edges and a center web;

a plurality of driver roll elements mounted along said support frame assembly and adapted to move the metal strip through said frame assembly; and a plurality of spaced idler forming rolls mounted for free rotation in pairs along said support frame assembly and adapted to simultaneously air form the side edges of said metal strip into angularly extending side flanges by urging the side edges in opposing directions from said center web; and wherein said feeding mechanism is adapted to feed a pair of metal strips into said frame assembly, said metal strips having substantially congruent side edges and center webs, wherein said driver roll elements are adapted to move said paired strips substantially simultaneously through said frame assembly, and wherein said forming rolls simultaneously air form the side edges of said paired metal strips into angularly extending side flanges by urging the substantially congruent side edges of said paired strips in opposing directions from one another.

2. The apparatus as claimed in claim 1, wherein the side edges and center web portions of said pair of metal strips substantially abut each other as they enter the front portion of said support frame assembly.

3. The apparatus as claimed in claim 2, wherein each said forming roll includes a beveled outer circumferential edge sized and angled to substantially equally separate the edges of said paired metal strips and bend them outwardly away from each other as they pass along said frame assembly.

4. The apparatus as claimed in claim 3, wherein said driver roll elements comprise a plurality of sets of roller elements with each said set including at least one pair of roller elements, each said pair including an upper and lower roller element disposed, respectively, above and below said at least one metal strip along said frame assembly, and wherein the outer circumferential edge of each said driver roll element is tapered to form a beveled surface substantially parallel to the beveled outer circumferential edge of an adjacent forming roll.

5. The apparatus as claimed in claim 3, wherein the angles formed by the beveled circumferential edges of said plurality of pairs of forming rolls progressively increase from the front to the rear portions of said frame assembly to form the channel-shaped members from said metal strips.

6. The apparatus as claimed in claim 5, wherein said channel-shaped members comprise track elements having side flanges at approximately right angles relative to the center web portion thereof.

7. The apparatus as claimed in claim 5, wherein said channel-shaped members comprise stiffened edge stud elements having side flanges at approximately right angles relative to the center web portion thereof, and ledge extensions forming a pair of lip elements projecting inwardly toward each other from the distal end edges of said side flanges.

8. The apparatus as claimed in claim 5, wherein said plurality of pairs of forming rolls comprise nine to twelve sets of paired forming rolls spaced along said frame assembly.

9. The apparatus as claimed in claim 5, wherein said channel-shaped members comprise track elements having side flanges at approximately right angles relative to the center web portion thereof, and wherein the angles formed by the beveled circumferential edges of said plurality of pairs of forming rolls are sized and shaped such that said paired metal strips engage all but the first two sets of said forming rolls to form said track elements.

10. The apparatus as claimed in claim 5, wherein said channel-shaped members comprise stiffened edge stud elements having side flanges at approximately right angles relative to the center web portion thereof, and ledge extensions forming a pair of lips projecting inwardly toward each other from the distal end edges of said side flanges, and wherein said paired metal strips engage all sets of said forming rolls to form said stud elements, the first few sets of forming rolls being sized and shaped to form said projecting lip portions of said stud elements.

11. The apparatus as claimed in claim 1, wherein said mechanism for selectively feeding said paired metal strips into said frame assembly comprises a device for attaching a connector element between the two strips to join them together to prevent relative slippage therebetween as the paired strips move through said frame assembly.

12. The apparatus as claimed in claim 11, wherein said connector element attachment device comprises a screw gun mounted to said frame assembly.

13. The apparatus as claimed in claim 1, wherein said mechanism for selectively feeding said paired metal strips into said frame assembly comprises a pair of steel coil rolls each providing one said metal strip therefrom, a cradle assembly for each said coil roll having at least three support rollers for supporting and rotating said coil roll to play out said metal strips, and an alignment mechanism for engaging the metal strips from both said coil rolls to establish a slack loop for the metal strips and ensure proper alignment between the substantially congruent strips and firm engagement between the front portion of said frame assembly and said substantially congruent metal strips.

14. The apparatus as claimed in claim 13, wherein said alignment mechanism comprises a tensioner member having a biasing mechanism for maintaining the slack loop.

15. The apparatus as claimed in claim 13, wherein each said cradle assembly includes four support rollers, at least three of which drive and rotate said coil roll, and wherein said alignment mechanism comprises a pair of spaced roller conveyor members for forming said slack loop.

16. The apparatus as claimed in claim 13, wherein said mechanism for selectively feeding said substantially congruent metal strips into said frame assembly further comprises a shearing device for simultaneously cutting said paired strips into preestablished substantially identical lengths as they pass through said frame assembly and are formed into metal components.

17. The apparatus as claimed in claim 16, wherein said mechanism for selectively feeding said substantially congruent metal strips into said frame assembly further comprises a pair of encoder elements each associated with one said metal strip, said encoder elements being adapted to measure and select said preestablished metal strip lengths to identify where said shearing device is to make said cuts.

18. The apparatus as claimed in claim 17, wherein said encoder elements are in the form of magnetic wheels to substantially prevent friction, slippage and squeeze between said wheels and said metal strips prior to entry into said frame assembly.

19. The apparatus as claimed in claim 16, wherein said shearing device comprises a double shear mechanism to provide both blanking and guillotine shearing actions.

20. The apparatus as claimed in claim 1, wherein said driver roll elements comprise a plurality of sets of roller elements with each said set including at least one pair of roller elements, each said pair including an upper and lower roller element disposed, respectively, above and below said at least one metal strip along said frame assembly, and wherein said apparatus further comprises an adjustment mechanism associated with each said pair of upper and lower driver roll elements, said adjustment mechanism automatically adjusting the clearance of said driver roll elements in said frame assembly for variations in metal strip thickness and differences in metal strip gauges.

21. The apparatus as claimed in claim 20, wherein said adjustment mechanism includes a stop member disposed between the upper and lower driver roll elements of each said pair of driver roll elements to prevent them from directly contacting each other.

22. The apparatus as claimed in claim 20, wherein said adjustment mechanism comprises at least one disc spring.

23. The apparatus as claimed in claim 20, wherein said adjustment mechanism comprises a laminated urethane block.

24. The apparatus as claimed in claim 20, wherein said adjustment mechanism comprises a hydraulic cylinder.

25. The apparatus as claimed in claim 20, wherein each said pair of driver roll elements is aligned adjacent to a second pair of driver roll elements to form a set of four driver roll elements disposed proximate to each other through which said at least one metal strip is moved, the upper driver roll elements of each set of driver roll elements being adapted to slide fit and float on a first shaft while separated by a first spacer key therebetween, and the lower driver roll elements of each set of driver roll elements being adapted to slide fit and float on a second shaft while being separated by a second spacer key therebetween, the driver roll elements of each set of elements being disposed to float on their respective shafts to minimize pinching and stress on the metal strip being moved between each pair of upper and lower driver roll elements.

26. An apparatus for roll forming metal components including substantially channel-shaped members for use in a building structure, said apparatus comprising:

a support frame assembly having front and rear portions;

a mechanism for selectively feeding at least one metal strip into said support frame assembly, said metal strip having a pair of side edges and a center web;

a plurality of driver roll elements mounted along said support frame assembly and adapted to move the metal strip through said frame assembly; and a plurality of spaced idler forming rolls mounted for free rotation in pairs along said support frame assembly and adapted to simultaneously air form the side edges of said metal strip into angularly extending side flanges by urging the side edges in opposing directions from said center web;

wherein said feeding mechanism is adapted to feed a pair of metal strips into said frame assembly, said metal strips having substantially congruent side edges and center webs, wherein said driver roll elements are adapted to move said paired strips substantially simultaneously through said frame assembly, and wherein said forming rolls simultaneously air form the side edges of said paired metal strips into angularly extending side flanges by urging the substantially congruent side edges of said paired strips in opposing directions;

wherein the side edges and center web portions of said pair of metal strips substantially abut each other as they enter the front portion of said support frame assembly; and wherein each said forming roll includes a beveled outer circumferential edge sized and angled to substantially equally separate the edges of said paired metal strips and bend them outwardly away from each other as they pass along said frame assembly.

* * * * *